US012742301B2

(12) United States Patent
Omae et al.

(10) Patent No.: US 12,742,301 B2
(45) Date of Patent: Sep. 22, 2026

(54) WORK VEHICLE, METHOD OF CONTROLLING WORK VEHICLE, AND CONTROLLER FOR WORK VEHICLE

(71) Applicant: KUBOTA CORPORATION, Osaka (JP)

(72) Inventors: Ken Omae, Sakai (JP); Ryuki Nishimoto, Sakai (JP); Ken Uno, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 62 days.

(21) Appl. No.: 18/882,767

(22) Filed: Sep. 12, 2024

(65) Prior Publication Data

US 2025/0084610 A1 Mar. 13, 2025

(30) Foreign Application Priority Data

Sep. 13, 2023 (JP) ..... 2023-148800

(51) Int. Cl.
*E02F 3/43* (2006.01)
*E02F 9/22* (2006.01)

(52) U.S. Cl.
CPC ..... *E02F 3/435* (2013.01); *E02F 9/2225* (2013.01); *E02F 9/2267* (2013.01); *E02F 9/2285* (2013.01)

(58) Field of Classification Search
CPC ..... E02F 3/435; E02F 9/2225; E02F 9/2267; E02F 9/2285; E02F 3/439; E02F 9/265
See application file for complete search history.

(56) References Cited

U.S. PATENT DOCUMENTS

| | | | | |
|---|---|---|---|---|
| 7,894,962 | B2 | 2/2011 | Sahlin et al. | |
| 11,655,615 | B1 | 5/2023 | Abe et al. | |
| 2009/0018729 | A1* | 1/2009 | Sahlin | E02F 3/847 701/50 |

FOREIGN PATENT DOCUMENTS

| | | |
|---|---|---|
| JP | 07-509294 | 10/1995 |
| JP | 6919479 B2 | 4/2019 |
| JP | 2023-115701 | 8/2023 |
| WO | WO 94/26988 | 11/1994 |

* cited by examiner

*Primary Examiner* — Scott A Browne
*Assistant Examiner* — Josephine Elizabeth Rich
(74) *Attorney, Agent, or Firm* — MORI & WARD, LLP

(57) ABSTRACT

A work vehicle includes a memory configured to store first information corresponding to a reference direction which is a standard of an implement direction, and second information corresponding to a reference height which is a standard of an arm height, an input device configured to receive an instruction to perform automatic control for changing the implement direction and the arm height respectively to the reference direction and the reference height, and control circuitry configured to control the hydraulic circuit so that the arm height and the implement direction respectively approach the reference height and the reference direction in response to the instruction received by the input device. The control circuitry is configured to control a hydraulic circuit so that during the automatic control, the implement direction is changed to the reference direction when the arm height reaches a target height which is greater than the reference height.

20 Claims, 21 Drawing Sheets

25 (20)

WORK VEHICLE, METHOD OF CONTROLLING WORK VEHICLE, AND CONTROLLER FOR WORK VEHICLE

CROSS-REFERENCE TO RELATED APPLICATIONS

The present application claims priority under 35 U. S. C. § 119 to Japanese Patent Application No. 2023-148800, filed Sep. 13, 2023. The contents of this application are incorporated herein by reference in their entirety.

BACKGROUND

Technical Field

The present disclosure relates to a work vehicle, a method for controlling the work vehicle, and a controller for the work vehicle.

Discussion of the Background

U.S. Pat. No. 7,894,962 discloses a work vehicle capable of executing automatic implement return control for changing the position and posture of an implement and an arm from those when a load is dumped to a reference position and posture of the implement and the arm stored in advance.

SUMMARY

In accordance with one aspect of the present disclosure, a work vehicle includes a joint, an implement, an arm assembly, a vehicle body, a traveling device, a first hydraulic cylinder, a second hydraulic cylinder, a hydraulic circuit, an implement posture detection sensor, an arm posture detection sensor, a memory, control circuitry, and an input device. The implement is connected to the joint and includes an implement tip opposite to the joint. The arm assembly includes an arm distal end and arm proximal end opposite to the arm distal end. The arm distal end is connected to the joint to swingably support the implement. The vehicle body is configured to swingably support the arm proximal end. The traveling device is configured to move the vehicle body. The first hydraulic cylinder is configured to control an implement direction from the joint to the implement tip. The second hydraulic cylinder is configured to control an arm height which is a height of the arm distal end with respect to a ground contact surface of the traveling device in a height direction perpendicular to the traveling direction of the traveling device. The hydraulic circuit is configured to control the first hydraulic cylinder and the second hydraulic cylinder. The implement posture detection sensor is configured to detect the implement direction. The arm posture detection sensor is configured to detect the arm height. The memory is configured to store first information corresponding to a reference direction which is a standard of the implement direction, and second information corresponding to a reference height which is a standard of the arm height. The control circuitry is configured to control the hydraulic circuit. The input device is configured to receive an instruction to perform automatic control for changing the implement direction and the arm height respectively to the reference direction and the reference height. The control circuitry is configured to control the hydraulic circuit so that the arm height and the implement direction respectively approach the reference height and the reference direction in response to the instruction received by the input device. The control circuitry is configured to control the hydraulic circuit so that during the automatic control, the implement direction is changed to the reference direction when the arm height reaches a target height which is greater than the reference height.

In accordance with another aspect of the present disclosure, a control method of a work vehicle includes acquiring a reference direction which is a standard of an implement direction from a joint to an implement tip of an implement, the joint rotatably connecting the implement to an arm distal end of the work vehicle. The control method includes acquiring a reference height which is a standard of an arm height which is a height of the implement tip with respect to a ground contact surface of a traveling device of the work vehicle in a height direction perpendicular to a traveling direction of the traveling device. The control method includes controlling a second hydraulic cylinder of the work vehicle such that the arm height approaches the reference height in response to an instruction to perform automatic control to change the implement direction and the arm height to the reference direction and the reference height, respectively. The control method includes controlling a first hydraulic cylinder of the work vehicle to change the implement direction in accordance with change in the arm height such that the implement direction is changed to the reference direction when the arm height reaches a target height which is greater than the reference height.

In accordance with further aspect of the present disclosure, a controller for a work vehicle, includes a memory and a processor. The memory is configured to store a first reference value and a second reference value, the first reference value corresponding to a reference direction which is a standard of an implement direction of a first parameter, the first parameter representing the implement direction representing an implement direction to an implement tip of an implement from a joint that rotatably connects the implement, the second reference value corresponding to a reference height which is a standard of an arm height of a second parameter, the second parameter representing the arm height which is a height of the implement tip with respect to a ground contact surface of a traveling device of the work vehicle in a height direction perpendicular to a traveling direction of the traveling device. The process is configured to control a second hydraulic cylinder of the work vehicle such that the arm height approaches the reference height in response to an instruction to perform automatic control to change the implement direction and the arm height to the reference direction and the reference height, respectively. The process is configured to control a first hydraulic cylinder of the work vehicle to change the implement direction in accordance with change in the arm height such that the implement direction is changed to the reference direction when the arm height reaches a target height which is greater than the reference height.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
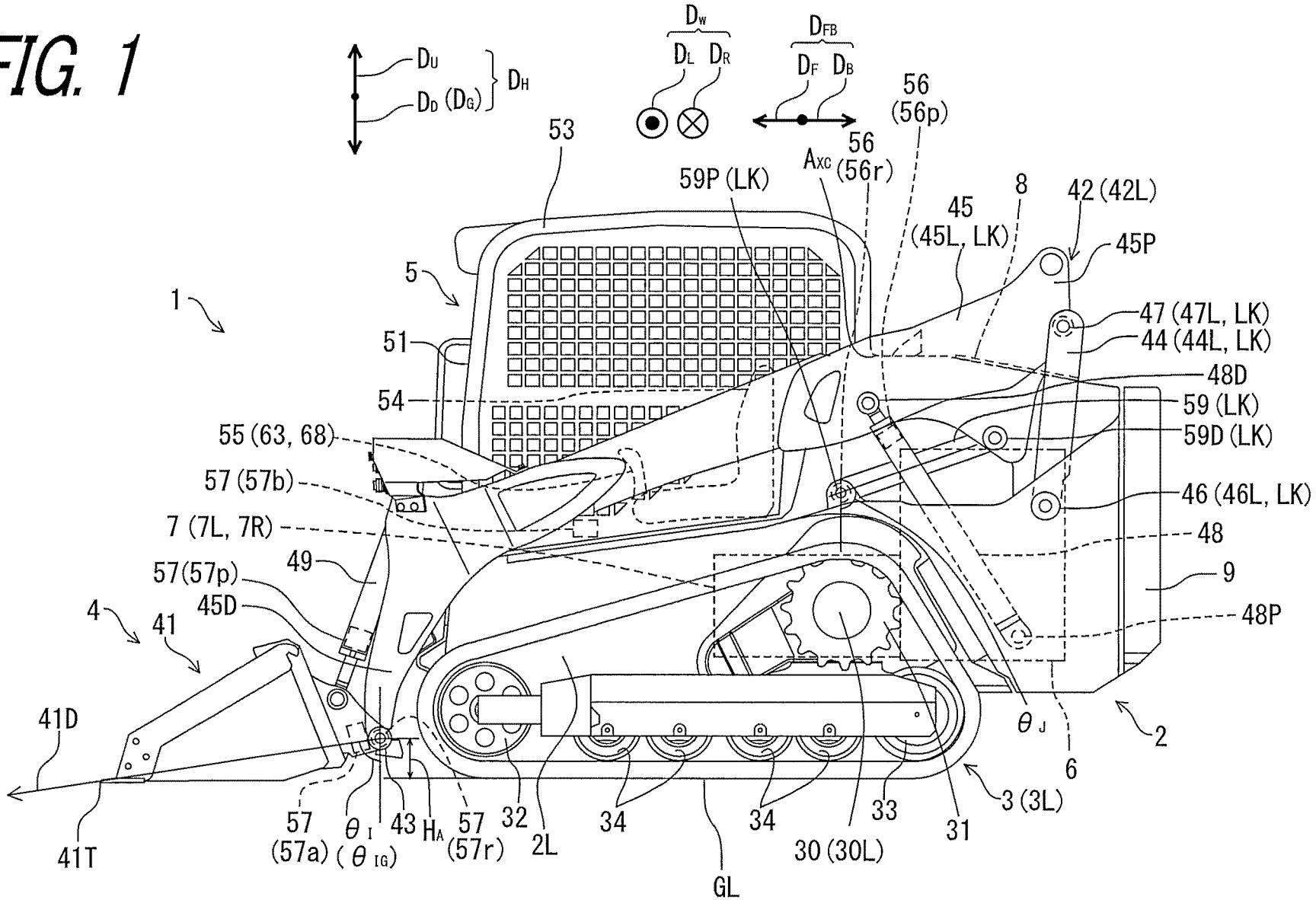
FIG. 1 is a side view of a work vehicle.

Hereinafter, embodiments of the present disclosure will be described with reference to the accompanying drawings. Similar reference numerals indicate corresponding or identical configurations in each figure.

Figure 2:
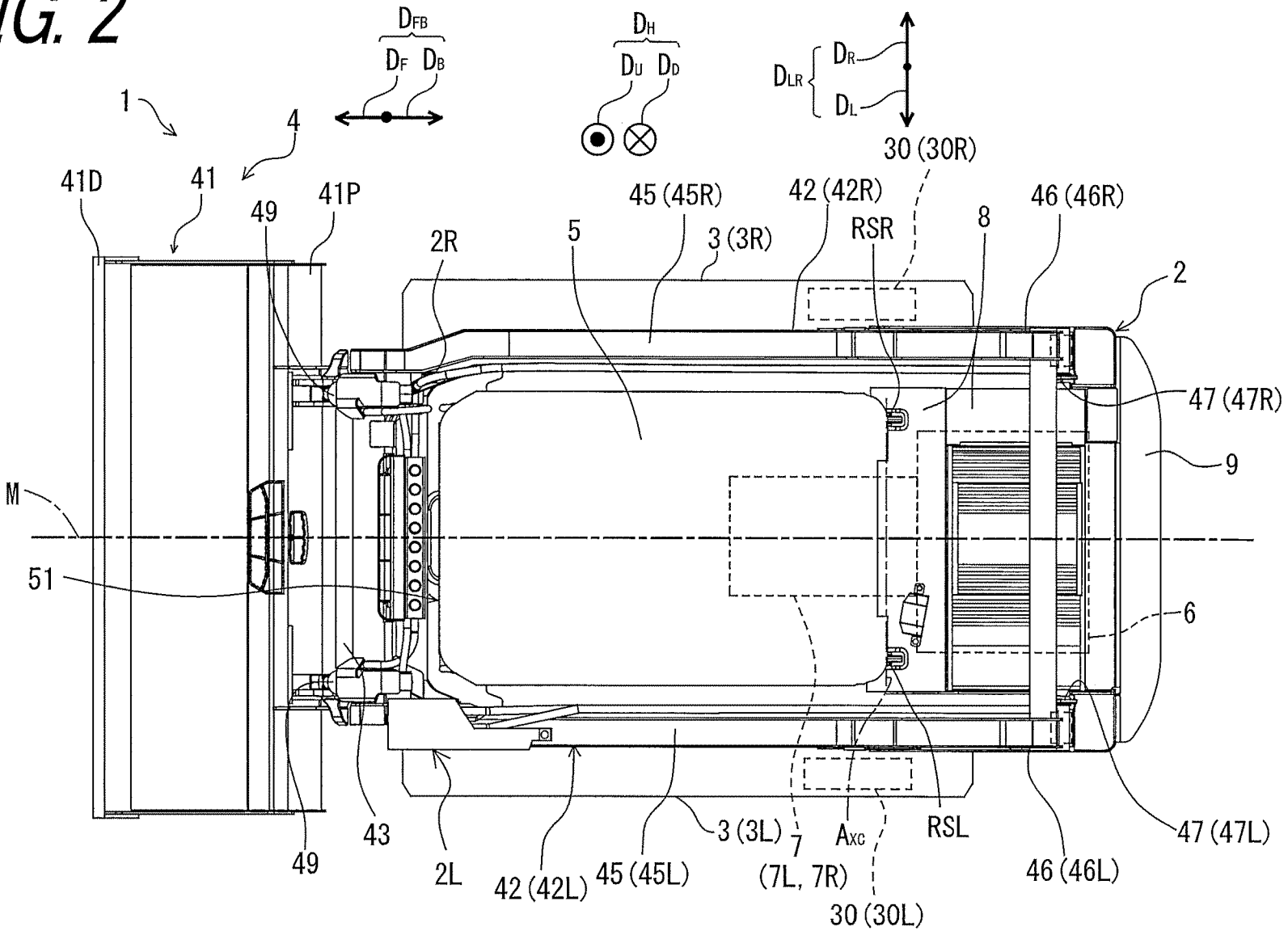
FIG. 2 is a top view of the work vehicle.

Referring to FIGS. 1 and 2, a work vehicle 1, for example, a compact truck loader, includes a vehicle body 2, a pair of traveling devices 3, and a working device 4. The vehicle body 2 supports the traveling device 3 and the working device 4. The traveling device 3 is configured to move the vehicle body 2. In the illustrated embodiment, the traveling device 3 is a crawler type traveling device 3. Therefore, each of the pair of traveling devices 3 includes a drive wheel 31, driven wheels 32 and 33, and a rolling wheel 34, which are driven by the hydraulic motor device 30. However, each of the pair of traveling devices 3 is not limited to the crawler type traveling device 3. Each of the pair of traveling devices 3 may be, for example, a front wheel/rear wheel traveling device 3 or a traveling device 3 having a front wheel and a rear crawler. The working device 4 includes an implement 41 at the distal end of the working device 4 and a joint 43 connected to the implement 41. In FIGS. 1 and 2, a bucket is illustrated as an example of the implement 41. The implement 41 has an implement tip 41T which is opposite to the joint 43. The joint 43 is, for example, a pivot shaft. A proximal end of the working device 4 is attached to a rear portion of the vehicle body 2. The working device 4 includes a pair of arm assemblies 42 for rotatably supporting the implement 41 via the joint 43. Each of the pair of arm assemblies 42 includes a first link 44, arm 45, and a link mechanism LK including a second link 59. The arm 45 includes an arm distal end 45D that swingably supports the implement 41 at the joint 43 and an arm distal end 45D opposite to the arm proximal end 45P. The arm distal end 45D swingably supports a joint 43. The vehicle body 2 swingably supports the arm proximal end 45P. To be more specific, the vehicle body 2 swingably supports the arm proximal end 45P via the first link 44 and the second link 59. The link mechanism LK is configured to couple the arm distal end 45D onto the vehicle body 2.

The first link 44 is rotatable around a fulcrum shaft 46 with respect to the vehicle body 2. The second link 59 is rotatable around a fulcrum shaft 59P with respect to the vehicle body 2. An arm 45 is rotatable around a joint shaft 47 with respect to the first link 44. The arm 45 is rotatable about the joint shaft 59D with respect to the second link 59. The arm 45 operates with one degree-of-freedom because of a link defined by two free ends (joint shaft 47, joint shaft 59D) of the four joint link mechanism LK including two fixed ends (fulcrum shaft 46, fulcrum shaft 59P) and two free ends (joint shaft 47, joint shaft 59D). That is, the position of the joint 43 is uniquely determined by the rotation angle $\theta_J$ of the fulcrum shaft 59P.

The work vehicle 1 further includes a plurality of second hydraulic cylinder 48. Each of the plurality of second hydraulic cylinder 48 is rotatably connected to the vehicle body 2 and the arm 45, and moves the first link 44, the arm 45, and the like to raise and lower the implement 41. That is, each of the plurality of second hydraulic cylinder 48 is configured to control an arm height $H_A$ which is a height of the arm distal end 45D with respect to the ground contact surface GL of the traveling device 3 in the height direction $D_H$ perpendicular to the traveling direction of the traveling device 3. For convenience, the height of arm distal end 45D is the height of joint 43. That is, the arm height $H_A$ is a distance between the ground contact surface GL of the traveling device 3 and the joint 43 in the height direction $D_H$. The work vehicle 1 includes an arm posture detection sensor 56 configured to detect a rotation angle $\theta_J$ of the fulcrum shaft 59P to detect the position of the arm distal end 45D (joint 43). The arm posture detection sensor 56 is a rotation angle detection sensor configured to detect rotation angle $\theta_J$ of a joint (fulcrum shaft 59P) of the link mechanism LK. In FIG. 1, for the sake of simplicity, an angle formed by a vector from the center of the fulcrum shaft 59P toward the downward direction $D_D$ and a vector from the center of the fulcrum shaft 59P toward the center of the joint shaft 59D is illustrated as the rotation angle $\theta_J$, but other angles may be used. The arm posture detection sensor 56 includes a potentiometer 56*r*, for example. The arm posture detection sensor 56 is configured to detect an arm height $H_A$. Here, the parameter representing the arm height $H_A$ is referred to as a second parameter. The rotation angle $\theta_J$ is an example of a second parameter.

The work vehicle 1 further includes at least one first hydraulic cylinder 49. The at least one first hydraulic cylinder 49 is configured to control the implement direction 41D from the joint 43 towards the implement tip 41T. The work vehicle 1 is provided with an implement posture detection sensor 57 for detecting an implement direction 41D. The implement posture detection sensor 57 includes, as an example, a first inertial measurement unit (IMU) 57*a* attached to the implement 41 and a second inertial measurement unit (IMU) 57*b* attached to the vehicle body 2. The first inertial measurement unit 57*a* and the second inertial measurement unit 57*b* each include at least an accelerometer and a gyroscope, and can detect the gravity direction $D_G$. That is, the first inertial measurement unit 57*a* can detect the second angle $\theta_{IG}$ formed by the implement direction 41D and the gravity direction $D_G$. The second inertial measurement unit 57*b* can detect a first angle $\theta_{VG}$ (not illustrated) formed by the vehicle reference direction (a posture of the vehicle body 2 is defined by the vehicle reference direction. For example, the vehicle reference direction is the vehicle downward direction $D_D$) and the gravity direction $D_G$. FIG. 1 shows an example in which the work vehicle 1 is placed on a horizontal plane, and the first angle $\theta_{VG}$ is 0 degrees with the downward direction $D_D$ as the vehicle reference direction. The work vehicle (the controller 15 as described later) acquires the first angle $\theta_{VG}$ from the signal outputted from the second inertial measurement unit 57*b*, and the second angle $\theta_{IG}$ from the signal outputted from the first inertial measurement unit 57*a*, and obtains the implement inclination angle $\theta_I$ between the implement direction 41D and the vehicle reference direction (e.g., the vehicle-downward direction $D_D$) with reference to the first angle $\theta_{VG}$ and the second angle $\theta_{IG}$. Here, the parameter representing the implement direction 41D is referred to as a first parameter. The implement inclination angle $\theta_I$ is an example of a first parameter.

The arm posture detection sensor 56 may be a linear sensor 56*p* that detects the position PA of the second hydraulic cylinder 48 instead of the potentiometer 56*r*. The implement posture detection sensor 57 may be a linear sensor 57*p* that detects the position $P_I$ of the first hydraulic cylinder 49, instead of the first inertial measurement unit 57*a* and the second inertial measurement unit 57*b*. An example of such a linear sensor is a sensor for detecting a stroke in a hydraulic cylinder, which is described in introduction of products, KYB Giho No. 54 (April 2017), pages 75 to 78. The implement posture detection sensor 57 may be a potentiometer 57*r* for detecting rotation angle $\theta_R$ of the joint 43, instead of the first inertial measurement unit 57*a*, the second inertial measurement unit 57*b* or the linear sensor 57*p*. The position $P_I$ and the rotation angle $\theta_R$ of the first hydraulic cylinder 49 are another example of the first parameter. The position $P_A$ of the second hydraulic cylinder 48 is another example of the second parameter.

The vehicle body 2 includes a cabin 5. The cabin 5 includes a front window 51 that can be opened and closed, and the outer shape of the cabin 5 is defined by a cab frame 53. The front window 51 may be omitted. The work vehicle 1 includes the operator's seat 54 and the operation lever 55 (the arm input member 63 and the implement input member 68) in the cabin 5. As shown in FIG. 2, the cab frame 53 is rotatable around rotational shafts RSL and RSR on the vehicle body 2. In FIGS. 1 and 2, the common pivot axis $A_{XC}$ defined by the rotational shafts RSL and RSR is illustrated. That is, the cab frame 53 is attached to the vehicle body 2 to be rotatable around the pivot axis $A_{XC}$.

In the embodiment according to the present application, a front-back direction $D_{FB}$ (forward direction $D_D$/backward direction DB) means a front-back direction (forward direction/backward direction) as seen from an operator seated on the operator's seat 54 of the cabin 5. A leftward direction $D_L$, a rightward direction DR, a width direction $D_W$ means the left direction, the right direction, and the left-right direction as viewed from the operator, respectively. An upward direction $D_U$, a downward direction $D_D$, height direction $D_H$ means an upward direction, a downward direction, and a height direction as viewed from the operator. The front-back, left-right (width), and up-down (height) directions of the work vehicle 1 coincide with the front-back, left-right (width), and up-down (height) directions as viewed from the operator, respectively.

FIG. 1 shows the left side of the work vehicle 1. As shown in FIG. 2, the vehicle body 2 is substantially symmetrical with respect to the vehicle body center plane M and includes a first side surface 2L and a second side surface 2R which is a right side surface. Among the pair of traveling devices 3, the traveling device 3 provided on the first side surface 2L is shown as a first traveling device 3L, and the traveling device 3 provided on the second side surface 2R is shown as a second traveling device 3R. Among the pair of arm assemblies 42, an arm assembly 42 provided on the left side with respect to the vehicle body center plane M is referred to as a first arm assembly 42L, and an arm assembly 42 provided on the right side with respect to the vehicle body center plane M is referred to as a second arm assembly 42R. The first link 44 provided on the left side with respect to the vehicle body center plane M is shown as a first left link 44L. The arm 45 provided on the left side with respect to the vehicle body center plane M is shown as a first arm 45L, and the arm 45 provided on the right side with respect to the vehicle body center plane M is shown as a second arm 45R. The fulcrum shaft 46 provided on the left side with respect to the vehicle body center plane M is shown as a first fulcrum shaft 46L, and the fulcrum shaft 46 provided on the right side with respect to the vehicle body center plane M is shown as a second fulcrum shaft 46R. The joint shaft 47 provided on the left side with respect to the vehicle body center plane M is shown as a first joint shaft 47L, and the joint shaft 47 provided on the right side with respect to the vehicle body center plane M is shown as a second joint shaft 47R. Among the hydraulic motor devices 30, the hydraulic motor device 30 provided on the left side with respect to the vehicle body center plane M is the first hydraulic motor device 30L, and the hydraulic motor device 30 provided on the right side with respect to the vehicle body center plane M is shown as a second hydraulic motor device 30R.

Referring to FIGS. 1 and 2, the work vehicle 1 includes an engine 6 provided at a rear portion of a vehicle body 2, and a plurality of hydraulic pumps including a rotation speed detection sensor 6*a*; a first traveling hydraulic pump 7L, and a second traveling hydraulic pump. The engine 6 is configured to drive the plurality of hydraulic pumps 7. The rotation speed detection sensor 6*a* is configured to detect the rotation speed of the engine 6. The first traveling hydraulic pump 7L and the second traveling hydraulic pump 7R are configured to discharge the hydraulic fluid for driving the hydraulic motor device 30 and the like that drives the drive wheel 31. The plurality of hydraulic pumps other than the first traveling hydraulic pump 7L and the second traveling hydraulic pump 7R are configured to discharge hydraulic fluid for driving the hydraulic actuators (the plurality of second hydraulic cylinder 48, at least one first hydraulic cylinder 49, and the like) connected to the working device 4. The engine 6 is provided between the pair of arm assemblies 42 in the width direction DW of the work vehicle 1. The work vehicle 1 further includes a cover 8 for covering the engine 6. The work vehicle 1 further includes a bonnet cover 9 provided at a rear end of the vehicle body 2. The bonnet cover 9 can be opened and closed, and a maintenance worker can perform maintenance work of the engine 6 and the like.

<Hydraulic Circuit>

Figure 3:
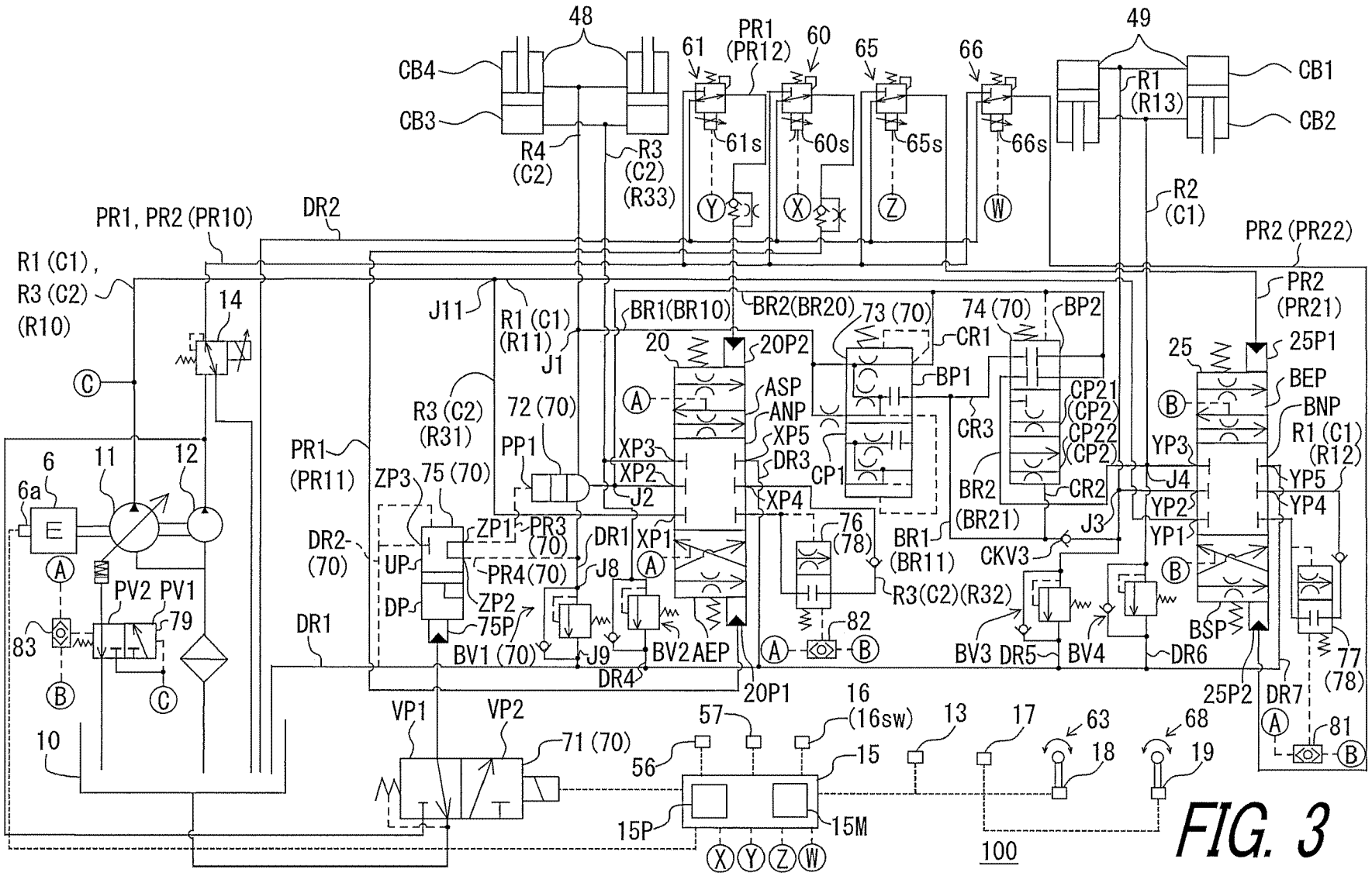
FIG. 3 is a schematic configuration diagram of the first hydraulic cylinder, the second hydraulic cylinder, and the hydraulic circuit of the work vehicle.

The work vehicle 1 includes hydraulic circuit 100 and a controller (control circuitry) 15. The hydraulic circuit 100 is configured to control the first hydraulic cylinder 49 and the second hydraulic cylinder 48. FIG. 3 is a schematic configuration diagram of the first hydraulic cylinder 49, the second hydraulic cylinder 48, and the hydraulic circuit 100 of the work vehicle 1. The hydraulic circuit 100 includes a hydraulic pump 11, a pilot pump 12, a first control valve 25, a second control valve 20, a first pilot control valve 65, a second pilot control valve 66, a third pilot control valve 60, a fourth pilot control valve 61, a first oil passage R1, a second oil passage R2, a third oil passage R3, a fourth oil passage R4, a first pilot oil passage PR1, and a second pilot oil passage PR2, a bypass oil passage BR1, and a switching mechanism 70. The controller 15 is configured to control the hydraulic circuit 100. In the following embodiments, the first oil passage R1 and the second oil passage R2 may be collectively referred to as a first cylinder hydraulic circuit C1. The third oil passage R3 and the fourth oil passage R4 may be collectively referred to as a second cylinder hydraulic circuit C2. The first cylinder hydraulic circuit C1 connects the first hydraulic cylinder 49 and the hydraulic pump 11. The second cylinder hydraulic circuit C2 connects the second hydraulic cylinder 48 and the hydraulic pump 11.

The first hydraulic cylinder 49 includes a first chamber CB1 into which the hydraulic fluid flows when the implement tip 41T is tilted downward and a second chamber CB2 into which the hydraulic fluid flows when the implement tip 41T is tilted upward. The second hydraulic cylinder 48 includes a third chamber CB3 into which the hydraulic fluid flows when the arm distal end 45D is raised, and a fourth chamber CB4 into which the hydraulic fluid flows when the arm distal end 45D is lowered. The hydraulic pump 11 is configured to be driven by the engine 6 and supply the hydraulic fluid stored in the hydraulic fluid tank 10 to a first hydraulic cylinder 49 and a second hydraulic cylinder 48. The hydraulic pump 11 is for example a variable displacement hydraulic pump. A port connected to a swash plate of the hydraulic pump 11 is connected to a regulator valve 79 described later, and the pressure of the hydraulic fluid output from the hydraulic pump 11 is regulated. The pilot pump 12 is configured to be driven by the engine 6 and discharge pilot oil for controlling the second control valve 20 and the first control valve 25. Among the hydraulic fluid stored in the hydraulic fluid tank 10, the hydraulic fluid discharged from the pilot pump 12 and used for control may be referred to as pilot oil, and the pressure of the pilot oil may be referred to as pilot pressure. The pilot pump 12 is, for example, a fixed displacement hydraulic pump.

A first oil passage R1 connects a hydraulic pump 11 with a first chamber CB1 of the first hydraulic cylinder 49. The first control valve 25 is provided in the first oil passage R1. The first control valve 25 is provided in the first cylinder hydraulic circuit C1 between the hydraulic pump 11 and the first hydraulic cylinder 49. The first control valve 25 includes pilot ports 25P1, 25P2 and is configured to control the hydraulic fluid supplied to the first chamber CB1 and the second chamber CB2 of the first hydraulic cylinder in response to the hydraulic pressure of the pilot oil applied to the pilot ports 25P1, 25P2. The first oil passage R1 includes a partial oil passage R10 common to a third oil passage R3 extending from the hydraulic pump 11 to the joint J11, and a partial oil passage R11 extending from the joint J11 to the first control valve 25, a partial oil passage R12 connecting different connection ports of the first control valve 25 to each other, and a partial oil passage R13 extending from the first control valve 25 to a first chamber CB1 of the first hydraulic cylinder 49. The second oil passage R2 connects the first control valve 25 and the second chamber CB2 of the first hydraulic cylinder 49. The first oil passage R1 and the second oil passage R2 are branched by being connected to different ports of the first control valve 25.

Figure 4:
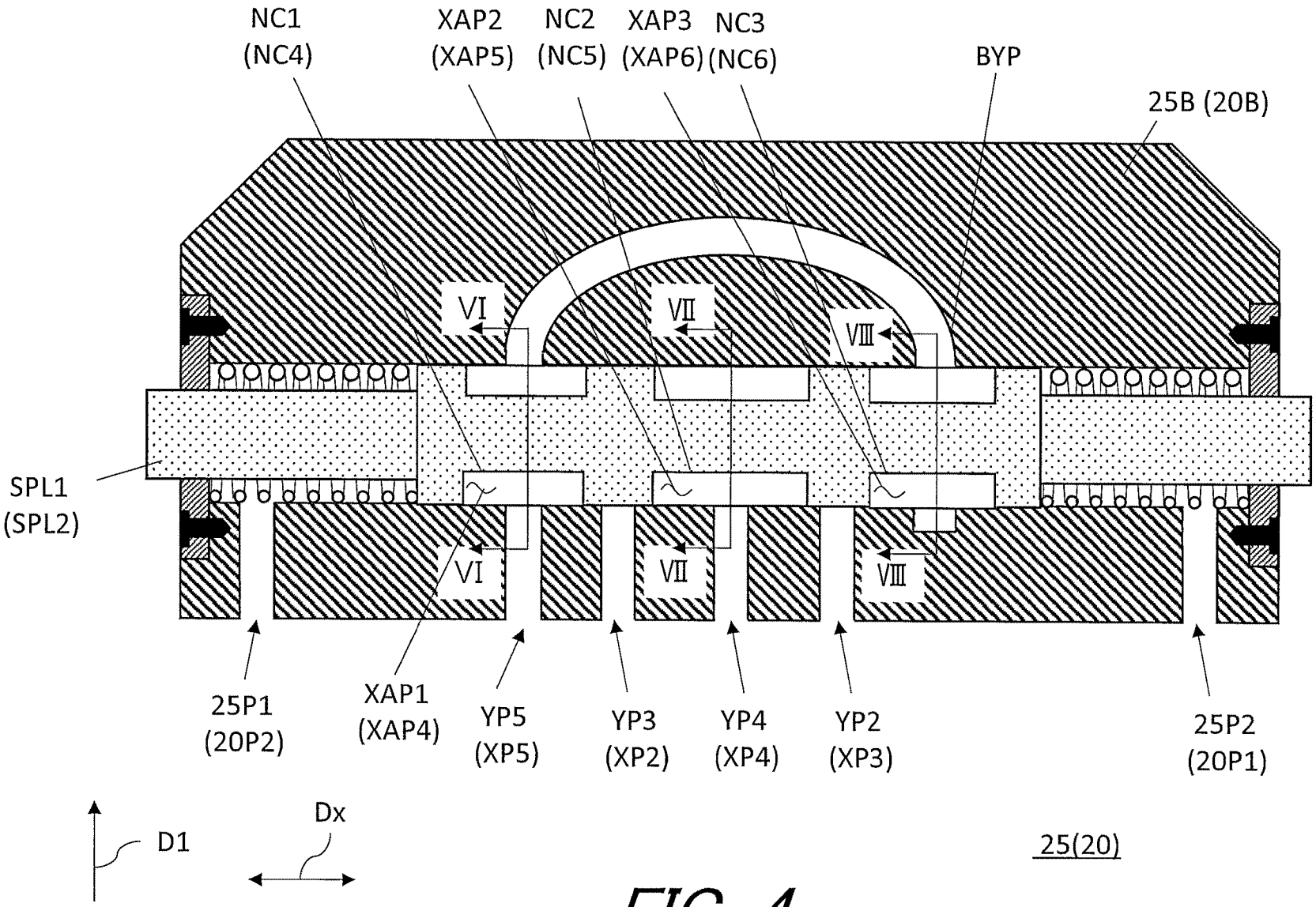
FIG. 4 is a schematic configuration diagram showing an example of the internal configuration of the first control valve and the second control valve.
Figure 5:
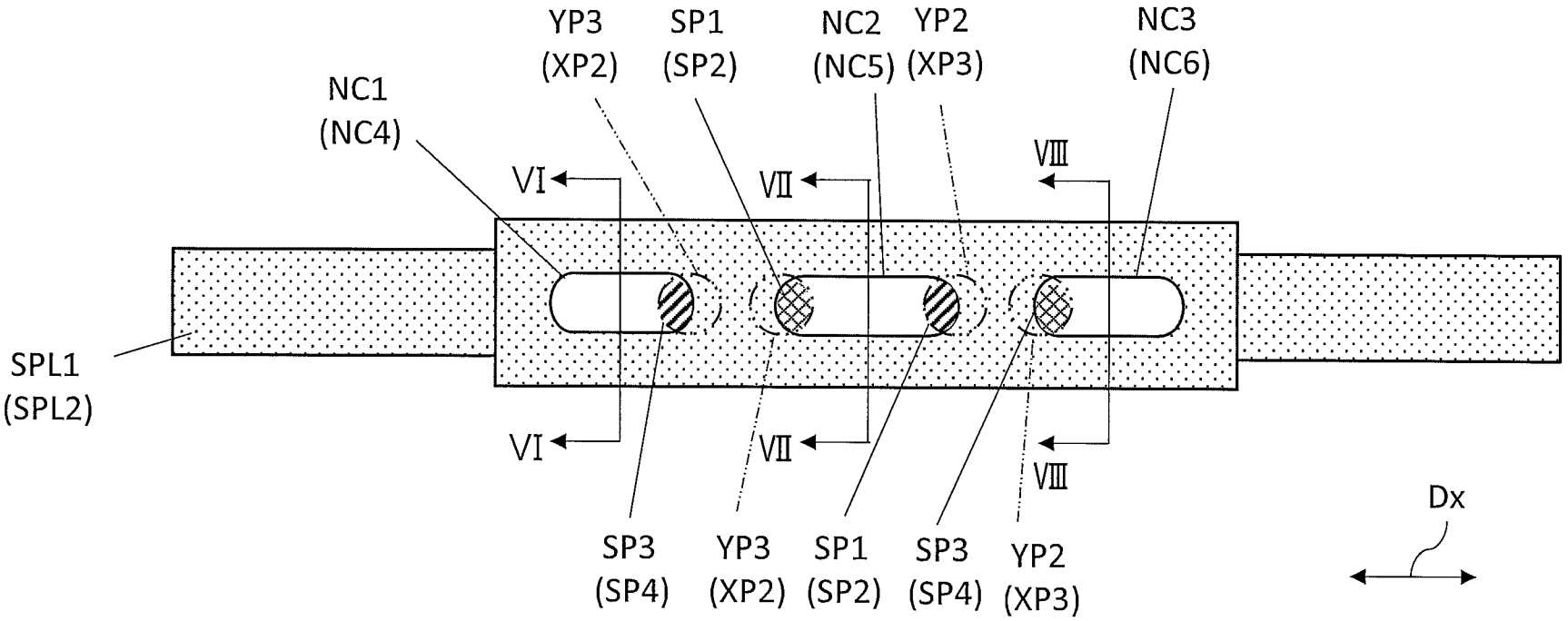
FIG. 5 is a view of the first spool and the second spool as viewed from the first direction in FIG. 4.
Figure 6:
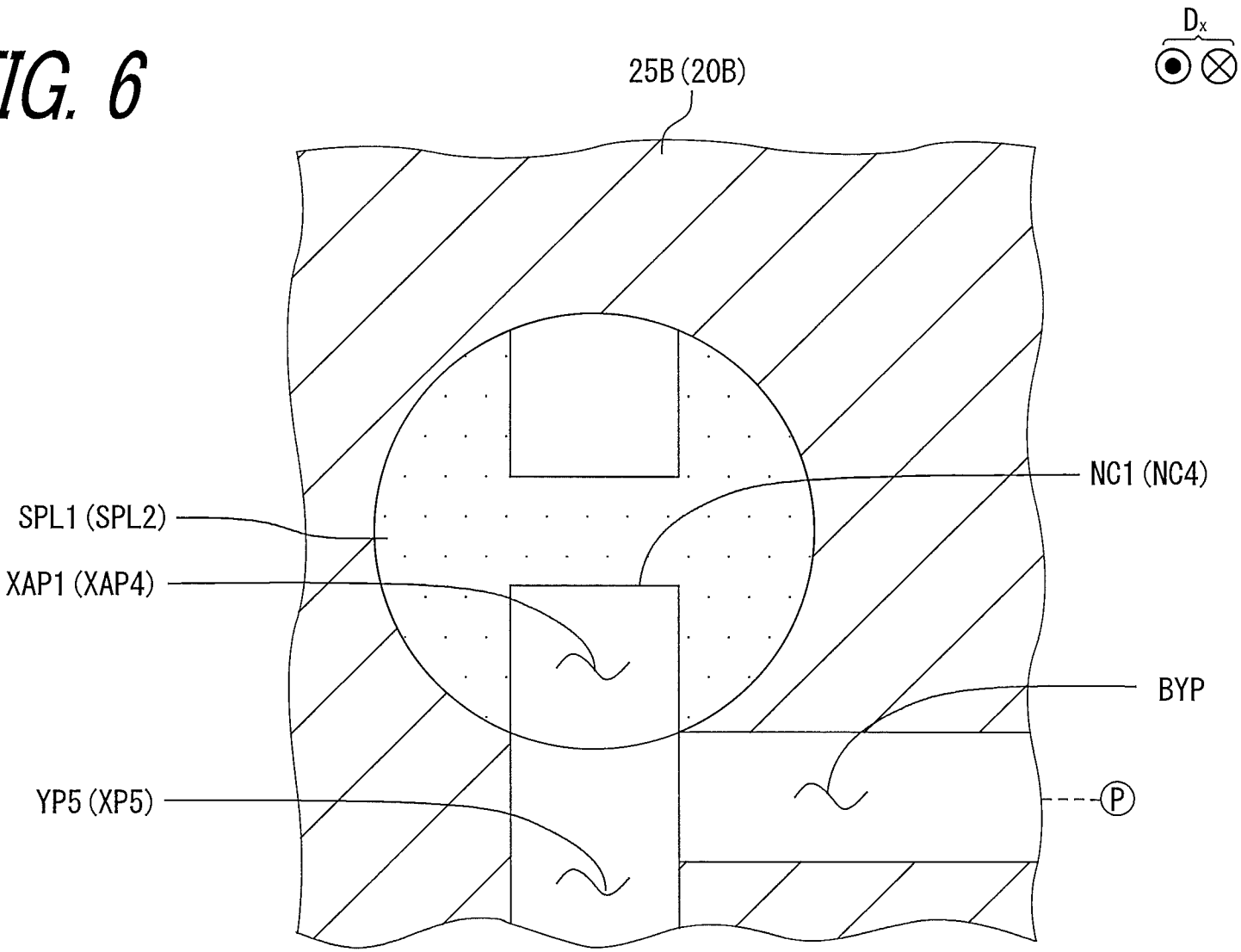
FIG. 6 is a cross-sectional view of the first control valve and the second control valve taken along line VI-VI in FIG. 4.
Figure 7:
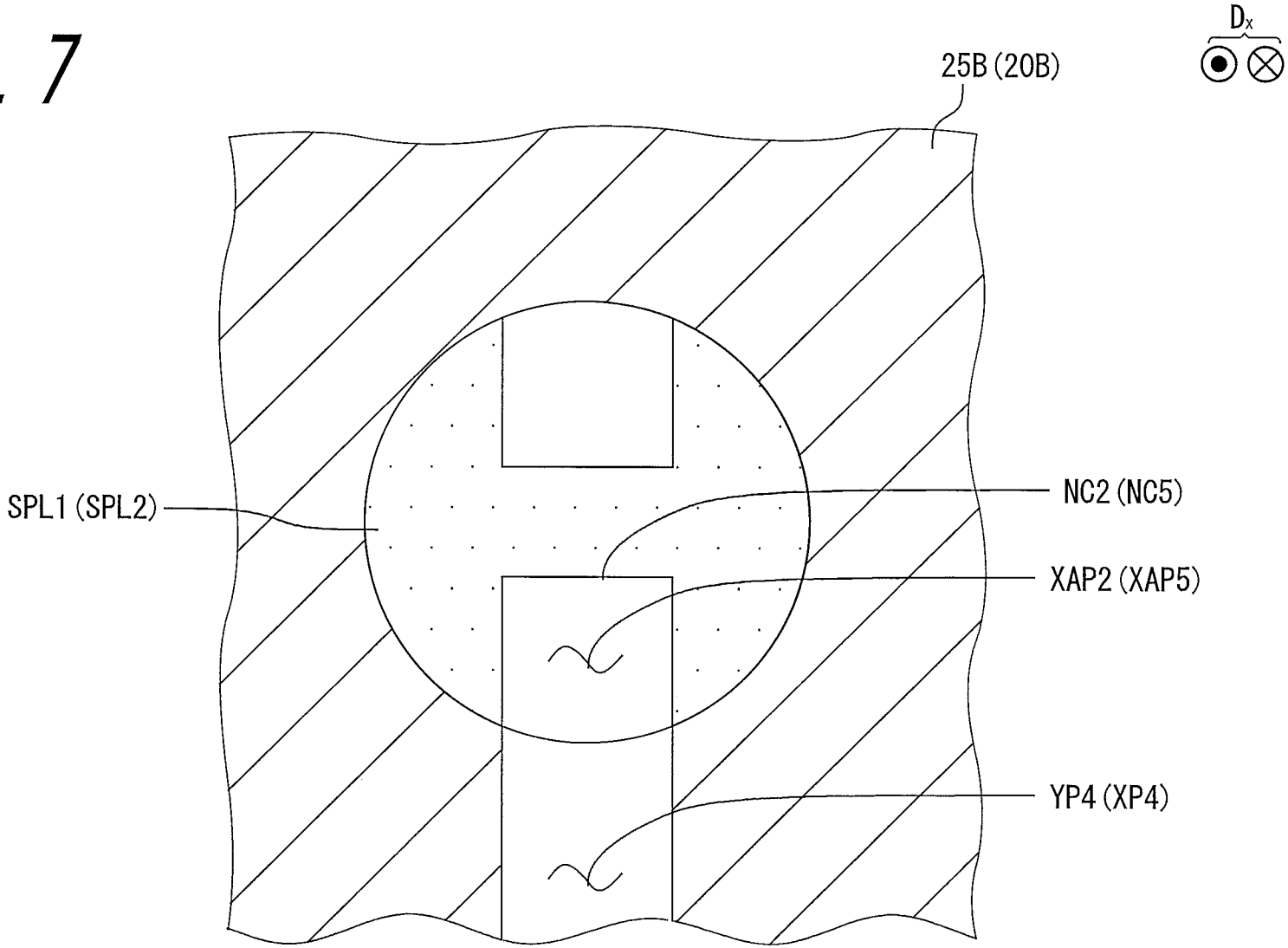
FIG. 7 is a cross-sectional view of the first control valve and the second control valve taken along line VII-VII in FIG. 4.
Figure 8:
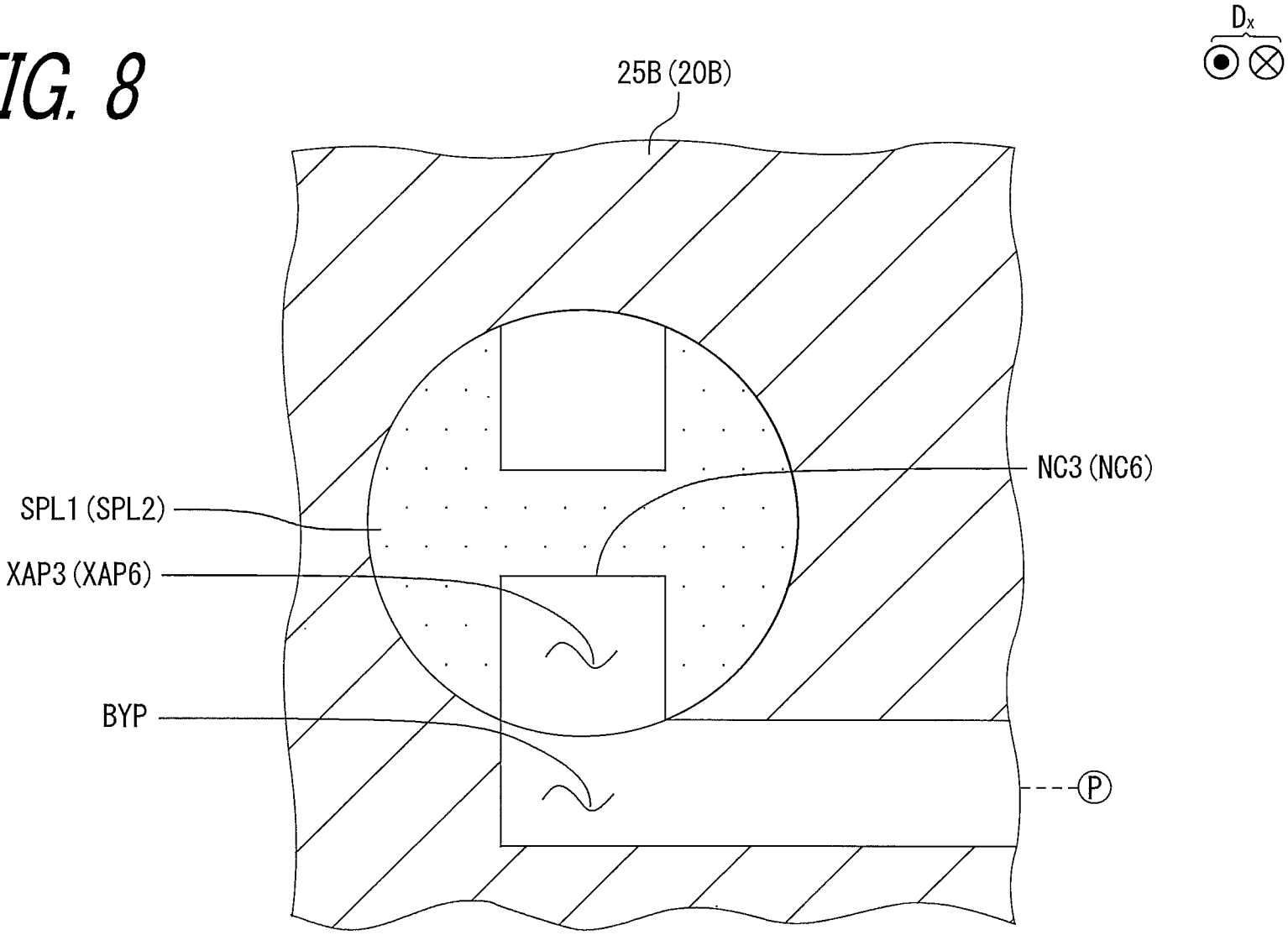
FIG. 8 is a sectional view of the first control valve and the second control valve taken along line VIII-VIII of FIG. 4.

FIG. 4 is a schematic configuration diagram showing an example of an internal configuration of the first control valve 25. As shown in FIG. 4, the first control valve 25 includes a first spool SPL1 and a first valve housing 25B. FIG. 5 is a view of the first spool SPL1 as viewed from the first direction D1 in FIG. 4. Referring to FIGS. 4 and 5, the first spool SPL1 is a rod-shaped member extending in the axial direction Dx. The first direction D1 is perpendicular to the axial direction Dx. The first valve housing 25B supports the first spool SPL1 so as to be slidable in the axial direction Dx. Referring to FIGS. 4 and 5, the first spool SPL1 has a first notch NC1, a second notch NC2, and a third notch NC3. FIG. 6 is a sectional view of the first control valve 25 taken along line VI-VI in FIG. 4. FIG. 7 is a cross-sectional view of the first control valve 25 taken along line VII-VII in FIG. 4. FIG. 8 is a sectional view of the first control valve 25 taken along line VIII-VIII of FIG. 4. Referring to FIG. 6, the first notch NC1 forms a first axial opening XAP1 in the axial direction Dx. Referring to FIG. 7, the second notch NC2 forms a second axial opening XAP2 in the axial direction Dx. Referring to FIG. 8, the third notch NC3 forms a third axial opening XAP3 in the axial direction Dx.

Figure 9:
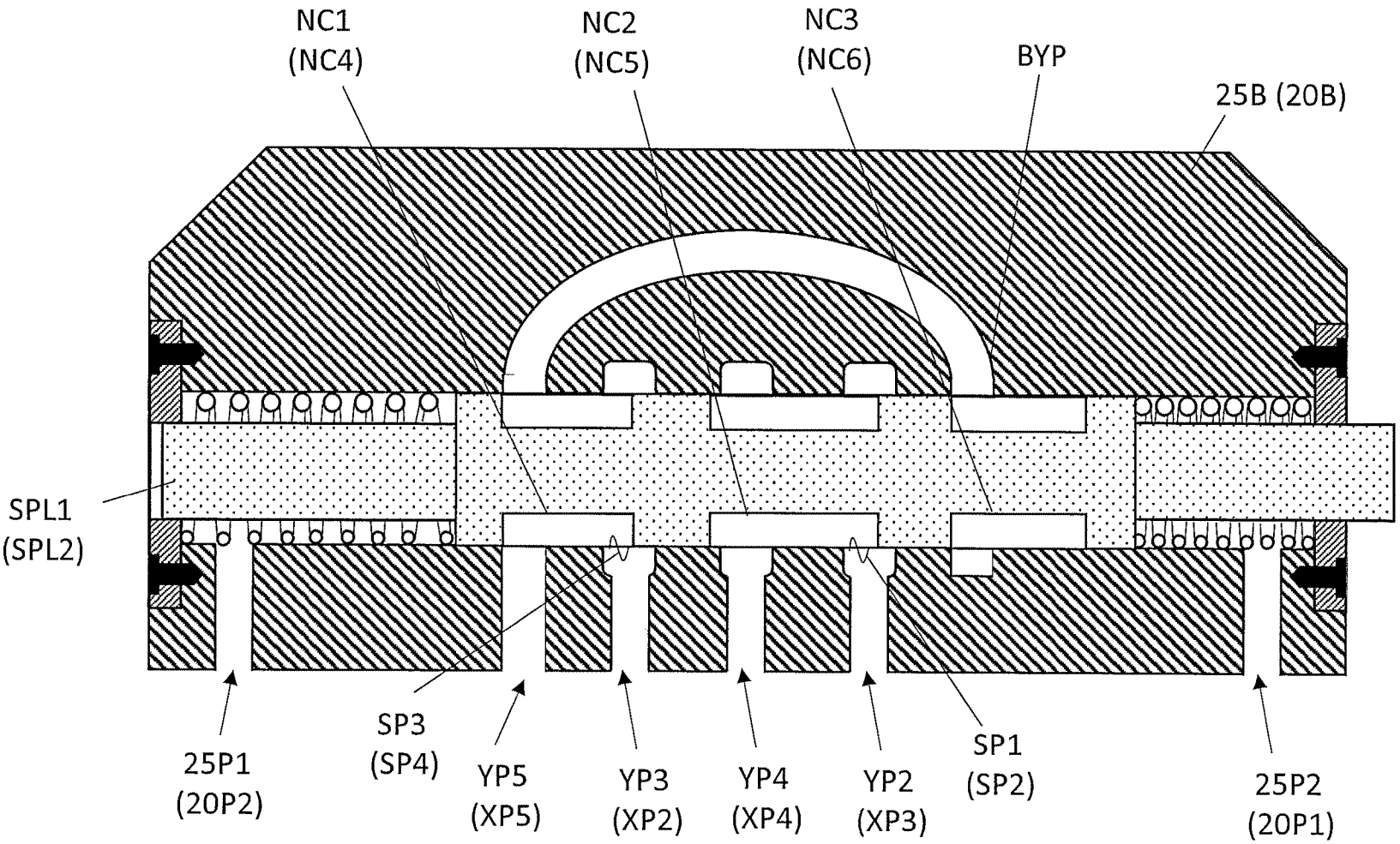
FIG. 9 is a schematic diagram showing another example of the internal structure of the first control valve and the second control valve.
Figure 10:
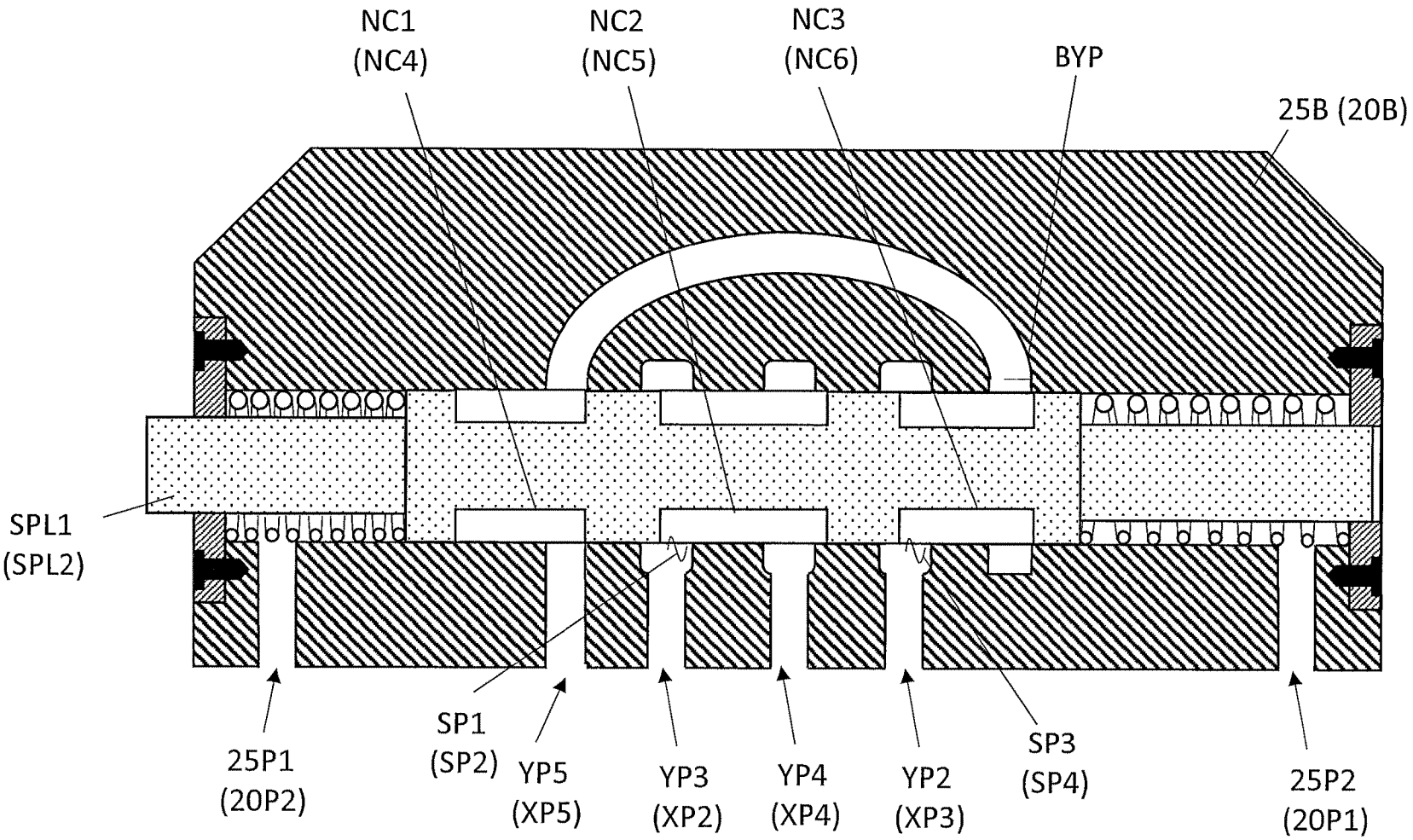
FIG. 10 is a schematic configuration diagram showing still another example of the internal configuration of the first control valve and the second control valve.

FIG. 4 shows the internal configuration of the first control valve 25 in which the position of the first spool SPL1 is switched to the first hydraulic cylinder rest control position BNP. FIG. 9 shows the internal configuration of the first control valve 25 in which the position of the first spool SPL1 is switched to the first hydraulic cylinder extension control position BEP. FIG. 10 shows the internal configuration of the first control valve 25 in which the position of the first spool SPL1 is switched to the first hydraulic cylinder retraction control position BSP. The first control valve 25 switches a first spool position, which is a position of the first spool SPL1, to a first hydraulic cylinder rest control position BNP, a first hydraulic cylinder extension control position BEP, or a first hydraulic cylinder retraction control position BSP, depending on a difference between the pilot pressure pp1 applied to the pilot port 25P1 and the pilot pressure pp2 applied to the pilot port 25P2. The first control valve 25 is configured to switch the first spool position to the first hydraulic cylinder extension control position BEP or the first hydraulic cylinder retraction control position BSP, thereby alternatively switching each of the two oil chambers CB1 and CB2 of the first hydraulic cylinder 49 to the first supplied oil chamber (CB1 or CB2) for supplying the hydraulic fluid and the first discharged oil chamber (CB2 or CB1) for discharging the hydraulic fluid. In detail, referring to FIG. 5, when the first spool position is switched to the first hydraulic cylinder extension control position BEP, the first supplied oil chamber is the first chamber CB1 of the first hydraulic cylinder 49, and the first discharged oil chamber is the second chamber CB2 of the first hydraulic cylinder 49. Referring to FIG. 10, when the first spool position is switched to the first hydraulic cylinder retraction control position BSP, the first supplied oil chamber is the second chamber CB2 of the first hydraulic cylinder 49, and the first discharged oil chamber is the first chamber CB1 of the first hydraulic cylinder 49.

To be more specific, the first control valve 25 includes a first implement control valve port YP1, a second implement control valve port YP2, a third implement control valve port YP3, a fourth implement control valve port YP4, and a fifth implement control valve port YP5. The first implement control valve port YP1 is connected to the hydraulic pump 11 via a first oil passage R1. The second implement control valve port YP2 is connected to the first chamber CB1 of the first hydraulic cylinder 49 via the first oil passage R1. The third implement control valve port YP3 is connected to the second oil passage R2. When the pilot pressure pp1 applied to the pilot port 25P1 is higher than the pilot pressure pp2 applied to the pilot port 25P2 by a predetermined pressure or more, the first control valve 25 switches the first spool position to the first hydraulic cylinder extension control position BEP at which the first and second implement control valve ports YP1 and YP2 are communicated with each other via the fourth implement control valve port YP4 and the third implement control valve port YP3 is communicated with a first drain oil passage DR1 (described later) via the fifth implement control valve port YP5. Referring to FIG. 9, the second implement control valve port YP2 and the second notch NC2 form a first opening SP1. The third implement control valve port YP3 and the first notch NC1 form a third opening SP3. In FIG. 5, the outline of the second implement control valve port YP2 at this time is indicated by a two dot chain line, and the first opening SP1 is indicated by hatching. The outline of the third implement control valve port YP3 at this time is indicated by a two dot chain line, and the third opening SP3 is indicated by hatching. The first opening area AS1, which is the dimension of the first opening SP1, can be continuously changed by changing the first spool position. The maximum value of the first opening area AS1 is sufficiently smaller than the dimension of the second axial opening XAP2 of the second notch NC2. The third opening area which is the dimension of the third opening SP3 can be continuously changed by changing the first spool position. The maximum value of the third opening areas is sufficiently smaller than the areas of the first axial opening XAP1 of the first notch NC1.

When the pilot pressure pp2 applied to the pilot port 25P2 is higher than the pilot pressure pp1 applied to the pilot port 25P1 by the predetermined pressure or more, the first control valve 25 switches the first spool position to the first hydraulic cylinder retraction control position in which the first implement control valve port YP1 and the third implement control valve port YP3 are communicated with each other via the fourth implement control valve port YP4 and the second implement control valve port YP2 is communicated with the DR1 (described later) via the fifth implement control valve port. YP2. Note that the first valve housing 25B has a bypass oil passage BYP for connecting the second implement control valve port YP2 and the fifth implement control valve port YP5. The bypass oil passage BYP is also shown in FIGS. 6 and 8. Referring to FIG. 10, the third implement control valve port YP3 and the second notch NC2 form a first opening SP1. The second implement control valve port YP2 and the third notch NC3 form a third opening SP3. In FIG. 5, the outline of the third implement control valve port YP3 at this time is indicated by a two dot chain line, and the first opening SP1 is indicated by a check pattern. The outline of the second implement control valve port YP2 at this time is indicated by a two dot chain line, and the third opening SP3 is indicated by a check pattern. The first opening area AS1, which is the dimension of the first opening SP1, can be continuously changed by changing the first spool position. The maximum value of the first opening area AS1 is sufficiently smaller than the dimension of the second axial opening XAP2 of the second notch NC2. The third opening area which is the dimension of the third opening SP3 can be continuously changed by changing the first spool position. The maximum value of the third opening areas is sufficiently smaller than the areas of the third axial opening XAP3 of the third notch NC3.

When the absolute value of the difference between the pilot pressure PP2 applied to the pilot port 25P2 and the pilot pressure pp1 applied to the pilot port 25P1 is equal to or less than the predetermined value, the first control valve 25 switches the first spool position to the first hydraulic cylinder rest control position BNP where the first, second, third, fourth, and fifth implement control valve ports YP1, YP2, YP3, YP4, and YP5 are isolated. In the schematic views of the first control valve 25 shown in FIGS. 4, 9, and 10, a portion related to the control of the oil passage between the first implement control valve port YP1 and the fourth implement control valve port YP4 is omitted.

As shown in FIG. 3, the hydraulic circuit 100 further includes shuttle valves 81 that output higher pressures between the pressures applied to the second and third implement control valve ports YP2 and YP3 and the pressures applied to second and third arm control valve ports XP2 and XP3, and first pressure compensation valves 77 provided in the first cylinder hydraulic circuit C1 between the first control valve 25 and the hydraulic pump 11. The first pressure compensation valve 77 makes the first implement control valve port YP1 to communicate with the fourth implement control valve port YP4 only when the pressure applied to the first implement control valve port YP1 is higher than the pressure outputted from the shuttle valve 81 by a fourth threshold value or more. This fourth threshold pressure may be referred to as the first pressure. That is, the first pressure compensation valve 77 controls the hydraulic pressure of the hydraulic fluid output from the first opening SP1 to be lower than the hydraulic pressure of the hydraulic fluid input to the first opening SP1 by the first pressure.

The first control valve 25 is configured to change a first opening area AS1, which is a dimension of a first opening SP1 that communicates an oil passage connecting the first supplied oil chamber (CB1 or CB2) and the first control valve 25 with an oil passage connecting the hydraulic pump 11 and the first control valve 25, in accordance with the first spool position. As the maximum value of the first opening area AS1 is sufficiently smaller than the dimension of the second axial opening XAP2 of the second notch NC2, when the first opening SP1 is regarded as an orifice, it is known that the flow rate of the hydraulic fluid passing through the first opening SP1 is proportional to the product of the first opening area AS1 and the square root of difference between input and output pressures of first opening SP1. The first pressure compensation valve 77 controls the difference between the input and output pressure of the first opening SP1 to be the first pressure, and therefore the first control valve 25 can adjust the amount of the hydraulic fluid supplied to the first supplied oil chamber (CB1 or CB2) per unit time by changing the first opening area AS1 at the first hydraulic cylinder extension control position BEP and the first hydraulic cylinder retraction control position BSP. The third opening SP3 can be referred to as an opening of the first control valve 25 that allows an oil passage connecting the first discharged oil chamber (CB2 or CB1) and the first control valve 25 to communicate with a first drain oil passage DR1 (described later). The dimension of the third opening SP3 varies according to the first opening area AS1. In FIG. 9, the first opening SP1 is an opening between the second implement control valve port YP2 and the first spool SPL1, and the third opening SP3 is an opening between the third implement control valve port YP3 and the first spool SPL1. In FIG. 10, the first opening SP1 is an opening between the third implement control valve port YP3 and the first spool SPL1, and the third opening SP3 is an opening between the second implement control valve port YP2 and the first spool SPL1.

The third oil passage R3 connects the hydraulic pump 11 and the third chamber CB3 of the second hydraulic cylinder 48. The third oil passage R3 includes a partial oil passage R10 which is common to a first oil passage R1 extending from a hydraulic pump 11 and a partial oil passage R31 branched from the first oil passage R1 in the joint J11. The second control valve 20 is provided in the third oil passage R3. The second control valve 20 is provided in a second cylinder hydraulic circuit C2 between the hydraulic pump 11 and the second hydraulic cylinder 48. The second control valve 20 includes a pilot port 20P1, 20P2, and is configured to control the hydraulic fluid supplied to the third chamber CB3 and the fourth chamber CB4 of the second hydraulic cylinder 48 in response to the oil pressure of the pilot oil applied to the pilot ports 20P1, 20P2. The third oil passage R3 further includes a partial oil passage R32 connecting different connection ports of the second control valve 20 to each other and a partial oil passage R33 extending to the third chamber CB3 of the second hydraulic cylinder 48. The fourth oil passage R4 connects the second control valve 20 and the fourth chamber CB4 of the second hydraulic cylinder 48. Third oil passage R3 and the fourth oil passage R4 are branched by being connected to different ports of the first control valve 25.

FIG. 4 is a schematic diagram showing an example of the internal configuration of the second control valve 20. In FIG. 4, the reference numeral of the second control valve 20 is shown in parentheses. As shown in FIG. 4, the second control valve 20 includes a second spool SPL2 and a second valve housing 20B. FIG. 5 also shows a view of the second spool SPL2 as seen from the first direction D1 in FIG. 4. Referring to FIGS. 4 and 5, the second spool SPL2 is a rod-shaped member extending in the axial direction Dx. The first direction D1 is perpendicular to the axial direction Dx. The second valve housing 20B supports the second spool SPL2 so as to be slidable in the axial direction Dx. Referring to FIGS. 4 and 5, the second spool SPL2 has a fourth notch NC4, a fifth notch NC5, and a sixth notch NC6. FIG. 6 is a cross-sectional view of the second control valve 20 taken along line VI-VI of FIG. 4. FIG. 7 is a cross-sectional view of the second control valve 20 taken along line VII-VII of FIG. 4. FIG. 8 is a sectional view of the second control valve 20 taken along line VIII-VIII of FIG. 4. Referring to FIG. 6, the fourth notch NC4 forms a fourth axial opening XAP4 in the axial direction Dx. Referring to FIG. 7, the fifth notch NC5 forms a fifth axial opening XAP5 in the axial direction Dx. Referring to FIG. 8, the sixth notch NC6 forms a sixth axial opening XAP6 in the axial direction Dx.

FIG. 4 shows the internal configuration of the second control valve 20 in which the position of the second spool SPL2 is switched to the second hydraulic cylinder rest control position ANP. FIG. 9 shows the internal configuration of the second control valve 20 in which the position of the second spool SPL2 is switched to the second hydraulic cylinder extension control position AEP. FIG. 10 shows the internal configuration of the second control valve 20 in which the position of the second spool SPL2 is switched to the second hydraulic cylinder retraction control position ASP. The second control valve 20 switches the second spool position, which is the position of the second spool SPL2, to the second hydraulic cylinder rest control position ANP, the second hydraulic cylinder extension control position AEP, or the second hydraulic cylinder retraction control position ASP, depending on the difference between the pilot pressure pp3 applied to the pilot port 20P1 and the pilot pressure pp4 applied to the pilot port 20P2. The second control valve 20 alternatively switches each of the two oil chambers (CB3, CB4) of the second hydraulic cylinder 48 to the second supplied oil chamber (CB3 or CB4) for supplying the hydraulic fluid and the second discharged oil chamber (CB3 or CB4) for discharging the hydraulic fluid by switching the second spool position to the second hydraulic cylinder extension control position AEP or the second hydraulic cylinder retraction control position ASP. In detail, referring to FIG. 9, when the second spool position is switched to the second hydraulic cylinder extension control position AEP, the second supplied oil chamber is the third chamber CB3 of the second hydraulic cylinder 48, and the first discharged oil chamber is the fourth chamber CB4 of the second hydraulic cylinder 48. Referring to FIG. 10, when the second spool position is switched to the second hydraulic cylinder retraction control position ASP, the second supplied oil chamber is the fourth chamber CB4 of the second hydraulic cylinder 48, and the first discharged oil chamber is the third chamber CB3 of the second hydraulic cylinder 48.

To be more specific, the second control valve 20 further includes a first arm control valve port XP1, a second arm control valve port XP2, a third arm control valve port XP3, and a fourth arm control valve port XP4, and a fifth arm control valve port XP5. The first arm control valve port XP1 is connected to the hydraulic pump 11 via a third oil passage R3. The second arm control valve port XP2 is connected to the fourth oil passage R4.

The third arm control valve port XP3 is connected to the third chamber CB3 of the second hydraulic cylinder 48 via the third oil passage R3. When the pilot pressure pp3 applied to the pilot port 20P1 is higher than the pilot pressure pp4 applied to the pilot port 20P2 by a predetermined pressure or more, the second control valve 20 makes a first arm control valve port XP1 to communicate with a third arm control valve port XP3 via the fourth arm control valve port XP4, and switches the second hydraulic cylinder extension control position AEP at which the second arm control valve port XP2 is communicated with a first drain oil passage DR1 (described later) via the fifth arm control valve port XP5. Referring to FIG. 9, the third arm control valve port XP3 and the fifth notch NC5 form a second opening SP2. The second arm control valve port XP2 and the fourth notch NC4 form a fourth opening SP4. In FIG. 5, the outline of the third arm control valve port XP3 at this time is indicated by a two dot chain line, and the second opening SP2 is indicated by hatching. The outline of the second arm control valve port XP2 at this time is indicated by a two dot chain line, and the fourth opening SP4 is indicated by hatching. The second opening area AS2, which is the dimension of the second opening SP2, can be continuously changed by changing the second spool position. The maximum value of the second opening area AS2 is sufficiently smaller than the dimension of the fifth axial opening XAP5 of the fifth notch NC5. The fourth opening area which is the dimension of the fourth opening SP4 can be continuously changed by changing the position of the second spool. The maximum value of the fourth opening area is sufficiently smaller than the dimension of the fourth axial opening XAP4 of the fourth notch NC4.

When the pilot pressure pp4 applied to the pilot port 20P4 is higher than the pilot pressure pp3 applied to the pilot port 20P1 by the predetermined pressure, the second control valve 20 switches the second spool position to the second hydraulic cylinder retraction control position ASP at which the first arm control valve port XP1 and the second arm control valve port XP2 are communicated with each other via the fourth arm control valve port XP4, and the third arm control valve port XP3 is communicated with the first drain oil passage lpt via the fifth arm control valve port XP5. The second valve housing 20B includes a bypass oil passage BYP for connecting the third arm control valve port XP3 and the fifth arm control valve port XP5. The bypass oil passage BYP is also shown in FIGS. 6 and 8. Referring to FIG. 10, the second arm control valve port XP2 and the fifth notch NC5 form a second opening SP2. The third arm control valve port XP3 and the sixth notch NC6 form a fourth opening SP4. In FIG. 5, the outline of the second arm control valve port XP2 at this time is indicated by a two dot chain line, and the second opening SP2 is indicated by a check pattern. The outline of the third arm control valve port XP3 at this time is indicated by a two dot chain line, and the fourth opening SP4 is indicated by a check pattern. The second opening area AS2, which is the dimension of the second opening SP2, can be continuously changed by changing the second spool position. The maximum value of the second opening area AS2 is sufficiently smaller than the dimension of the fifth axial opening AP5 of the fifth notch NC5. The fourth opening area which is the dimension of the fourth opening SP4 can be continuously changed by changing the position of the second spool. The maximum value of the fourth opening areas is sufficiently smaller than the dimension of the sixth axial opening XAP6 of the sixth notch NC6.

When the difference between the pilot pressure pp4 applied to the pilot port 20P2 and the pilot pressure pp3 applied to the pilot port 20P1 is equal to or smaller than the predetermined pressure, the second control valve 20 switches the second spool position to the second hydraulic cylinder rest control position ANP for isolating the first arm control valve port XP1, the second arm control valve port XP2, the third arm control valve port XP3, the fourth arm control valve port XP4 and the fifth arm control valve port XP5. In the schematic views of the first control valve 25 shown in FIGS. 4, 9, and 10, a portion related to the control of the oil passage between the first arm control valve port XP1 and the fourth arm control valve port XP4 is omitted.

As shown in FIG. 3, the hydraulic circuit 100 further includes a shuttle valve 82 that outputs higher one of pressures applied to the second arm control valve port XP2 or a third arm control valve port XP3 described later and pressures applied to the second implement control valve port YP2 or the third implement control valve port YP3, and the second pressure compensation valve 76 provided in the second cylinder hydraulic circuit C2 between the second control valve 20 and the hydraulic pump 11. The second pressure compensation valve 76 communicates the first arm control valve port XP1 with the fourth arm control valve port XP4 only when the pressure applied to the first arm control valve port XP1 is higher than the pressure outputted from the shuttle valve 82 by a third threshold value or more. The third threshold pressure is equal to the fourth threshold pressure and may be referred to as the first pressure. The second pressure compensation valve 76 is configured to control the second output oil pressure of the hydraulic fluid outputted from the second control valve 20 to the second supplied oil chamber (CB3 or CB4) to be lower than the second input oil pressure inputted from the second pressure compensation valve 76 to the second control valve 20 by the first pressure. Thus, when the hydraulic pressure from the hydraulic pump 11 is less than the third threshold pressure, the arm control can be prevented from being performed.

The second control valve 20 is configured to change a second opening area AS2, which is a dimension of a second opening SP2 of the second control valve 20 that communicates an oil passage connecting the second supplied oil chamber (CB3 or CB4) and the second control valve 20 with an oil passage connecting the hydraulic pump 11 and the second control valve 20, according to the second spool position. The maximum value of the second opening area AS2 is sufficiently smaller than the fifth axial opening XAP5 of the fifth notch NC5, and therefore, when the second opening SP2 is regarded as an orifice, the flow rate of the hydraulic fluid passing through the second opening SP2 is known to be proportional to the product of the square root of the difference between the input and output pressures of the second opening SP2 and the second opening area AS2. As the pressure difference between the input and output of the second opening SP2 is controlled by the second pressure compensation valve 76 to be the first pressure, the second control valve 20 is controlled such that the second control valve 20 can adjust the amount of hydraulic fluid supplied per unit time to the second supplied oil chamber (CB3 or CB4) by changing the second opening area AS2 in each of the second hydraulic cylinder extension control position AEP or second hydraulic cylinder retraction control position ASP, respectively. The fourth opening SP4 can be referred to as an opening of the second control valve 20 that allows an oil passage connecting the second discharged oil chamber (CB3 or CB4) and the second control valve 20 to communicate with a first drain oil passage DR1 (described later). The fourth opening SP4 varies in size in accordance with the second opening area AS2. In FIG. 9, the second opening SP2 is an opening between the third arm control valve port XP3 and the second spool SPL2, and the fourth opening SP4 is an opening between the second arm control valve port XP2 and the second spool SPL2. In FIG. 10, the second opening SP2 is an opening between the second arm control valve port XP2 and the second spool SPL2, and the fourth opening SP4 is an opening between the third arm control valve port XP3 and the second spool SPL2.

The difference between the pressures at the input and output of the first opening SP1 of the first pressure compensation valve 77 and the difference between the pressures at the input and output of the second opening SP2 of the second pressure compensation valve 76 are set to the same first pressure. Therefore, the ratio between the flow rate of the hydraulic fluid per unit time via the first control valve 25 and the flow rate of the hydraulic fluid per unit time via the second control valve 20 can be adjusted by the ratio between the first opening area AS1 and the second opening area AS2. The second pressure compensation valve 76 and the first pressure compensation valve 77 are collectively referred to as a pressure control mechanism 78.

The pressure control mechanism 78 further includes a shuttle valve 83 that outputs a higher one of the oil pressure applied to the first supplied oil chamber (CB1 or CB2) and the hydraulic pressure applied to the second supplied oil chamber (CB3 or CB4), and a regulator valve 79 for the pressure output from the hydraulic pump 11 to be equal to or higher than the above described first pressure. The regulator valve 79 is switched to the first position PV1 when the oil pressure is lower than the higher oil pressure and higher than the first pressure, and is switched to the second position PV2 when the hydraulic pressure is higher than the higher hydraulic pressure by the first hydraulic pressure or more. Thus, even if the hydraulic pressure increases while at least one of the first hydraulic cylinder 49 and the second hydraulic cylinder 48 is being controlled, the hydraulic pump 11 can supply a pressure higher than the first pressure, and therefore the first hydraulic cylinder 49 and the second hydraulic cylinder 48 can be continuously controlled. When the hydraulic pump 11 is controlled in this way, the difference between the lower one of the hydraulic pressure s applied to the first supplied oil chamber (CB1 or CB2) and the second supplied oil chamber (CB3 or CB4) and the hydraulic pressure of the hydraulic fluid output from the hydraulic pump 11 is larger than the first pressure. However, the functions of the first and second pressure compensation valves 77 and 76 adjust the difference between the pressures at the input and output of the first opening SP1 and the difference between the pressures at the input and output of the second opening SP2 to the same first pressures. The pressure control mechanism 78 may use another hydraulic control component to set the hydraulic pressure to be equal to or higher than the first hydraulic pressure, which is higher than the hydraulic pressure applied to the first supplied oil chamber (CB1 or CB2) or the hydraulic pressure applied to the second supplied oil chamber (CB3 or CB4).

Thus, as the pressure control mechanism 78 can adjust the amount of hydraulic fluid via the first control valve 25 by the first opening area AS1, the first control valve 25 is configured to adjust the hydraulic fluid per unit time supplied to the first supplied oil chamber (CB1 or CB2) per unit time and the amount of hydraulic fluid discharged from the first discharged oil chamber (CB2 or CB1) per unit time in accordance with the first spool position, which is the position of the first spool SPL1. As the pressure control mechanism 78 can adjust the amount of hydraulic fluid via the second control valve 20 by the second opening area AS2, the second control valve 20 is configured to adjust the amount of hydraulic fluid supplied to the second supplied oil chamber (CB3 or CB4) per unit time and the amount of hydraulic fluid discharged from the second discharged oil chamber (CB4 or CB3) per unit time in accordance with the second spool position, which is the position of the second spool SPL2.

The first pilot oil passage PR1 connects the pilot ports 20P1, 20P2 with a pilot pump 12. To be specific, the first pilot oil passage PR1 includes a partial oil passage PR10*f* common to the second pilot oil passage PR2 extending from the pilot pump 12 to the third pilot control valve 60 and the fourth pilot control valve 61, a partial oil passage PR11 extending from the third pilot control valve 60 to the pilot port 20P1, and a partial oil passage PR12 extending from the fourth pilot control valve 61 to the pilot port 20P2. The hydraulic circuit 100 further includes an additional solenoid valve 14 provided in the partial oil passage PR10. That is, the additional solenoid valve 14 is provided in at least one of the first pilot oil passage PR1 between the pilot pump 12 and the third pilot control valve 60 and the fourth pilot control valve 61 and the second pilot oil passage PR2 between the pilot pump 12 and the first pilot control valve 65 and the second pilot control valve 66. The additional solenoid valve 14 is a solenoid valve capable of changing the pressure of the hydraulic fluid output from the pilot pump 12. The pressure of the hydraulic fluid can be changed by control from the controller 15.

The third pilot control valve 60 is a solenoid control valve provided in the first pilot oil passage PR1. The third pilot control valve 60 includes a solenoid 60*s* and controls the hydraulic pressure of the pilot oil applied to the pilot port 20P1 based on the control amount u3 applied to the solenoid 60*s*. The arm input member 63 is provided with a rotation detection sensor 18 such as a potentiometer, and the controller 15 acquires an operation amount of the arm input member 63 operated for lifting and lowering the arm 45 from the rotation detection sensor 18, and outputs a control amount U3 applied to the solenoid 60*s* based on the operation amount. The fourth pilot control valve 61 is a solenoid control valve provided in the first pilot oil passage PR1. The fourth pilot control valve 61 includes a solenoid 61*s* and controls the hydraulic pressure of the pilot oil applied to the pilot port 20P2 based on the control amount u4 applied to the solenoid 61*s*. The controller 15 acquires the operation amount of the arm input member 63 operated for raising and lowering the arm 45 from the rotation detection sensor 18, and outputs the control amount u4 to be applied to the solenoid 61*s* based on the operation amount. When the arm input member 63 is tilted forward, the controller 15 operates the third pilot control valve 60, and the pilot pressure pp3 is output from the third pilot control valve 60 to the partial oil passage PR11. The pilot pressure pp3 acts on the pilot port 20P1 of the second control valve 20. When the arm input member 63 is tilted rearward, the controller 15 operates the fourth pilot control valve 61 to output the pilot pressure pp4 to the partial oil passage PR12 from the fourth pilot control valve 61. The pilot pressure pp4 acts on the pilot port 20P2 of the second control valve 20.

To be more specific, when an operation for raising the arm 45 is performed by the arm input member 63 (an operation for tilting the arm input member 63 rearward), the pilot pressure pp3 applied to the pilot port 20P1 becomes larger than the pilot pressure pp4 applied to the pilot port 20P2 by the predetermined pressure. When an operation for lowering the arm 45 is performed by the arm input member 63 (an operation of tilting the arm input member 63 forward), the pilot pressure pp4 applied to the pilot port 20P2 becomes higher than the pilot pressure pp3 applied to the pilot port 20P1 by the predetermined pressure. When the operation amount of the arm input member 63 is smaller than the predetermined amount, the absolute value of the difference between the pilot pressure pp4 applied to the pilot port 20P2 and the pilot pressure pp3 applied to the pilot port 20P1 is equal to or smaller than the predetermined pressure.

The second pilot oil passage PR2 connects the pilot ports 25P1 and 25P2 to the pilot pump 12. To be specific, the second pilot oil passage PR2 includes a partial oil passage PR10 common to the first pilot oil passage PR1 extending from the pilot pump 12 to the first pilot control valve 65 and the second pilot control valve 66, a partial oil passage PR21 extending from the first pilot control valve 65 to the pilot port 25P1, and a partial oil passage PR22 extending from the second pilot control valve 66 to the pilot port 25P2. The first pilot control valve 65 is a solenoid control valve provided in the second pilot oil passage PR2. The first pilot control valve 65 includes a solenoid 65*s*, and controls the hydraulic pressure of the pilot oil applied to the pilot port 25P1 based on a control amount u1 applied to the solenoid 65*s*. The implement input member 68 is mounted with the rotation detection sensor 19 such as a potentiometer, and the controller 15 acquires the tilt angle of the implement input member 68 detected by the rotation detection sensor 19, and outputs a control amount u1 to be applied to the solenoid 65*s* based on the operation amount. The second pilot control valve 66 is a solenoid control valve provided in the second pilot oil passage PR2. The second pilot control valve 66 includes a solenoid 66*s*, and controls the hydraulic pressure of the pilot oil applied to the pilot port 25P2 based on the control amount u2 applied to the solenoid 66*s*. The controller 15 acquires the tilt angle of the implement input member 68 detected by the rotation detection sensor 19, and outputs a control amount u2 to be applied to the solenoid 66*s* based on the operation amount.

When the implement input member 68 is tilted to the right side, the controller 15 operates the first pilot control valve 65, and the pilot pressure pp1 is output from the first pilot control valve 65 to the partial oil passage PR21. The pilot pressure pp1 acts on the pilot port 25P1 of the first control valve 25. When the implement input member 68 is tilted to the left side, the controller 15 operates the second pilot control valve 66, and the pilot pressure PP2 is output from the second pilot control valve 66 to the partial oil passage pp2. The pilot pressure pp2 acts on the pilot port 25P2 of the first control valve 25.

To be more specific, when an operation for tilting the implement tip 41T downward by the implement input member 68 (an operation for tilting the implement input member 68 to the right side) is performed, the pilot pressure pp1 applied to the pilot port 25P1 becomes larger than the pilot pressure pp2 applied to the pilot port 25P2 by the predetermined pressure. When an operation for tilting the implement tip 41T upward is performed by the implement input member 68 (an operation of tilting the implement input member 68 to the left side), the pilot pressure pp2 applied to the pilot port 25P2 becomes larger than the pilot pressure pp1 applied to the pilot port 25P1 by the predetermined pressure. When the operation amount of the implement input member 68 is smaller than the predetermined amount, the difference between the pilot pressure pp2 applied to the pilot port 25P2 and the pilot pressure pp1 applied to the pilot port 25P1 is equal to or smaller than the predetermined pressure.

Although the arm input member 63 and the implement input member 68 are shown as separate members in FIG. 3, they may be the same member as represented by the operation lever 55 in FIG. 1. In this case, the rotation detection sensors 18 and 19 are arranged around the same member.

The bypass oil passage BR1 is configured to connect the fourth oil passage R4 and the first oil passage R1. The bypass oil passage BR1 is connected to the fourth oil passage R4 at the first joint J1. The bypass oil passage BR1 is connected to the first oil passage R1 at the third joint J3. The switching mechanism 70 is configured to control connection and disconnection of the fourth oil passage R4 and the first oil passage R1 by the bypass oil passage BR1. The controller 15 is configured to control the switching mechanism 70 to connect the fourth oil passage R4 and the first oil passage R1 when it is determined that the horizontal control of the implement 41 is performed. The controller 15 is, for example, a hardware controller such as an ECU. Accordingly, the controller 15 comprises electronic circuit such as a hardware processor 15P and a memory 15M. The memory 15M may be referred to as a memory.

The switching mechanism 70 includes a solenoid valve 71 and a first switching valve 72. The first switching valve 72 is provided in the fourth oil passage R4 between the first joint J1 and the second control valve 20, and has a first pilot port PP1. The first switching valve 72 is configured to block the connection between the second control valve 20 and the fourth chamber CB4 of the second hydraulic cylinder 48 via the fourth oil passage R4 when the pilot oil is applied to the first pilot port PP1 at a first threshold pressure or higher, and to connect the second control valve 20 and the fourth chamber CB4 via the fourth oil passage R4 when the pilot oil is applied to the first pilot port PP1 at a first threshold pressure or lower. The solenoid valve 71 can be switched between a second position VP2 for communicating the first pilot port PP1 with the hydraulic fluid tank 10 and a first position VP1 for connecting the first pilot port PP1 to an oil passage capable of applying a pilot pressure equal to or higher than a first threshold pressure to the first pilot port PP1.

The solenoid of the solenoid valve 71 is connected to the controller 15. For example, when it is determined that the horizontal control of the implement 41 is performed, the controller 15 transmits an electric signal for switching the solenoid valve 71 to the first position VP1 to the solenoid valve 71.

The work vehicle 1 further includes an ON/OFF changeover switch 16 which is connected to the controller 15. When the switch 16 is turned ON, the controller 15 transmits an electric signal for switching the solenoid valve 71 to the first position VP1. The switch 16 is turned on when the above-described horizontal control is performed.

The work vehicle 1 further includes an additional bypass oil passage BR2 that connects the second oil passage R2 and a fourth oil passage R4 between the first switching valve 72 and the second control valve 20. The additional bypass oil passage BR2 is connected to the fourth oil passage R4 at the second joint J2, and is connected to the second oil passage R2 at the fourth joint J4. The switching mechanism 70 further includes a second switching valve 73 provided in the bypass oil passage BR1 and a third switching valve 74 provided in the additional bypass oil passage BR2. The additional bypass oil passage BR2 includes a partial oil passage BR20 from the second joint J2 to the third switching valve 74, and a partial oil passage BR21 from the third switching valve 74 to the fourth joint J4. The work vehicle 1 further includes a first connection passage CR1 connecting an additional bypass oil passage BR2 an additional bypass oil passage BR2 (partial oil passage BR20) between the second joint J2 and the third switching valve 74, a second connection passage CR2 connecting a bypass oil passage BR1 (partial oil passage BR11) between the third joint J3 and the second switching valve 73, and a third connection passage CR3 connecting the second switching valve 73 and the bypass oil passage BR1 (partial oil passage BR11) between the second connection passage CR2 and the second switching valve 73

When the first pressure of the bypass oil passage BR1 (partial oil passage BR10) between the first joint J1 and the second switching valve 73 is larger than the second oil pressure of the first connection passage CR1, the second switching valve 73 is configured to switch to the first communication position CP1 to connect the first joint J1 and the third joint J3. When the second oil pressure is equal to or greater than the first pressure, the second switching valve 73 is configured to switch to the first blocking position BP1 to block the first joint J1 and the third joint J3. When it is switched to the first blocking position BP1, the second switching valve 73 is configured to connect the partial oil passage BR10 and the first connection passage CR1. When it is switched to the first communication position CP1, the second switching valve 73 is configured to block the partial oil passage BR10 and the first connection passage CR1.

The third switching valve 74 switches to any one of the second shutoff position BP2, the twenty first communication position CP21, and the twenty second communication position CP22 based on the third oil pressure of the additional bypass oil passage BR2 (partial oil passage BR2) between the second joint J2 and the third switching valve 74; and the fourth oil pressure in the second connection passage CR2. Note that the twenty first communication position CP21 and the twenty second communication position CP22 are collectively referred to as a second communication position CP2. Since the check valve CKV is provided between the second connection passage CR2 and the third joint J3, the hydraulic pressure of the first oil passage R1 does not affect the hydraulic pressure of the second connection passage CR2. The third switching valve 74 is configured to switch to a second communication position CP2 for communicating the second joint J2 with the fourth joint J4 when the third oil pressure is smaller than the fourth oil pressure, and to switch to a second shutoff position BP2 for shutting off the communication between the second joint J2 and the fourth joint J4 when the fourth oil pressure is equal to or smaller than the third oil pressure. The third switching valve 74 switches to a twenty first communication position CP21 to communicate the second joint J2 with the fourth joint J4, and disconnect the third connection passage CR3 and the partial oil passage BR11. On the other hand, when the third oil pressure is smaller than the fourth oil pressure by a predetermined pressure or more, the switching to the twenty first communication position CP21 is performed, the second joint J2 and the fourth joint J4 are communicated, and the third connection passage CR3 and the bypass oil passage BR1 (partial oil passage BR11) are connected. This can prevent the oil pressure of the bypass oil passage BR1 (partial oil passage BR11) from becoming too high.

The work vehicle 1 further includes a first drain oil passage DR1 that connects the fourth chamber CB4 and the hydraulic fluid tank 10 when the second control valve 20 and the fourth chamber CB4 of the second hydraulic cylinder 48 is connected via the fourth oil passage R4 by the first switching valve 72. The switching mechanism 70 further includes a third pilot oil passage PR3 connected to a first counterbalance valve BV1 provided in the first drain oil passage DR1, the fourth switching valve 75, and the first pilot port PP1 of the first switching valve 72 and the fourth switching valve, the switching and the first pilot port PP1 of the first switching valve 72, and a fourth pilot oil passage PR4 connecting the fourth switching valve 75 and the first drain oil passage DR1 between the first switching valve 72 and the first counterbalance valve BV1, and a second drain oil passage DR2 connecting the fourth switching valve 75 and the hydraulic fluid tank 10. The first counterbalance valve BV1 is a control valve configured to be opened when the pressure in the joint J8 shown in the figure becomes higher than the hydraulic pressure in the joint J9 by a predetermined value or more, and to allow the hydraulic fluid to flow from the joint J8 to the joint J9. The first threshold pressure is lower than the predetermined pressure at which the first counterbalance valve BV1 opens. Note that the same counterbalance valves BV2 to BV4 are connected to the fourth to sixth drain oil passages DR4 to DR6 connected to the third oil passage R3, the first oil passage R1, and the second oil passage R2, respectively. The fourth to sixth drain oil passages DR4 to DR6 are connected to the first drain oil passage DR1.

The fourth switching valve 75 includes a first connection port ZP1 connected to the third pilot oil passage PR3, a second connection port ZP2 connected to the fourth pilot oil passage PR4, a third connection port ZP3 connected to the second drain oil passage DR2, and a switching-valve pilot port 75P to which a pilot pressure is applied by the solenoid valve 71. When the pilot oil pressure is applied to the switching-valve pilot port 75P by the second threshold or more, the fourth switching valve 75 is switched to the drain position DP at which the first connection port ZP1, the second connection port ZP2, and the third connection port ZP3 are communicated with each other. When the pilot oil pressure smaller than the second threshold pressure is applied to the switching-valve pilot port 75P, the fourth switching valve 75 is switched to the pressurizing position UP at which the first connection port ZP1 and the second connection port ZP2 are communicated with each other and the third connection port ZP3 is disconnected from the first connection port ZP1 and the second connection port ZP2.

When the solenoid valve 71 is switched to the second position VP2 by the controller 15, the pilot oil pressure is applied to the switching-valve pilot port 75P at a second threshold pressure or higher. Thus, the fourth switching valve 75 is switched to the drain position DP, and the pilot pressure applied to the first pilot port PP1 becomes lower than the first threshold pressure. In this case, the first switching valve 72 is opened, and the second control valve 20 and the fourth chamber CB4 are connected via the fourth oil passage R4, and the fourth oil passage R4 and the first drain oil passage DR1 to the first counterbalance valve BV1 are connected.

At this time, when the arm input member 63 is tilted forward, the pilot pressure pp3 applied to the pilot port 20P2 becomes larger than the pilot pressure pp4 applied to the pilot port 20P2 by the predetermined pressure, and thus the second control valve 20 is switched to the second hydraulic cylinder extension control position AEP. Therefore, the hydraulic fluid having a pressure higher than the third threshold pressure from the hydraulic pump 11 is supplied to the third chamber CB3 of the second hydraulic cylinder 48 through the second control valve 20. As a result, the hydraulic fluid is output from the fourth chamber CB4 of the second hydraulic cylinder 48 to the fourth oil passage R4. Since the first switching valve 72 is opened, the hydraulic fluid is sent to the second arm control valve port XP2 of the second control valve 20 and is discharged to the third drain oil passage DR3 connected to the first drain oil passage DR1.

When the arm input member 63 is tilted rearward, the pilot pressure pp4 applied to the pilot port 20P2 becomes higher than the pilot pressure pp3 applied to the pilot port 20P1 by the predetermined pressure, and thus the second control valve 20 is switched to the second hydraulic cylinder retraction control position ASP. Therefore, the hydraulic fluid having a pressure higher than the third threshold pressure is supplied to the fourth chamber CB4 of the second hydraulic cylinder 48 via the second control valve 20 and the first switching valve 72. Thus, the hydraulic fluid is output from the third chamber CB3 of the second hydraulic cylinder 48 to the third oil passage R3. The hydraulic fluid is sent to the third arm control valve port XP3 of the second control valve 20 and is discharged to the third drain oil passage DR3 connected to the first drain oil passage DR1.

When the solenoid valve 71 is switched to the second position VP2 by the controller 15, the control of the implement 41 is performed independently of the control of the arm 45 except for automatic implement return control described later. In this state, when the implement input member 68 is tilted to the right, the pilot pressure pp1 applied to the pilot port 25P1 becomes larger than the pilot pressure pp2 applied to the pilot port 25P2 by the predetermined pressure, and thus the first control valve 25 is switched to the first hydraulic cylinder extension control position BEP. Therefore, the hydraulic fluid having a pressure higher than the fourth threshold pressure is supplied to the first chamber CB1 of the first hydraulic cylinder 49 through the first control valve 25. Thus, the hydraulic fluid is output from the second chamber CB2 of the first hydraulic cylinder 49 to the second oil passage R2. The hydraulic fluid is sent to the third implement control valve port YP3 of the first control valve 25 and is discharged to the seventh drain oil passage DR7 connected to the first drain oil passage DR1.

When the implement input member 68 is tilted to the left, the pilot pressure pp2 applied to the pilot port 25P2 becomes larger than the pilot pressure pp2 applied to the pilot port 25P1 by the predetermined pressure, and thus the first control valve 25 is switched to the first hydraulic cylinder retraction control position BSP. Therefore, the hydraulic fluid having a pressure higher than the fourth threshold pressure is supplied to the second chamber CB2 of the first hydraulic cylinder 49 through the first control valve 25. Thus, the hydraulic fluid is output from the first chamber CB1 of the first hydraulic cylinder 49 to the first oil passage R1. The hydraulic fluid is sent to the second implement control valve port YP2 of the first control valve 25 and is discharged to the seventh drain oil passage DR7 connected to the first drain oil passage DR1.

After the solenoid valve 71 is switched to the second position VP2, when the solenoid valve 71 is switched to the first position VP1 by the controller 15, pilot oil pressure lower than the second threshold pressure is applied to the switching-valve pilot port 75P, and the fourth switching valve 75 is switched to the pressurizing position UP. At the beginning of the switching, the pilot pressure applied to the first pilot port PP1 is lower than the first threshold pressure, but the pilot pressure immediately increases due to the hydraulic fluid flowing from the fourth oil passage R4. Since the predetermined pressure at which the first counterbalance valve opens is higher than the first threshold pressure, the pilot pressure exceeds the first threshold pressure, and the first switching valve 72 is closed. Therefore, the connection between the second control valve 20 and the fourth chamber CB4 of the second hydraulic cylinder 48 via the fourth oil passage R4 is cut off.

When the first switching valve 72 is closed, if the operation of raising the arm 45 is performed (the operation of tilting the arm input member 63 rearward) and the implement 41 is not operated (the operation of tilting the implement input member 68 to nothing), the second control valve 20 is switched to the second hydraulic cylinder extension control position AEP and the first control valve 25 is switched to the first hydraulic cylinder rest control position BNP. When the arm input member 63 and the implement input member 68 are the same, the same input member is not tilted to the left or right but tilted to the rear side.

At this time, as described above, the hydraulic fluid flows out from the fourth chamber CB4 of the second hydraulic cylinder 48, but flows from the first joint J1 to the second switching valve 73 because the first switching valve 72 is closed. Further, since the additional bypass oil passage BR2 and the first connection passage CR1 connected thereto are connected to the third drain oil passage DR3, the first pressure of the bypass oil passage BR1 (partial oil passage BR10) between the first joint J1 and the second switching valve 73 is larger than the second oil pressure of the first connection passage CR1. As a result, the second switching valve 73 is switched to the first communication position CP1. At this time, the hydraulic fluid is sent from the second switching valve 73 to the first chamber CB1 of the first hydraulic cylinder 49 via the bypass oil passage BR1 (partial oil passage R1) and the first oil passage R1 (partial oil passages R13). At this time, the hydraulic fluid is output from the second chamber CB2 of the first hydraulic cylinder 49 to the second oil passage R2 and the additional bypass oil passage BR2 (partial oil passage BR21), however, since the third switching valve 74 is located at the second shutoff position BP2, the hydraulic fluid cannot flow, and the oil pressure of the second connection passage CR2 rises. When the difference between the fourth oil pressure of the second connection passage CR2 and the third oil pressure of the additional bypass oil passage BR2 (partial passage BR20) exceeds the connection threshold pressure, the switching to either the twenty first communication position CP21 or the twenty second communication position CP22 is performed based on the difference between the third oil pressure of the additional bypass oil passage BR2 (partial passage BR20) and the fourth oil pressure of the second connection passage CR2. When the difference between the fourth oil pressure and the third oil pressure is smaller than a predetermined switching threshold value, the third switching valve 74 is switched to the twenty first communication position CP21. When the difference between the fourth oil pressure and the third oil pressure is equal to or larger than a predetermined switching threshold value, the third switching valve 74 is switched to the twenty second communication position CP22. When the third switching valve 74 is switched to the twenty first communication position CP21 or the twenty second communication position CP22, the hydraulic fluid output from the second chamber CB2 of the first hydraulic cylinder 49 is discharged to the hydraulic fluid tank 10 via the additional bypass oil passage BR2 and the third drain oil passage DR3.

However, when the hydraulic fluid flows out from the fourth chamber CB4 of the second hydraulic cylinder 48, when the second oil pressure of the first connection passage CR1 is increased and the second switching valve 73 is switched to the first blocking position BP1, the hydraulic fluid flowing out from the fourth chamber CB4 is discharged to the hydraulic fluid tank 10 through the first connection passage CR1, the additional bypass oil passage BR2, and the third drain oil passage DR3. Thus, as the hydraulic fluid flows into the third chamber CB3 of the second hydraulic cylinder 48, part of the oil discharged from the fourth chamber CB4 of the second hydraulic cylinder 48 flows into the first chamber CB1 of the first hydraulic cylinder 49, and the rest is discharged to the hydraulic fluid tank 10. The amount of the hydraulic fluid discharged to the hydraulic fluid tank 10 is adjusted by empirically adjusting the size of the throttle at the first blocking position BP1 of the second switching valve 73 so that the change in the elevation angle of the arm 45 with respect to the vehicle body 2 per unit amount of the hydraulic fluid discharged to the hydraulic fluid tank 10 is substantially equal to the change in the swing angle with respect to the arm 45. Therefore, it is controlled to change the swing angle of the implement tip 41T to the arm 45 corresponding to the elevation angle of the arm, and to make a direction from the joint 43 to the implement tip 41T face toward substantially the horizontal direction. Such control is called horizontal control.

When the first switching valve 72 is closed, if the operation of lowering the arm 45 is performed (the operation of tilting the arm input member 63 forward) and the implement 41 is not operated (the operation of tilting the implement input member 68 to nothing), the second control valve 20 is switched to the second hydraulic cylinder retraction control position ASP and the first control valve 25 is switched to the first hydraulic cylinder rest control position BNP. At this time, the hydraulic fluid having a pressure that exceeds the third threshold pressure is output from the second arm control valve port XP2. Since the third threshold pressure is higher than the first threshold pressure and the threshold pressure for opening the first counterbalance valve BV1, the hydraulic fluid is sent to the fourth chamber CB4 of the second hydraulic cylinder 48 via the fourth oil passage R4 by pushing and opening the first switching valve 72. At this time, the hydraulic fluid is discharged from the third chamber CB3 of the second hydraulic cylinder 48 to the hydraulic fluid tank 10 via the third oil passage R3 and the third drain oil passage DR3.

<Automatic Implement Return Control>

Next, the automatic implement return control will be described. FIG. 7 is a conceptual diagram of automatic implement return control in the case where the implement posture detection sensor 57 is comprised of the first inertial measurement unit 57*a* and the second inertial measurement unit 57*b*. The automatic implement return control is automatic control for changing the position and posture of the implement 41 and the arm 45 at the time of dumping the load to the reference position and posture of the implement 41 and the arm 45 stored in the memory 15M in advance when the input device 17 is turned on. The input device 17 is, for example, a button, a switch, a dial, or a touch panel. The position and posture of the arm 45 can be defined by an arm height $H_A$. When the load is dumped, that is, when the automatic implement return control is started, the arm height $H_A$ is set to the initial height STA_H, the implement direction 41D at the time of starting the automatic implement return control is set as the initial orientation STA_D. The arm height $H_A$ of the control target (serving as a reference) of the automatic implement return control is set as a reference height REF_H, and the implement direction 41D of the control target (serving as a reference) of the automatic implement return control is set as a reference direction REF_D. In the automatic implement return control, the arm height $H_A$ is changed from STA_H to REF_H and the implement direction 41D is changed from the initial orientation STA_D to the reference direction REF_D for arbitrary STA_H and STA_D. That is, the input device 17 is configured to receive an instruction to perform automatic control for changing the implement direction 41D and the arm height $H_A$ to the reference direction REF_D and the reference height REF_H, respectively.

FIG. 8 is a conceptual diagram of automatic implement return control in the case where the implement posture detection sensor 57 is constituted by a potentiometer 57*r*. Referring to FIG. 8, for controlling the arm height $H_A$, when the arm posture detection sensor 56 is composed of potentiometer 56*r*, the memory 15M stores a table (third relational data) representing a third correspondence relationship between the rotation angle $\theta_J$ of the fulcrum shaft 59P and the arm height $H_A$. The hardware processor 15P is configured to determine the arm height $H_A$ from the rotation angle $\theta_J$ detected by the potentiometer 56*r* based on the third correspondence relationship. Further, the memory 15M may be configured to store a table (second relational data) representing the second correspondence relationship between relationship between the rotation angle $\theta_J$ of the fulcrum shaft 59P and the position $P_A$ of the second hydraulic cylinder 48. The hardware processor 15P is configured to determine the position $P_A$ of the second hydraulic cylinder 48 from the rotation angle $\theta_J$ detected by the potentiometer 56*r* based on the second correspondence relationship. At this time, the memory 15M stores, as the control target corresponding to the reference height REF_H, REF_$\theta_J$ which is the rotation angle $\theta_J$ of the fulcrum shaft 59P corresponding to the reference height REF_H or the second reference position REF_PA which is the position $P_A$ of the second hydraulic cylinder 48 at that time.

Referring to FIG. 7 or 8, when the arm posture detection sensor 56 is formed of the linear sensor 56*p*, the memory 15M stores a table (fourth relational data) representing a fourth correspondence relationship between the position $P_A$ of the second hydraulic cylinder 48 and the arm height $H_A$. The hardware processor 15P is configured to determine the arm height $H_A$ from the position $P_A$ detected by the linear sensor 56*p* based on the fourth correspondence relationship.

At this time, the memory 15M stores the second reference position REF_$P_A$, which is the position $P_A$ of the second hydraulic cylinder 48, as the control target corresponding to REF_H.

Referring to FIG. 7, since the arm 45 rotates, when the position $P_I$ of the first hydraulic cylinder 49 is fixed (even if the relative posture of the implement 41 with respect to the arm distal end 45D does not change), the implement inclination angle $\theta_I$ changes in accordance with the arm height $H_A$. The variation of the implement inclination angle $\theta_I$ in accordance with the arm height $H_A$ is referred to as an adjustment angle $\theta_A$. In the following embodiments, the adjustment angle $\theta_A$ at the arm height $H_A$ is referred to as $\theta_A$ ($H_A$). Therefore, when the implement posture detection sensor 57 is constituted by the first inertial measurement unit 57*a* and the second inertial measurement unit 57*b*, the memory 15M stores a table representing a fifth correspondence relationship between the arm height $H_A$ and the adjustment angle $\theta_A$ ($H_A$). The adjustment angle $\theta_A$ may be determined according to the rotation angle $\theta_J$ of the fulcrum shaft 59P. In this case, the adjustment angle $\theta_A$ corresponding to the rotation angle $\theta_J$ of the fulcrum shaft 59P derived from the third correspondence relationship and the fifth correspondence relationship is stored in the memory 15M. Further, the adjustment angle $\theta_A$ may be determined according to the position $P_A$ of the second hydraulic cylinder 48. In this case, the adjustment angle $\theta_A$ corresponding to the position $P_A$ of the second hydraulic cylinder 48 derived from the fourth correspondence relationship and the fifth correspondence relationship is stored in the memory 15M. In FIG. 7 and the following embodiments, $\theta_A$ (REF_H)=0 is set for the sake of simplicity, but $\theta_A$ (REF_H) may be a value other than 0, and in this case, the adjustment angle $\theta_A$ ($H_A$) may be changed from a value used in the following description based on the value of $\theta_A$ (REF_H).

Further, the memory 15M stores a table (first relational data) representing a first correspondence relationship between the angle of which the adjustment angle $\theta_A$ ($H_A$) to be changed in accordance with the arm height $H_A$ is added to the implement inclination angle $\theta_I$ and the position $P_I$ of the first hydraulic cylinder 49. When the implement posture detection sensor 57 is comprised of the first inertial measurement unit 57*a* and the second inertial measurement unit 57*b*, the hardware processor 15P controls the position $P_I$ of the first hydraulic cylinder 49 while referring to the implement inclination angle $\theta_I$ detected by the implement posture detection sensor 57 in order to control the implement direction 41D, and determine the angle obtained by adding the adjustment angle $\theta_A$ ($H_A$) to the implement inclination angle $\theta_I$ with reference to the fifth correspondence relationship in order to determine the position Pr of the first hydraulic cylinder 49 corresponding to the above-described STA_D and REF_D. The hardware processor 15P obtains the position $P_I$ of the first hydraulic cylinder 49 from the angle obtained by adding the adjustment angle $\theta_A$ ($H_A$) to the implement inclination angle $\theta_I$ based on the first correspondence relationship. At this time, the memory 15M stores, as a control target corresponding to REF_D, the reference inclination angle REF_$\theta_I$, which is the implement inclination angle $\theta_I$ corresponding to REF_D, plus the adjustment angle $\theta_A$ (REF_H) [the reference inclination angle REF_$\theta_I$ when $\theta_A$ (REF_H)=0], and the first reference position REF_$P_I$, which is the position $P_I$ of the first hydraulic cylinder 49 at that time.

Referring to FIG. 8, when the implement posture detection sensor 57 is constituted by the potentiometer 57*r*, the concept of the adjustment angle A ($H_A$) described above is not necessary, and the rotation angle $\theta_R$ of the joint 43 is detected from the potentiometer 57*r*. The hardware processor 15P controls the rotation angle $\theta_R$ of the joint 43 to control the implement direction 41D. However, in order to obtain the position $P_I$ of the first hydraulic cylinder 49 corresponding to the initial orientation STA_D and the reference direction REF_D, the memory 15M stores a table storing the sixth correspondence relationship between the rotation angle $\theta_R$ of the joint 43 and the position $P_I$ of the first hydraulic cylinder 49. The hardware processor 15P refers to the sixth correspondence relationship to obtain the position $P_I$ of the first hydraulic cylinder 49 from the rotation angle $\theta_R$ of the joint 43. At this time, the memory 15M stores, as the control target corresponding to the reference direction REF_D, the first reference position REF_$P_I$ which is the position Prof the first hydraulic cylinder 49 when the reference rotation angle REF_$\theta_R$ which is the rotation angle $\theta_R$ of the joint 43 corresponding to the reference direction REF_D.

Referring to FIGS. 7 and 8, when the implement posture detection sensor 57 is formed of the linear sensor 57*p*, the concept of the adjustment angle $\theta_A$ ($H_A$) and the rotation angle $\theta_R$ of the joint 43 is not necessary, and the position $P_I$ of the first hydraulic cylinder 49 may be controlled as a control amount so as to move from the position $P_I$ corresponding to STA_D to the position $P_I$ corresponding to REF_D. The memory 15M stores the first reference position REF_F which is the position of the first hydraulic cylinder 49 corresponding to REF_D as the control target corresponding to REF_D. Among the above, REF_$\theta_R$ or REF_$P_I$ is referred to as first information corresponding to the reference direction REF_D. REF_$\theta_J$ or REF_$P_A$ is referred to as second information corresponding to the reference height REF_H. The first information includes a first reference value (REF_$\theta_R$ or REF_$P_I$) of the first parameter (the rotation angle $\theta_R$ and the position $P_I$) corresponding to the reference direction REF_D. REF_$P_I$ may also be referred to as a first reference position of the first hydraulic cylinder 49. The second information includes a second reference value (REF_$\theta_J$, REF_$P_A$) of the second parameter (the rotation angle $\theta_J$, the position $P_A$) corresponding to the reference height REF_H. REF_$P_A$ may also be referred to as a second reference position of the second hydraulic cylinder 48.

The present automatic implement return control is characterized in that the first hydraulic cylinder 49 is controlled to be the same relative posture with respect to the arm distal end 45D of the implement 41 at the reference height REF_H at the target height TAR_H which is the arm height $H_A$ between the initial height STA_H and the reference height REF_H, and thereafter the arm height $H_A$ is changed to the reference height REF_H by controlling the second hydraulic cylinder 48 without changing the position $P_I$ of the first hydraulic cylinder 49. That is, the controller 15 is configured to determine the arm height $H_A$ of the arm distal end 45D when the implement tip 41T is directed to the reference direction REF_D in the middle of the automatic implement return control as the target height TAR_H. The controller 15 is configured to control the hydraulic circuit 100 so that the arm height $H_A$ is changed from the initial height STA_H to the reference height REF_H.

The controller 15 is configured to control the hydraulic circuit 100 so that the implement direction 41D becomes the reference direction REF_D when the arm height $H_A$ changes to the target height TAR_H in the middle of the automatic implement return control when the instruction to start the automatic implement return control is received by the input device 17. For example, the target height TAR_H is a value obtained by adding a predetermined offset value $H_{off}$ to the reference height REF_H. That is, the target height TAR_H is greater than the reference height REF_H.

FIG. 9 is a diagram showing the relationship between the change in the arm height $H_A$ and the change in the implement inclination angle $\theta_I$ in the automatic implement return control when the implement posture detection sensor 57 is constituted by the first inertial measurement unit 57*a* and the second inertial measurement unit 57*b*. FIG. 10 is a control block diagram according to the embodiment. The control system 150 according to the embodiment includes a control target calculation module 151. The control target calculation module 151 is realized by, for example, a program stored in the memory 15M and executed by the hardware processor 15P. First, at the time when the reference height REF_H is input (at the time when a registration instruction for registering the reference direction REF_D and the reference height REF_H is input to the additional input device 13 described later), the hardware processor 15P calculates a value obtained by adding the offset value $H_{off}$ to the registered reference height REF_H as the target height TAR_H. Then, the hardware processor 15P obtains the adjustment angle $\theta_A$ (TAR_H) at the target height TAR_H from the fifth correspondence relationship. The hardware processor 15P further reads the reference inclination angle REF_$\theta_I$+adjustment angle $\theta_A$ (REF_H) [or the reference inclination angle REF_$\theta_I$ when $\theta_A$ (REF_H)=0] stored in the memory 15M, and determines the implement inclination angle REF_$\theta_I$+$\theta_A$ (TAR_H) when the arm height $H_A$ becomes the target height TAR_H. REF_$\theta_I$+$\theta_A$ (TAR_H) corresponds to the first reference value of the first parameter corresponding to the target height TAR_H. That is, the controller 15 determines the first reference value REF_$\theta_I$+$\theta_A$ (TAR_H) of the first parameter corresponding to the target height TAR_H. Thus the first information includes REF_$\theta_I$+$\theta_A$ (TAR_H) as the first reference value of the first parameter corresponding to the reference direction REF_D. REF_$\theta_I$+$\theta_A$ (TAR_H) is stored in the memory 15M. REF_$\theta_I$+$\theta_A$ (TAR_H) is input to the control target calculation module 151.

The controller 15 performs the following processing when executing the control target calculation module 151. At the start of the automatic implement return control, which is the time point when the input device 17 receives the instruction to start the automatic implement return control, the controller 15 acquires the second initial rotation angle STA_$\theta_J$ of the fulcrum shaft 59P or the second initial position STA_$P_A$ of the second hydraulic cylinder 48 corresponding to the initial height STA_H obtained from the arm posture detection sensor 56 at that time. When the arm posture detection sensor 56 is the potentiometer 56*r* and acquires the second initial rotation angle STA_$\theta_J$, the controller 15 obtains the second initial position STA_$P_A$ corresponding to the initial height STA_H which is the position $P_A$ of the second hydraulic cylinder 48 based on the second correspondence relationship. When the arm posture detection sensor 56 is the potentiometer 56*r* and acquires the second initial rotation angle STA_$\theta_J$, the controller 15 obtains the initial height STA_H with reference to the third correspondence relationship. When the arm posture detection sensor 56 is the linear sensor 56*p* and acquires the second initial position STA_$P_A$, the controller 15 obtains the initial height STA_H with reference to the fourth correspondence relationship.

Next, the controller 15 obtains STA_$\theta_I$, which is the implement inclination angle $\theta_I$ corresponding to the initial orientation STA_D obtained from the implement posture detection sensor 57, from the output of the implement posture detection sensor 57. STA_$\theta_I$ corresponds to the first initial position STA_$P_I$ which is the position $P_I$ of the first hydraulic cylinder 49 at the time when the instruction to start the automatic implement return control is received by the input device 17. The controller 15 obtains the adjustment angle $\theta_A$ (STA_H) from the initial height STA_H based on the fifth correspondence relationship. The controller obtains a first initial position STA_$P_I$ which is the position $P_I$ of the first hydraulic cylinder 49 at the time when the instruction to start the automatic implement return control is received by the input device 17, from STA_$\theta_I$+$\theta_A$ (STA_H) based on the first correspondence relationship. The controller 15 generates a map M1 including L1 represented such that the implement inclination angle $\theta_I$ linearly changes from STA_$\theta_I$ to REF_$\theta_I$+$\theta_A$ (TAR_H) and L2 represented such that the arm height $H_A$ linearly changes from the initial height STA_H at the start of the automatic implement return control to the reference height REF_H. The horizontal axis of the map M1 is the timing t, the arm height $H_A$ at the timing t corresponds to the coordinate of the vertical axis on the right side of the point P on the L2, and the implement inclination angle $\theta_I$ at the timing t corresponds to the coordinate of the vertical axis on the left side of the point Q on the L1. The above is the processing of the control target calculation module 151.

The controller 15 performs feedforward control so that the arm height $H_A$ obtained from the second parameters (the rotation angle $\theta_J$ and the position $P_A$) detected by the arm posture detection sensor 56 decreases monotonously as indicated by 56*r* in FIG. 9, regardless of whether the arm posture detection sensor 56 is the potentiometer 56*r* or the linear sensor 56P. The control system 150 includes a feedforward controller $Cf_{v1}$ that performs this control. In the feedforward control, when the input device 17 receives an instruction to start the automatic implement return control, the controller 15 controls the hydraulic circuit 100 (second hydraulic cylinder 48) so that the second parameters (the rotation angle θ J of the fulcrum shaft 59P and the position $P_A$ of the second hydraulic cylinder 48) approach the second reference values (REF_$\theta_J$, REF_$P_A$). This feedforward control of second hydraulic cylinder 48 will be described later.

<Map Generation>

When the arm height $H_A$ at the timing t when the second hydraulic cylinder 48 is controlled in this way is $H_A$ (t), the controller 15 controls the first hydraulic cylinder 49 so as to approach the implement inclination angle $\theta_I$ (t) in the correspondence relationship as shown in FIG. 9. To be specific, the controller 15 obtains the arm height $H_A$ from the second parameters (the rotation angle $\theta_J$ of the fulcrum shaft 59P and the position $P_A$ of the second hydraulic cylinder 48) detected by the arm posture detection sensor 56 based on the third correspondence relationship or the fourth correspondence relationship. The controller 15 calculates the timing t corresponding to the obtained arm height $H_A$ from the map M1. The controller 15 obtains the implement inclination angle $\theta_I$ (t) corresponding to the obtained timing t from the map M1. As shown in FIG. 9, in the map M1, the first parameter corresponding to the point R at which the arm height $H_A$ becomes the target height TAR_H in L2 is set to be the first reference value REF_$\theta_I$+$\theta_A$ (TAR_H). Therefore, the controller 15 controls the hydraulic circuit 100 (the first hydraulic cylinder 49) so that the implement inclination angle $\theta_I$, which is the first parameter, approaches the first reference value REF_$\theta_I$+$\theta_A$ (TAR_H) when the arm height $H_A$ changes to the target height TAR_H. In this way, the map M1 represents the target of the control (a target operation). The first hydraulic cylinder 49 is controlled by a feedforward control and a feedback control when a predetermined condition is satisfied. Therefore, the control system 150 includes a feedforward controller $Cf_{v1}$ that performs the feedforward control and a feedback converter 152 and a feedback controller $Cb_{v1}$ that performs the feedback control. The control of the first hydraulic cylinder 49 will be described in detail later. In FIG. 9, the position $P_A$ of the second hydraulic cylinder 48 corresponding to the target height TAR_H is shown as a second target position TAR_$P_A$. The second target position TAR_$P_A$ is used in the feedforward process, which will be described later.

Figure 13:
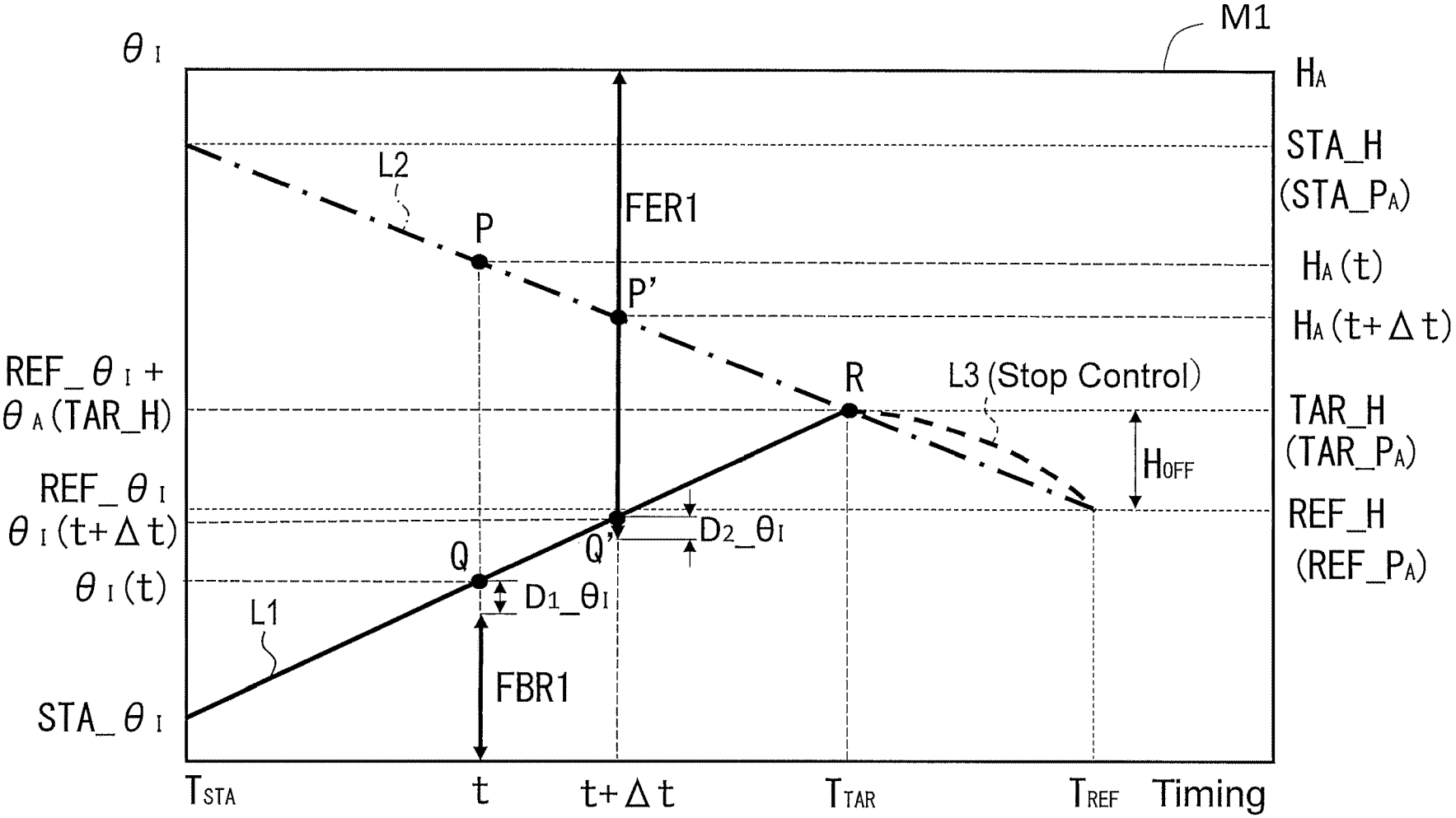
FIG. 13 is a diagram showing the relationship between a change in arm height and a change in implement inclination angle in automatic implement return control.

And when the implement inclination angle $\theta_I$, which is the first parameter, becomes a first reference value REF_$\theta_I$+$\theta_A$ (TAR_H), until the position $P_A$ of the second hydraulic cylinder 48 changes to the second reference position REF_$P_A$, the controller 15 controls the hydraulic circuit 100 not to change the position $P_I$ of the first hydraulic cylinder 49. The dotted line L3 in FIG. 13 shows how the implement inclination angle $\theta_I$ changes as a result of controlling the first hydraulic cylinder 49 so that the position Pr of the first hydraulic cylinder 49 do not change, but the controller 15 does not control the first hydraulic cylinder 49 so that the implement inclination angle $\theta_I$ follows the dotted line L3.

Figure 11:
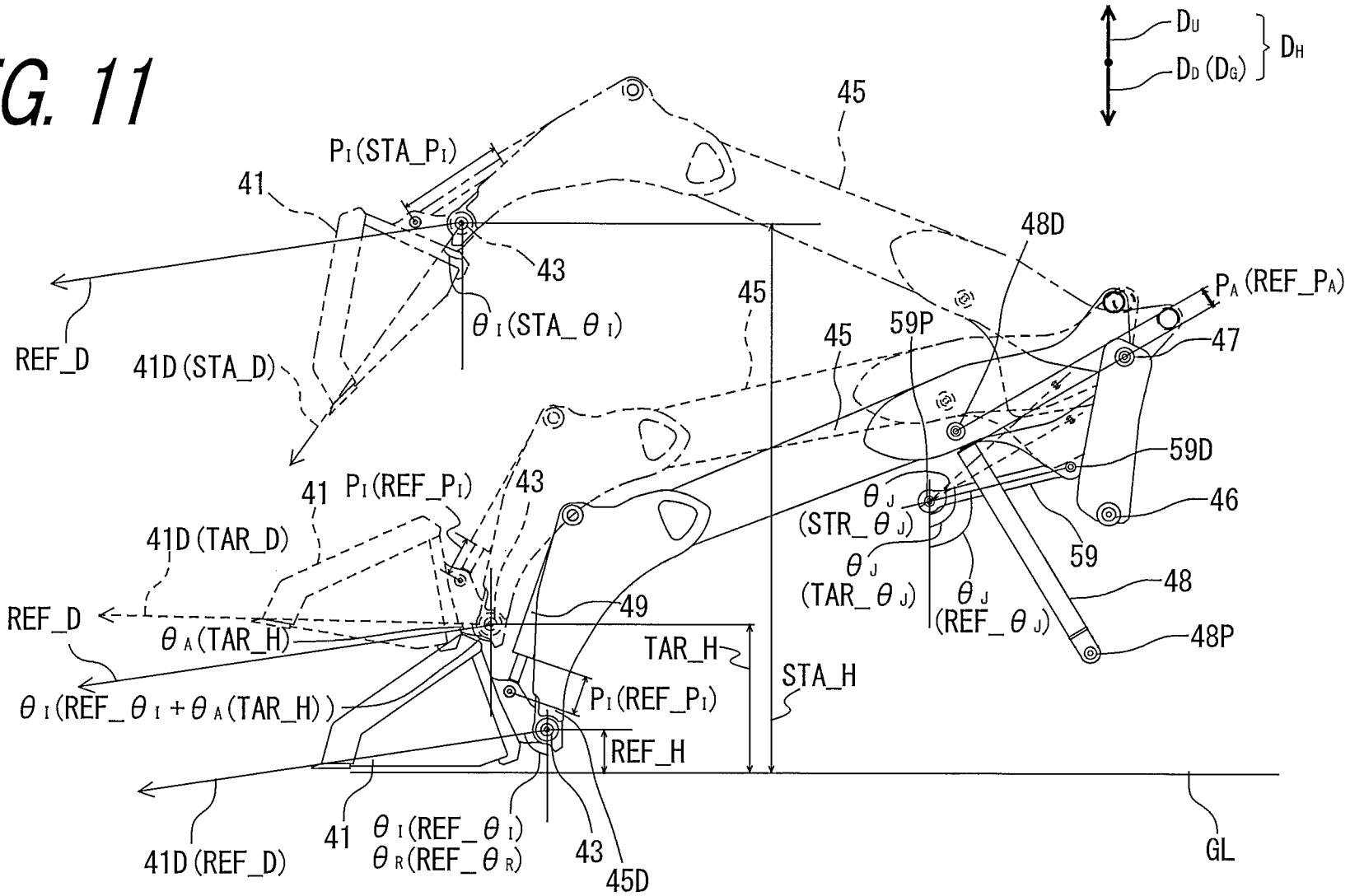
FIG. 11 is a conceptual diagram of automatic implement return control in the case where the implement posture detection sensor is comprised of a first inertial measurement unit and a second inertial measurement unit.

FIG. 11 is a diagram showing the relationship between the change in the arm height $H_A$ and the change in the rotation angle $\theta_R$ of the joint 43 in the automatic implement return control when the implement posture detection sensor 57 is constituted by the potentiometer 57*r*. FIG. 11 is similar to FIG. 9, but the control parameter is changed from the implement inclination angle $\theta_I$ to the rotation angle $\theta_R$, and therefore, the posture of the implement 41 does not necessarily change in accordance with the arm height $H_A$ in the control method of FIG. 11, as in the control method of FIG. 9. However, the present embodiment is the same as FIG. 9 in that the parameter is changed to a parameter corresponding to the reference direction REF_D when the arm height $H_A$ becomes the target height TAR_H. The control of the second hydraulic cylinder 48 in this case is the same as the control shown in the description of FIG. 9.

In this control, when the target height TAR_H is determined, the controller 15 determines the reference rotation angle REF_$\theta_R$ of the joint 43 at which the arm height $H_A$ becomes the target height TAR_H. REF_$\theta_R$ is the rotation angle $\theta_R$ of the joint 43 corresponding to the reference direction REF_D. That is, REF_$\theta_R$ is the first reference value of the first parameter corresponding to the target height TAR_H. That is, the controller 15 determines the first reference value REF_$\theta_R$ of the first parameter corresponding to the target height TAR_H. REF_$\theta_R$ is input to the control target calculation module 151.

The controller 15 performs the following processing when executing the control target calculation module 151. At the start of the automatic implement return control, the controller 15 obtains STA_$\theta_R$, which is the rotation angle $\theta_R$ of the joint 43 corresponding to the initial orientation STA_D obtained from the implement posture detection sensor 57 at that time, from the output of the implement posture detection sensor 57. STA_$\theta_R$ is a parameter corresponding to the first initial position STA_$P_I$ which is the position $P_I$ of the first hydraulic cylinder 49 at the time when the instruction to start the automatic implement return control is received by the input device 17. The controller 15 generates a map M2 including L1 represented such that the rotation angle $\theta_R$ linearly changes from STA_$\theta_R$ to REF_$\theta_R$ and a L2 represented such that the arm height $H_A$ linearly changes from the initial height STA_H at the start of the automatic implement return control to the reference height REF_H. The horizontal axis of the map M2 is the timing t, the arm height $H_A$ at the timing t corresponds to the coordinate of the vertical axis on the right side of the point P on the L2, and the rotation angle $\theta_R$ of the joint 43 at the timing t corresponds to the coordinate of the vertical axis on the left side of the point Q on the L1. The above is the processing of the control target calculation module 151.

In FIG. 11, when the arm height $H_A$ at the timing t is $H_A$ (t), the controller 15 controls the first hydraulic cylinder 49 to approach the rotation angle $\theta_R$ (t) in the correspondence relationship as shown in FIG. 11. To be specific, the controller 15 obtains the arm height $H_A$ from the parameters (the rotation angle $\theta_J$ of the fulcrum shaft 59P and the position $P_A$ of the second hydraulic cylinder 48) detected by the arm posture detection sensor 56 based on the third correspondence relationship or the fourth correspondence relationship. The controller 15 obtains the timing t corresponding to the obtained arm height $H_A$ from the map M2. The controller 15 obtains the rotation angle $\theta_R$ (t) corresponding to the obtained timing t from the map M2. As shown in FIG. 11, since the map M2 is determined such that the L2 passes through the point R at which the arm height $H_A$ becomes the target height TAR_H in the L1, the controller 15 controls the hydraulic circuit 100 such that the rotation angle $\theta_R$ which is the first parameter is changed to the first reference value REF_$\theta_R$ when the arm height $H_A$ is changed to the target height TAR_H. That is, the map M2 is a target of control (a target operation). As in the case of FIG. 9, the first hydraulic cylinder 49 is controlled by feedback control when predetermined conditions are satisfied with the feedforward control. The feedforward controller $Cf_{v2}$ described above performs the feedforward control. The feedback converter 152 and the feedback controller $Cb_{v2}$ described above perform this feedback control. The control of the first hydraulic cylinder 49 will be described in detail later.

When the rotation angle $\theta_R$ of the joint 43 becomes REF_$\theta_R$, that is, when the position $P_I$ of the first hydraulic cylinder 49 becomes the first reference position REF_$P_I$, the controller 15 controls the hydraulic circuit 100 so that the position $P_I$ of the first hydraulic cylinder does not change until the position $P_A$ of the second hydraulic cylinder 48 changes to the second reference position REF_$P_A$. The straight line L3 in FIG. 13 shows how the rotation angle $\theta_R$ of the joint 43 changes as a result of controlling the first hydraulic cylinder 49 so that the position $P_I$ of the first hydraulic cylinder 49 do not change, but the controller 15 may control the first hydraulic cylinder 49 so that the rotation angle $\theta_R$ of the joint 43 follows the straight line L3.

Figure 12:
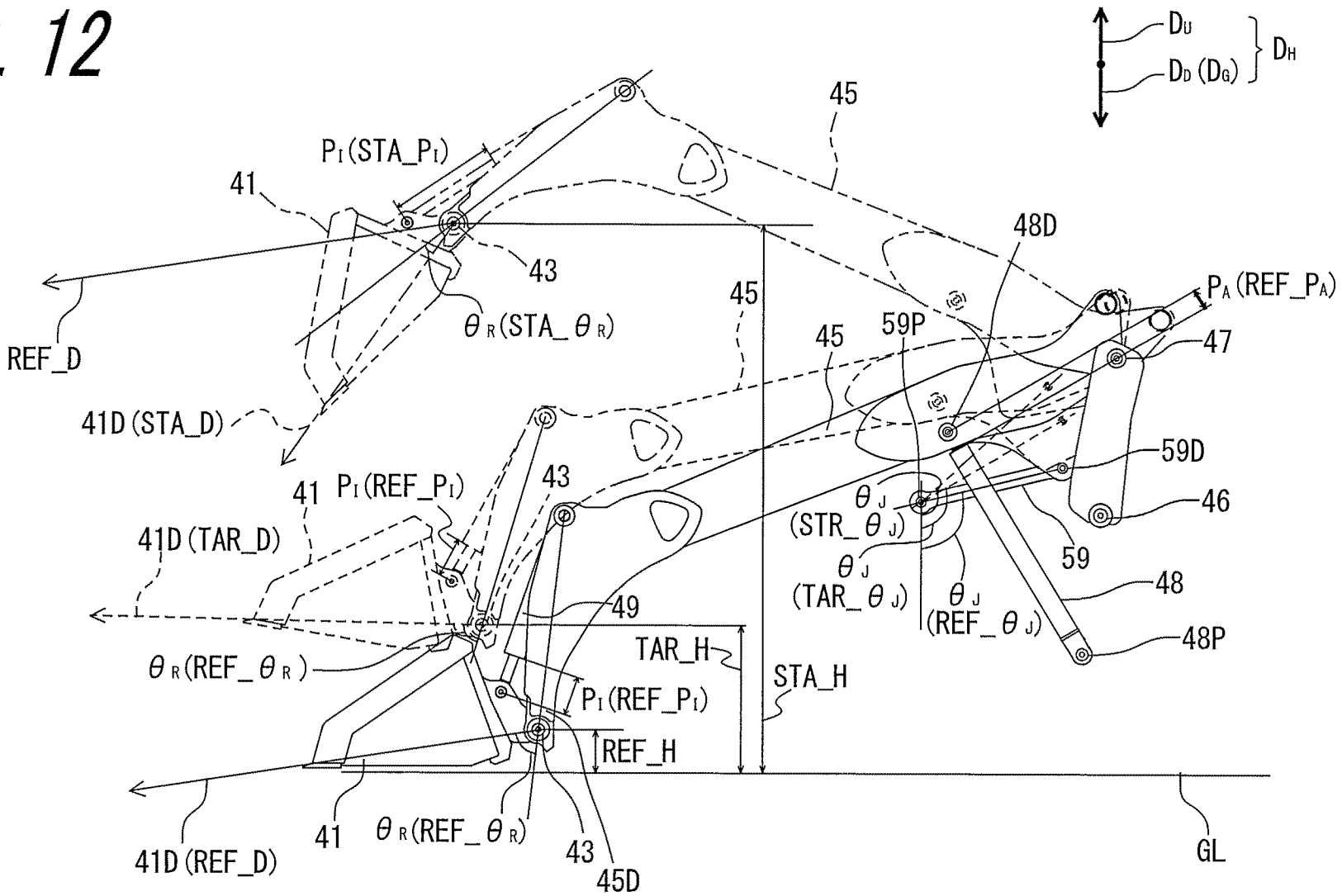
FIG. 12 is a conceptual diagram of automatic implement return control in the case where the implement posture detection sensor is formed of a potentiometer.

FIG. 12 is a diagram showing a relationship between a change in the arm height $H_A$ in the automatic implement return control and a change in the position Pr of the first hydraulic cylinder 49 in the case where the implement posture detection sensor 57 is formed of the linear sensor 57*p*. Although FIG. 12 is similar to FIGS. 9 and 11, the control parameter is changed from the implement inclination angle $\theta_I$ and the rotation angle $\theta_R$ of the joint 43 to the position Pr of the first hydraulic cylinder 49, and therefore, the control method of FIG. 12 does not necessarily change the posture of the implement 41 in accordance with the arm height $H_A$ as in the control method of FIGS. 9 and 11. However, the present embodiment is the same as FIGS. 9 and 11 in that the parameter is changed to a parameter corresponding to the reference direction REF_D when the arm height $H_A$ becomes the target height TAR_H. The control of the second hydraulic cylinder 48 in this case is the same as the control shown in the description of FIG. 9.

In this control, when the target height TAR_H is determined, the controller 15 determines the position REF_$P_I$ of the first hydraulic cylinder 49 at which the arm height $H_A$ becomes the target height TAR_H. REF_$P_I$ is a first reference position which is the position $P_A$ of the first hydraulic cylinder 49 corresponding to the reference direction REF_D. In addition, REF_$P_I$ is the first reference value of the first parameter corresponding to the target height TAR_H. That is, the controller 15 determines the first reference value REF_$P_I$ of the first parameter corresponding to the target height TAR_H. REF_$P_I$ is input to the control target calculation module 151.

The controller 15 performs the following processing when executing the control target calculation module 151. At the start of the automatic implement return control, the controller 15 obtains the first initial position STA_$P_I$ obtained from the implement posture detection sensor 57 at that time from the output of the implement posture detection sensor 57. The controller 15 generates a map M3 including L1 represented such that the position $P_A$ of the first hydraulic cylinder 49 linearly changes from STA_$P_I$ to REF_$P_I$ and L2 represented such that the arm height $H_A$ linearly changes from the initial height STA_H at the start of the automatic implement return control to the reference height REF_H. The horizontal axis of the map M3 is the timing t, the arm height $H_A$ at the timing t corresponds to the coordinate of the vertical axis on the right side of the point P on the L2, and the position $P_A$ of the first hydraulic cylinder 49 at the timing t corresponds to the coordinate of the vertical axis on the left side of the point Q on the L1. The above is the processing of the control target calculation module 151.

In FIG. 12, when the arm height $H_A$ at time tis $H_A$ (t), the controller 15 controls the first hydraulic cylinder 49 so that the arm height $H_A$ approaches the position $P_I$ (t) of the first hydraulic cylinder 49 in the correspondence relationship as shown in FIG. 12. To be specific, the controller 15 obtains the arm height $H_A$ from the parameters (the rotation angle $\theta_J$ of the fulcrum shaft 59P and the position $P_A$ of the second hydraulic cylinder 48) detected by the arm posture detection sensor 56 based on the third correspondence relationship or the fourth correspondence relationship. The controller 15 obtains the timing t corresponding to the obtained arm height $H_A$ from the map M3. The controller 15 obtains the position $P_I$ (t) of the first hydraulic cylinder 49 corresponding to the obtained timing t from the map M3. As shown in FIG. 12, since the map M3 is determined such that the L2 passes through the point R at which the arm height $H_A$ becomes the target height TAR_H in the L1, the controller 15 controls the hydraulic circuit 100 such that the position $P_I$ of the first hydraulic cylinder 49, which is the first parameter, is changed to the first reference position REF_$P_I$, which is the first reference value, when the arm height $H_A$ is changed to the target height TAR_H. That is, the map M3 is a target of control (a target operation). As in the case of FIG. 11, the first hydraulic cylinder 49 is controlled by feedback control when predetermined conditions are satisfied with the feedforward control. The feedforward controller $Cf_{v2}$ described above performs the feedforward control. The feedback converter 152 and the feedback controller $Cb_{v2}$ described above perform this feedback control. The control of the first hydraulic cylinder 49 will be described in detail later.

When the position $P_I$ of the first hydraulic cylinder 49 reaches the first reference position REF_$P_I$, the controller 15 controls the hydraulic circuit 100 so that the position $P_I$ of the first hydraulic cylinder 49 does not change until the position $P_A$ of the second hydraulic cylinder 48 changes to the second reference position REF_$P_A$. A straight line L3 in FIG. 13 shows a result of controlling the first hydraulic cylinder 49 so that the position Pr of the first hydraulic cylinder 49 does not change.

The first reference position REF_$P_I$, the second reference position REF_$P_A$, the target height TAR_H, and the second target position TAR_$P_A$ are determined as follows. The work vehicle 1 further includes an additional input device 13 that receives a registration instruction for registering the reference direction REF_D and the reference height REF_H. The additional input device 13 is, for example, a button, a switch, a dial, or a touch panel. In the case where the arm posture detection sensor 56 is formed of the potentiometer 56*r*, when the additional input device 13 receives the registration instruction, the controller 15 obtains the position $P_A$ of the second hydraulic cylinder 48 from the rotation angle $\theta_J$ of the fulcrum shaft 59P (joints) at the time when the registration instruction is received, based on the second correspondence relationship. The controller 15 sets the obtained position $P_A$ as the second reference position REF_$P_A$. The controller 15 obtains the reference height REF_H from the rotation angle $\theta_J$ of the fulcrum shaft 59P (joint) at the time when the registration instruction is received based on the third correspondence relationship. The controller 15 sets a value obtained by adding the offset value $H_{off}$ to the obtained reference height REF_H as the target height TAR_H. The controller 15 obtains the second target position TAR_$P_A$ from the target height TAR_H based on the fourth correspondence relationship. The second target position TAR_$P_A$ thus determined is stored in the memory 15M.

In the case where the arm posture detection sensor 56 is formed of the linear sensor 56*p*, when the additional input device 13 receives the registration instruction, the controller 15 obtains the position $P_A$ of the second hydraulic cylinder 48 detected by the linear sensor 56*p* at the time when the registration instruction is received. The controller 15 sets the obtained position $P_A$ as the second reference position REF_$P_A$. The controller 15 obtains the reference height REF_H from the second reference position REF_$P_A$ based on the fourth correspondence relationship. The controller 15 sets a value obtained by adding the offset value $H_{off}$ to the obtained reference height REF_H as the target height TAR_H. The controller 15 obtains the second target position TAR_$P_A$ from the target height TAR_H based on the fourth correspondence relationship. The second target position TAR_$P_A$ thus determined is stored in the memory 15M.

In a case where the implement posture detection sensor 57 is configured of a first inertial measurement unit 57*a* and a second inertial measurement unit 57*b*, when the additional input device 13 receives the registration instruction, the controller 15 obtains the reference inclination angle REF_$\theta_I$, which is the implement inclination angle $\theta_I$ at the time when the registration instruction is received, from the output of the first inertial measurement unit 57*a* and the output of the second inertial measurement unit 57*b* at the time when the registration instruction is received, and stores the reference inclination angle REF_$\theta_I$ in the memory 15M. The controller 15 obtains the reference height REF_H from the second reference position REF_$P_A$ based on the fourth correspondence relationship and obtains the adjustment angle $\theta_A$ (REF_H) from the reference height REF_H based on the fifth correspondence relationship. The controller obtains the first reference position REF_$P_I$ from REF_$\theta_I$+$\theta_A$ (REF_H) based on the first correspondence relationship.

When the implement posture detection sensor 57 is constituted of a potentiometer 57*r*, when the additional input device 13 receives a registration instruction, the controller 15 obtains the reference rotation angle REF_$\theta_R$ which is the rotation angle $\theta_R$ of the joint 43 at the time of receiving the registration instruction from the output of the potentiometer 57*r* at the time of receiving the registration instruction, stores the reference rotation angle REF_$\theta_R$ in the memory 15M. The controller 15 calculates the first reference position REF_$P_I$ from the reference rotation angle REF_$\theta_R$ with reference to the sixth correspondence relationship. In the case where the implement posture detection sensor 57 is formed of the linear sensor 57*p*, when the additional input device 13 receives the registration instruction, the controller 15 obtains the first reference position REF_$P_I$ from the output of the linear sensor 57*p* at the time when the registration instruction is received.

<Feedforward Control>

Next, the feedforward control of the first hydraulic cylinder 49 and the feedforward control of the second hydraulic cylinder 48 will be described. The hydraulic circuit 100 as described above is configured to equalize the difference between the pressure difference of input-output of the first control valve 25 and the pressure difference of the input-output of the second control valve 20, therefore, the ratio of the flow rate of the hydraulic fluid per unit time through the first control valve 25 and the flow rate of the hydraulic fluid per unit time through the second control valve 20 can be adjusted by the ratio of the first opening area AS1 set by the first control valve 25 to the second opening area AS2 set by the second control valve 20. By utilizing this, the feedforward control described below is performed at the start timing $T_{STA}$ of the automatic implement return control and the timing $T_{TAR}$ at which the arm height $H_A$ becomes the target height TAR_H shown in FIGS. 9, 11, and 12.

First, when the input device 17 receives an instruction to start the automatic implement return control, the controller 15 executing the control target calculation module 151 obtains a first initial position STA_$P_I$ which is the position $P_I$ of the first hydraulic cylinder 49 at the time of receiving the instruction and a second initial position STA_$P_A$ which is the position $P_A$ of the second hydraulic cylinder 48 at the time of receiving the instruction by the above-described method. The controller 15 acquires the first reference position REF_$P_I$, the second reference position REF_$P_A$, and the second target position TAR_$P_A$ from the memory 15M. The controller 15 is configured to calculate the first volume V1 of the hydraulic fluid supplied from the hydraulic pump 11 to the first hydraulic cylinder 49 in order to set the position $P_I$ of the first hydraulic cylinder 49 as the first reference position REF_$P_I$ from the first initial position STA_$P_I$ and the first reference position REF_$P_I$. The controller 15 is configured to calculate the second volume V2 of the hydraulic fluid supplied from the hydraulic pump 11 to the second hydraulic cylinder 48 in order to set the position $P_A$ of the second hydraulic cylinder 48 as the second target position TAR_$P_A$ from the second initial position STA_$P_A$ and the second target position TAR_$P_A$.

Next, when the input device 17 receives the instruction to start the automatic implement return control, the controller 15 obtains the maximum allowable value SEM of the sum of the first opening area AS1 and the second opening area AS2 from the rotation speed of the engine 6 at the time when the instruction is received. To be specific, the memory 15M stores a table representing a correspondence relationship between the rotation speed of the engine 6 and the maximum allowable value SEM, and the hardware processor 15P acquires the rotation speed of the engine 6 detected by the rotation speed detection sensor 6*a* and obtains the maximum allowable value SEM from the rotation speed with reference to the table. The controller 15 determines a limit value SAM which is the sum of the maximum value SMA1 of the first opening area AS1 when the first control valve 25 is switched to the first hydraulic cylinder retraction control position BSP and the maximum value SMA2 of the second opening area AS2 when the second control valve 20 is switched to the second hydraulic cylinder retraction control position ASP. The controller 15 determines the reference value SFF which is smaller value among the maximum allowable value SEM and the limit value SAM. The limit value SAM is known from the specifications of the first control valve 25 and the specifications of the second control valve 20, and is stored in the memory 15M in advance.

The controller 15 calculates the reference area SB1 which is a reference of the first opening area AS1 based on the following (Equation 1).

$$SB1 = SFF \times V1/(V1 + V2) \quad \text{(Equation 1)}$$

That is, the reference area SB1 is (first volume V1/(first volume V1+second volume V2)) times the reference value SFF. The controller 15 controls the first opening area AS1 of the first control valve 25 based on the reference area SB1 until the positions $P_I$ of the first hydraulic cylinder 49 changes from the first initial position STA_$P_I$ to the first reference positions REF_$P_I$.

The controller 15 further performs the following processing. The controller 15 sets the corrected area SB2 to the first target area TS1 when the corrected area SB2 obtained by multiplying the reference area SB1 by the first correction coefficient K1 associated with the rotation speed of the engine 6 is equal to or less than the maximum value SMA1 of the first opening area AS1. FIG. 13 is a diagram showing a relationship between the rotation speed of the engine 6 and the first correction coefficient K1. This is because the arm 45 tends to lower the arm height $H_A$ due to the influence of gravity, whereas the implement 41 must ascend the implement tip 41T against gravity, and therefore, when the rotation speed of the engine 6 is low, that is, when the discharge amount from the hydraulic pump 11 is small, the amount of fluctuation of the implement direction 41D with respect to the amount of fluctuation of the arm height $H_A$ becomes small with respect to the control target. FIG. 13 is a graph showing the first correction coefficient K1 that can eliminate the influence of the temperature difference. The engine rotation speed NEO corresponding to the first coefficient of 1 in FIG. 13 is a high idle rotation speed of the engine 6. When the corrected area SB2 is larger than the maximum value SMA1 of the first opening area AS1, the controller 15 sets the maximum value SMA1 as the first target area TS1. The controller 15 sets a value obtained by multiplying a value obtained by subtracting the first target area TS1 from the reference value SFF by the second opening area of the second control valve as the second target area TS2 of the second control valve 20. The first target area TS1 is input to the feedforward controller $Cf_{v1}$. The second target area TS2 is input to the feedforward controller $Cf_{v2}$.

The controller 15 performs the feedforward control so that the first opening area AS1 of the first control valve 25 is set to the first target area TS1 while the position $P_I$ of the first hydraulic cylinder 49 is changed from the first initial position STA_$P_I$ to the first reference position REF_$P_I$. To be more specific, in the execution of the feedforward controller $Cf_{v1}$, the controller 15 determines a feedforward control amount (FF control amount) u1*o* of the first pilot control valve 65 and an FF control amount u2*o* of the second pilot control valve 66 so that the first opening area AS1 of the first control valve 25 becomes the first target area TS1, and outputs the FF control amount u1*o* to the solenoid 65*s* of the first pilot control valve 65 and the FF control amount u2*o* to the solenoid 66*s* of the second pilot control valve 66.

The controller 15 performs the feedforward control so that the second opening area AS2 of the second control valve 20 is set to the area obtained by subtracting the first target area TS1 from the reference value SFF until the position $P_I$ of the first hydraulic cylinder 49 is changed from the first initial position STA_$P_I$ to the first reference position REF_$P_I$. In particular, in the execution of the feedforward controller $Cf_{v2}$, the controller 15 determines the control amount u3 of the third pilot control valve 60 and the control amount u4 of the fourth pilot control valve 61 so that the second opening area AS2 of the second control valve 20 become the second target area TS2, and outputs the control amount u3 to the solenoid 60*s* of the third pilot control valve 60 and the control amount u4 to the solenoid of the fourth pilot control valve 61.

When the corrected area SB2 becomes equal to or smaller than the maximum value SMA1 of the first opening area AS1 and the feed-forward control is performed, while the position $P_I$ of the first hydraulic cylinder 49 becomes the first reference position REF_$P_I$ from the initial position STA_$P_I$, the controller controls the hydraulic circuit 100 so that the absolute value of the amount of change in the positions $P_I$ of the first hydraulic cylinder 49 per unit time becomes (absolute value of the difference between the first reference position REF_$P_I$ and the first initial position STA_$P_I$/absolute value of the difference between the second target position TAR_$P_A$ and the second initial position STA_$P_A$) times as much as the absolute value of the amount in change in the positions $P_A$ of the second hydraulic cylinder 48 per unit time.

<Feedback Control>

Next, the feedback control will be described. Referring to FIGS. 9, 11 and 12, the controller 15 executing the feedback converter 152 is configured to control obtain the arm height $H_A$ detected by the arm posture detection sensor 56, and calculate the target value (Or (t), $\theta_R$ (t), or $P_I$ (t)) of the first parameter (the implement inclination angle $\theta_I$, the rotation angle $\theta_R$ of the joint 43, or the position $P_I$ of the first hydraulic cylinder 49) corresponding to the arm height $H_A$ is calculated based on the maps M1 to M3 (target). To be more specific, the controller 15 obtains the arm height $H_A$ from the rotation angle $\theta_J$ of the fulcrum shaft 59P or the position $P_A$ of the second hydraulic cylinder 48 detected by the arm posture detection sensor 56. Thereafter, referring to the maps M1 to M3, and θ I (t), θ R (t), or $P_I$ (t) at the same timing t as the arm height $H_A$ is obtained as the target value of the first parameter corresponding to the implement direction 41D.

Then, the controller 15 acquires the detected value ($\theta_I$*, θR*, or $P_I$*) of the first parameter detected by the implement posture detection sensor 57. In the following embodiments, $P_I$* may also be referred to as a detected position $P_I$* of the first hydraulic cylinder 49. The controller 15 that executes the feedback controller $cb_{v1}$ performs feedback control on the first opening area as1 of the first control valve 25 so as to bring the detected value closer to the target value when the absolute value of the difference between the detected value and the first reference value $REF_P_I$ is greater than the absolute value of the difference between the target value and the first reference value by a first threshold value or more.

In FIG. 9, the feedback control range FBR1 is defined as a range in which the absolute value of the difference between the detected value $\theta_I$* and the first reference value $REF_\theta_I+\theta_A$ (TAR_H) at the timing t is greater than the absolute value of the difference between the target value $\theta_I$ (t) and the first reference value $D1_\theta_I+\theta_A$ (TAR_H) by the first threshold value $D_1_\theta_I$ or more. The feedback control range FBR1 is a range less than $\theta_I$ (t)−$D_1_\theta_I$. $D_1_\theta_I$ is preferably invariable regardless of the timing t. In the case where the implement posture detection sensor 57 is constituted by the first inertial measurement unit 57*a* and the second inertial measurement unit 57*b*, when the detected value $\theta_I$* falls within the feedback control range FBR1, the feedback control is performed. To be specific, as shown in FIG. 10, the controller 15 that executes the feedback controller $cb_{v1}$ calculates a feedback control amount (FB control amount) u1* of the first pilot control valve 65 and calculates an FB control amount u2* of the second pilot control valve 66 in accordance with a difference e obtained by subtracting $\theta_I$ (t) from $\theta_I$*. The controller 15 outputs a control amount u1*o* obtained by adding the FB control amount u1* to the FF control amount u1*o* to the solenoid 65*s* of the first pilot control valve 65. The controller 15 outputs a control amount u2*o* obtained by adding the FB control amount u2* to the FF control amount u2*o* to the solenoid 66*s* of the second pilot control valve 66. When the detected value $\theta_I$* does not fall within the feedback control range FBR1, the controller 15 that executes the feedback controller $cb_{v1}$ sets the FB control amounts u1* and u2* to 0.

In FIG. 11, a range in which the absolute value of the difference between the detected value $\theta_R$* and the first reference value $REF_\theta_R$ at the timing t is larger than the target value $\theta_R$ (t) and the first reference value $REF_\theta_R$ by the first threshold value $D_1_\theta_I$ or more is represented as a feedback control range FBR2. The feedback control range FBR2 is a range less than $\theta_R$ (t)−$D_1_\theta_R$. The $D_1$_OR is preferably invariable regardless of the timing t. In the case where the implement posture detection sensor 57 is constituted by the potentiometer 57*r*, the feedback control is performed when the detected value $\theta_R$* falls within the feedback control range FBR2. To be specific, as shown in FIG. 10, the controller 15 that executes the feedback controller $cb_{v1}$ calculates the FB control amount u1* of the first pilot control valve 65 and calculates the FB control amount u2* of the second pilot control valve 66 in accordance with the difference e obtained by subtracting $\theta_I$ (t) from $\theta_R$*. The controller 15 outputs a control amount u1 obtained by adding the FB control amount u1* to the FF control amount u1*o* to the solenoid 65*s* of the first pilot control valve 65. The controller 15 outputs a control amount u2 obtained by adding the FB control amount u2* to the FF control amount u2*o* to the solenoid 66*s* of the second pilot control valve 66. When the detected value $\theta_R$* does not fall within the feedback control range FBR2, the controller 15 that executes the feedback controller $cb_{v1}$ sets the FB control amounts u1* and u2* to 0.

In FIG. 12, a range in which the absolute value of the difference between the detected value $P_I$* and the first reference value $REF_P_I$ at the timing t is larger than the absolute value of the difference between the target value $P_I$ (t) and the first reference value $REF_P_I$ by the first threshold value $D_1_P_I$ or more is represented as a feedback control range FBR3. The feedback control range FBR3 is a range larger than $P_I$ (t)+$D_1_\cdot P_I$. It is preferable that the $D_1_P_I$ is not changed regardless of the timing t. In the case where the implement posture detection sensor 57 is configured by the linear sensor 57*p*, the feedback control is performed when the detected value $P_I$* falls within the feedback control range FBR3. To be specific, as shown in FIG. 10, the controller 15 that executes the feedback controller $cb_{v1}$ calculates the FB control amount u1* of the first pilot control valve 65 and calculates the FB control amount u2* of the second pilot control valve 66 in accordance with the difference e obtained by subtracting $P_I$ (t) from $P_I$*. The controller 15 outputs a control amount u1 obtained by adding the FB control amount u1* to the FF control amount u1*o* to the solenoid 65*s* of the first pilot control valve 65. The controller 15 outputs a control amount u2 obtained by adding the FB control amount u2* to the FF control amount u2*o* to the solenoid 66*s* of the second pilot control valve 66. When the detected value $P_I$* does not fall within the feedback control range FBR3, the controller 15 that executes the feedback controller $cb_{v1}$ sets the FB control amounts u1* and u2* to 0.

As described above, by performing the feedback control in addition to the feedforward control, during the position $P_I$ of the first hydraulic cylinder 49 becomes the first reference position $REF_P_I$ from the first initial position $STA_P_I$, the controller 15 controls the hydraulic circuit 100 so that the absolute value of the amount of change in the positions $P_I$ of the first hydraulic cylinder 49 per unit time becomes (absolute value of the difference between the first reference position $REF_P_I$ and the first initial position $STA_P_I$/absolute value of the difference between the second target position $TAR_P_A$ and the second initial position $STA_P_A$). times as much as the absolute value of the amount of change in the positions $P_A$ of the second hydraulic cylinder 48 per unit time.

After starting the feedback control, when the absolute value of the difference between the detected value and the first reference value becomes smaller than the value obtained by adding the second threshold value which is smaller than the first threshold value to the absolute value of the difference between the target value and the first reference value, the controller 15 performs feedforward control such that the first opening area AS1 of the first control valve 25 is set to a value obtained by multiplying the first target area TS1 by a second correction coefficient K2, the second correction coefficient K2 being obtained by dividing the control amount (larger one of u1*o* and u2*o*) of the first control valve 25 in case where the feedback control is performed immediately before falling below the second threshold value by the control amount (the larger one of and AS1) of the first control valve 25 in case where the feedforward control is performed such the first opening area AS is set to the first target area TS1.

In FIG. 9, a range in which the absolute value of the difference between the detected value $\theta_I$* and the first reference value $REF_\theta_I+\theta_A$ (TAR_H) is smaller than the value obtained by adding the second threshold value $D_2_\theta_I$ to the absolute value of the difference between the target value $\theta_I$ (t) and the first reference value $REF_\theta_I+\theta_A$ (TAR_H) after the elapse of Δ t from the timing t is represented as the feedback end range FER1.

The feedback end range FER1 is a range of $\theta_I$ (t)−$D_2_\theta_I$ or more. $D_2_\theta_I$ is smaller than the $D_1_\theta_I$. In the case where the implement posture detection sensor 57 is constituted by the first inertial measurement unit 57*a* and the second inertial measurement unit 57*b*, when the detected value $\theta_I$* falls within the feedback end range FER1, the controller 15 acquires the control amounts u1 and u2 immediately before the feedback control is ended. The controller 15 uses a umax which is larger among the control amounts u1 and u2 for calculating the second correction coefficient K2. Further, the controller 15 acquires the control amounts u1*o* and u2*o* of the first control valve 25 in the case where the feedforward control is performed so that the first opening area AS1 become the first target area TS1. The controller 15 uses umaxo which is larger among the u1*o* and u2*o* for calculating the second correction coefficient K2. Note that, from the nature of the present control, when umax is u1, umaxo is u1*o*, and when umax is u2, umaxo is u2*o*.

In FIG. 11, a range in which the absolute value of the difference between the detected value $\theta_R$* and the first reference value REF_$\theta_R$ is smaller than the value obtained by adding the second threshold value D2_$\theta_I$ to the absolute value of the difference between the target value $\theta_R$ (t) and the first reference value REF_$\theta_R$ after the elapse of Δ t from the timing t is represented as the feedback end range FER2. The feedback end range FER2 is a range of $\theta_R$ (t)−$D_2$_$\theta_R$ or more. $D_2$_$\theta_R$ is smaller than the $D_1$_$\theta_R$. In the case where the implement posture detection sensor 57 is constituted by the potentiometer 57*r*, when the detected value $\theta_R$* falls within the feedback end range FER2, the controller 15 acquires the control amounts u1 and u2 immediately before the feedback control is ended. The controller 15 uses umax which is larger among the control amounts u1 and u2 for calculating the second correction coefficient K2. Further, the controller 15 acquires the control amounts u1*o* and u2*o* of the first control valve 25 in the case where the feedforward control is performed so that the first opening area AS1 become the first target area TS1. The controller 15 uses the larger one among the umaxo and u2*o* for calculating the second correction coefficient K2. The controller 15 sets umax/umaxo as the second correction coefficient K2. Note that, from the nature of the present control, when umax is u1, umaxo is u1*o*, and when umax is u2, umaxo is u2*o*.

In FIG. 12, a range in which the absolute value of the difference between the detected value $P_I$* and the first reference value REF_$P_I$ becomes smaller than the value obtaining by adding the second threshold value $D_2$_$P_I$ to the absolute value of the difference between the target value $P_I$ (t) and the first reference value REF_$P_I$ after the elapse of A t from the timing t is represented as a feedback end range FER3. The feedback end range FER3 is a range equal to or less than $P_I$ (t)+D2_$P_I$. $D_2$_$P_I$ is smaller than $D_1$_$P_I$. In the case where the implement posture detection sensor 57 is configured by the linear sensor 57*p*, when the detected value $P_I$* falls within the feedback end range FER3, the controller 15 acquires the control amounts u1 and u2 immediately before the feedback control is ended. The controller 15 uses a umax which is larger among the control amounts u1 and u2 for calculating the second correction coefficient K2. Further, the controller 15 acquires the control amounts u1*o* and u2*o* of the first control valve 25 in the case where the feedforward control is performed so that the first opening area As1 become the first target area TS1. The controller 15 uses umaxo which is the larger among u1*o* and u2*o* for calculating the second correction coefficient K2. The controller 15 sets umax/umaxo as the second correction coefficient K2. Note that, from the nature of the present control, when umax is u1, umaxo is u1*o*, and when umax is u2, umaxo is u2*o*.

<Cushion Control>

In the above-described control method, the first hydraulic cylinder 49 is controlled so that the implement direction 41D becomes the reference direction REF_D as quickly as possible. Therefore, if the movement of the implement 41 is suddenly stopped when the implement direction 41D becomes the reference direction REF_D, the implement 41 vibrates greatly. Similarly, in the above-described control method, the second hydraulic cylinder 48 is controlled so that the arm height $H_A$ becomes the reference height REF_H as quickly as possible. Therefore, if the movement of the arm 45 is suddenly stopped when the arm height $H_A$ becomes the reference height REF_H, the arm 45 vibrates greatly. Such large vibrations apply a large load to hydraulic devices such as the first hydraulic cylinder 49 and the second hydraulic cylinder 48, and are therefore not preferable from the viewpoint of durability. Therefore, the amount of positional change (shift) per unit time of the first hydraulic cylinder 49 is reduced when the implement direction 41D approaches the reference direction REF_D, and the amount of positional change (shift) per unit time of the second hydraulic cylinder 48 is reduced when the arm height $H_A$ approaches the reference height REF_H. Thus, even when the movement of the implement 41 is stopped when the implement direction 41D becomes the reference direction REF_D, the vibration of the implement 41 is suppressed, and even when the movement of the arm 45 is stopped when the arm height $H_A$ becomes the reference height REF_H, the vibration of the arm 45 is suppressed. Such control is called cushion control.

Figure 14:
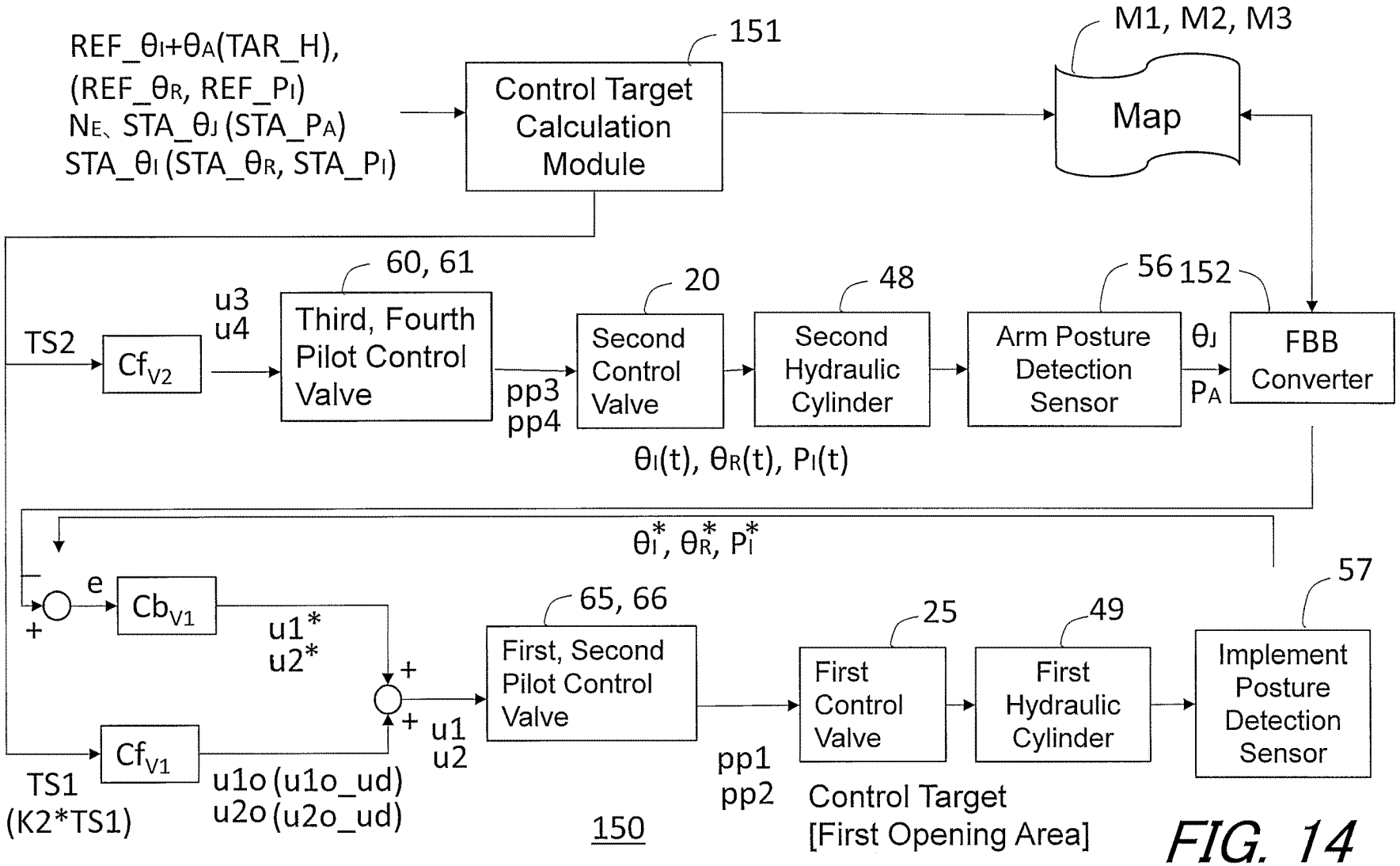
FIG. 14 is a control block diagram according to the embodiment.

FIG. 14 is a diagram showing the concept of the cushion control of the first hydraulic cylinder 49. The upper part of FIG. 14 shows the amount of change (displacement) per unit time of the position Pr of the first hydraulic cylinder 49, and the lower part of FIG. 14 shows the change over time of the position Pr of the first hydraulic cylinder 49. In order to realize the cushion control, the memory 15M stores the first approach speed $V_{APP1}$, which is the amount of change in the position $P_I$ of the first hydraulic cylinder 49 per unit time immediately before the position of the first hydraulic cylinder 49 becomes the first reference position REF_$P_I$, and the first deceleration $D_{V1}$ for decelerating from the displacing speed VEST1 of the first hydraulic cylinder 49 to the first approach speed VAPP1.

The controller 15 obtains the detected position $P_I$* of the first hydraulic cylinder 49 detected by the implement posture detection sensor 57. When the implement posture detection sensor 57 includes the first inertial measurement unit 57*a* and the second inertial measurement unit 57*b*, the estimated value $H_A$* of the arm height $H_A$ is obtained from the rotation angle $\theta_J$* detected by the arm posture detection sensor 56 (potentiometers 56*r*) or the estimated value $H_A$* of the arm height $H_A$ is obtained from the detected position $P_A$* detected by the arm posture detection sensor 56 (linear sensors 56*p*). The controller 15 obtains the detected position $P_I$* from the detected value $\theta_I$* detected by the implement posture detection sensor 57 and the adjustment angle $\theta_A$ ($H_A$*) based on the first correspondence relationship. When the implement posture detection sensor 57 is the potentiometer 57*r*, the detected position $P_I$* is obtained from the detected value $\theta_R$* based on the sixth correspondence relationship. The controller 15 obtains the displacing speed $V_{EST1}$ of the first hydraulic cylinder 49, which is the amount of change in the detected position $P_I$* of the first hydraulic cylinder 49 per unit time, from a temporal change in the detected positions $P_I$*. The controller 15 may obtain the displacing speed $V_{EST1}$ of the first hydraulic cylinder 49 based on only the detected value $\theta_I$* on the assumption that the adjustment angle $\theta_A$ ($H_A$*) hardly changes regardless of the estimated value $H_A$* of the arm height $H_A$.

The controller 15 calculates a first deceleration time $T_{RED1}$ of the first hydraulic cylinder 49 by dividing the difference between the displacement speed $V_{EST1}$ of the first hydraulic cylinder 49 and the first approach speed $V_{APP1}$ by the first deceleration speed $DV_1$.

The controller 15 calculates the deceleration start position SR_$P_I$ of the first hydraulic cylinder which starts deceleration from the displacement speed $V_{EST1}$ of the first hydraulic cylinder based on the displacement speed $V_{EST1}$ of the first hydraulic cylinder 49 and the first deceleration time $T_{RED1}$. In detail, the controller 15 sets a value obtained by adding a value obtained by multiplying the displacement speed $V_{EST1}$ of the first hydraulic cylinder by the first deceleration time $T_{RED1}$ to the first reference position REF_$P_1$ as the deceleration start position SR_$P_1$.

When the implement posture detection sensor 57 is the potentiometer 57*r*, the controller 15 determines that the detected position $P_I$* of the first hydraulic cylinder 49 has reached the deceleration start position SR-PI when the rotation angle $\theta_R$ corresponding to the deceleration start position SR-$P_I$ has been reached, with reference to the sixth correspondence relationship. When the implement posture detection sensor 57 includes the first inertial measurement unit 57*a* and the second inertial measurement unit 57*b*, the controller 15 obtains the implement inclination angle $\theta_I$+adjustment angle $\theta_A$ ($H_A$) corresponding to the deceleration start position SR-$P_I$ by referring to the first correspondence relationship and also using the detection result of the arm posture detection sensor 56 and determines that the detected position $P_I$* of the first hydraulic cylinder 49 has reached the deceleration start position SR-$P_I$ when the implement inclination angle $\theta_I$+the adjustment angle $\theta_A$ ($H_A$) has been reached The controller 15 is configured to control the first opening area AS1 of the first hydraulic cylinder such that the displacing speed $V_{EST1}$ of the first hydraulic cylinder 49 is reduced based on the first deceleration $V_{EST1}$ until the displacement speed $V_{EST1}$ of the first hydraulic cylinder 49 becomes the first approach speed $V_{APP1}$ after the detected position $P_1$*| has reached to the deceleration start point SR_$P_1$ (timing $T_{SR1}$). In concrete terms, the controller 15 linearly decreases the control amounts u1*o*, u2*o* of the feedforward controller $Cf_{v1}$ so that the first opening area AS1 becomes $V_{APP1}/V_{EST1}$ times as much as the first target area TS1 (or K1×TS1) at the time of feedforward control after the first deceleration time $T_{RED1}$ from the timing $T_{SR1}$. Note that feedback control is not performed during cushion control.

As a result, the position $P_I$ of the first hydraulic cylinder 49 reaches the first reference position REF_$P_I$ at a timing TRINI slightly delayed from the timing $T_{TAR}$ at which the arm height $H_A$ set in the maps M1 to M3 becomes the target height TAR_H. When the implement posture detection sensor 57 is a potentiometer 57*r* or a linear sensor 57*p*, the position Prof the first hydraulic cylinder 49 can be controlled to the first reference position REF_$P_I$ even if there is a time delay. However, when the implement posture detection sensor 57 includes the first inertial measurement unit 57*a* and the second inertial measurement unit 57*b*, there is a problem in that the arm height $H_A$ at the timing $T_{FIN1}$ becomes a height (TAR_H−Δ H) slightly lower than the target height TAR_H. The implement inclination angle $\theta_I$ obtained from the first inertial measurement unit 57*a* and the second inertial measurement unit 57*b* is ideally REF_$\theta_I$+$\theta_A$ (TAR_H-A H), however, since it is difficult to calculate ΔH, the first reference value REF_$\theta_I$+$\theta_A$ (TAR_H) is obtained. Therefore, the control is performed with the state where the implement tip 41T is directed upward by the deviation $\theta_A$ (TAR_H)−$\theta_A$ (TAR_H−ΔH) of the adjustment angle as a target. Therefore, when the arm height $H_A$ becomes the reference height REF_H, the position $P_I$ of the first hydraulic cylinder 49 is individually controlled and corrected.

Figure 15:
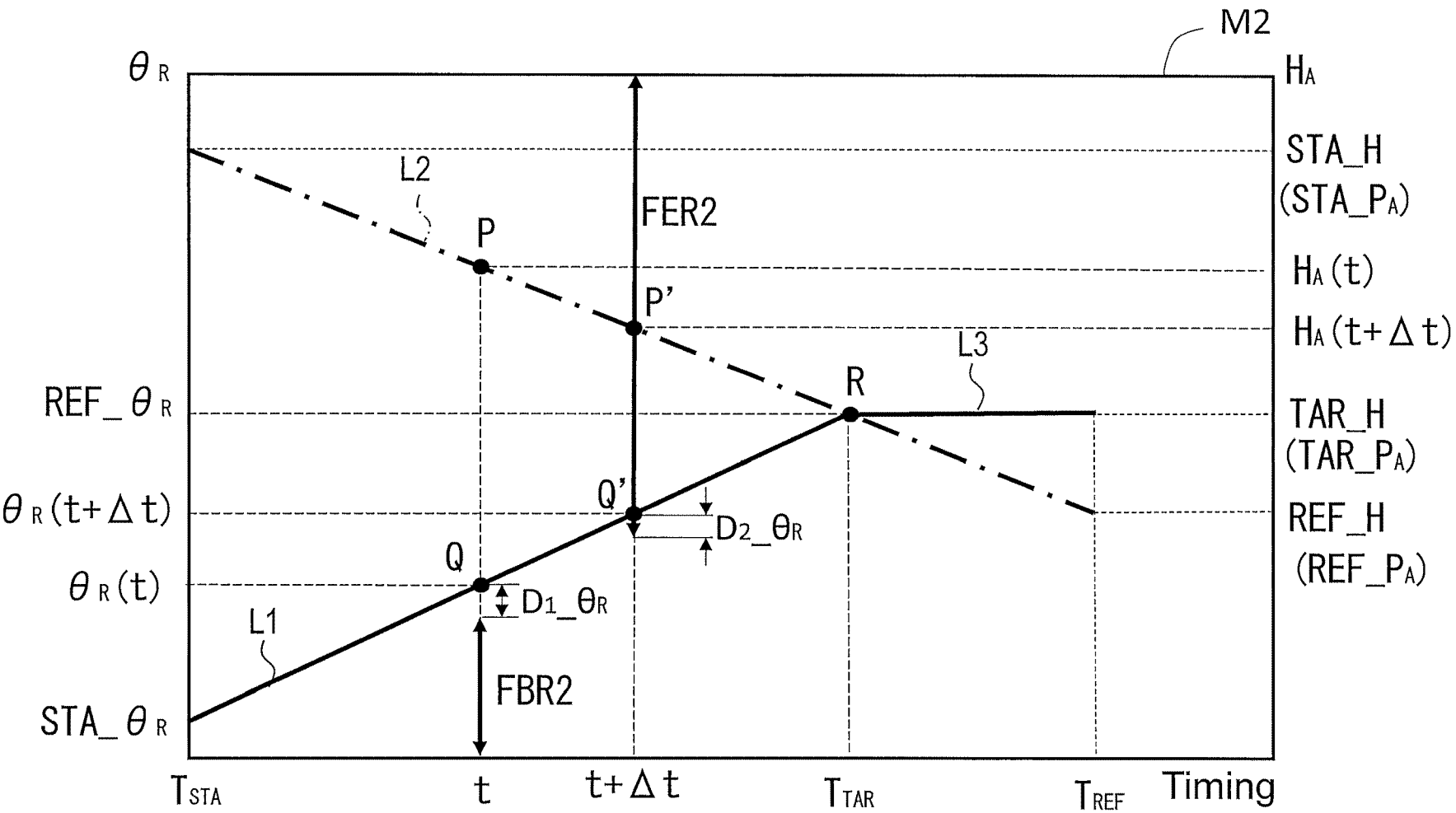
FIG. 15 is a diagram showing the relationship between a change in arm height and a change in joint rotation angle in automatic implement return control.

FIG. 15 is a diagram showing the concept of the cushion control of the second hydraulic cylinder 48. The upper stage of FIG. 15 shows the amount of change (displacement) per unit time of the position $P_A$ of the second hydraulic cylinder 48, and the lower stage of FIG. 15 shows the change over time of the position $P_A$ of the second hydraulic cylinder 48. In order to realize the cushion control, the memory 15M stores a second approach speed $V_{APP2}$ which is the amount of change in the positions $P_A$ of the second hydraulic cylinder 48 per unit time immediately before the position $P_A$ of the second hydraulic cylinder 48 reaches the second reference position REF_$P_A$, and a second deceleration $D_{V2}$ for decelerating the second hydraulic cylinder 48 from the displacement speed $V_{EST2}$ to the second approach speed $V_{APP2}$.

The controller 15 obtains the detected position $P_A$* of the second hydraulic cylinder 48 detected by the arm posture detection sensor 56. When the arm posture detection sensor 56 is the potentiometer 56*r*, the detected position $P_A$* is obtained from the rotation angle $\theta_J$* detected by the potentiometer 56*r* with reference to the second correspondence relationship. When the arm posture detection sensor 56 is the linear sensor 56*p*, the detected value detected from the linear sensor 56*p* is set as the detected position $P_A$*. The controller 15 obtains the displacement speed $V_{EST2}$ of the second hydraulic cylinder 48, which is the amount of change in the detected position $P_A$* of the second hydraulic cylinder 48 per unit time, from a temporal change in the detected positions $P_A$*.

The controller 15 calculates the second deceleration time $T_{RED2}$ by dividing the difference between the displacement speed $V_{EST2}$ of the second hydraulic cylinder 48 and the second approach speed $V_{APP2}$ by the second deceleration $D_{V2}$. The controller 15 calculates the deceleration start position SR_$P_A$ of the second hydraulic cylinder 48 at which the second hydraulic cylinder 48 start to decelerate from the displacement speed $V_{EST2}$, based on the displacement speed $V_{EST2}$ of the second hydraulic cylinder 48, the second deceleration time $T_{RED2}$, and the second reference position REF_$P_A$. To be more specific, the controller 15 sets a value obtained by adding a value obtained by multiplying the displacement speed $V_{EST2}$ of the second hydraulic cylinder 48 by the second deceleration time $T_{RED2}$ to the second reference position REF_$P_A$ as the deceleration start position SR_$P_A$.

When the arm posture detection sensor 56 is the potentiometer 56*r*, with reference to the second correspondence relationship, the controller 15 determines that the detected position $P_A$* of the second hydraulic cylinder 48 has reached the deceleration start position SR_$P_A$ when the rotation angle $\theta_J$ corresponding to the deceleration start position SR_$P_A$ is reached. When the arm posture detection sensor 56 is the linear sensor 56*p*, the controller 15 determines whether or not the detected position $P_A$* detected by the linear sensor 56*p* has reached the deceleration start position SR_$P_A$.

The controller 15 controls the second opening area AS2 of the second control valve 20 so as to decelerate the displacement speed $V_{EST2}$ of the second hydraulic cylinder 48 based on the second deceleration $D_{V2}$ until the displacement speed $V_{EST2}$ of the second hydraulic cylinder 48 become the second approach speed $V_{APP2}$ after the detected position $P_A$* of the second hydraulic cylinder 48 reach the deceleration start position SR-$P_A$ (timing $D_{V2}$). In concrete terms, the controller 15 linearly decreases the control amounts u3 and u4 of the feedforward controller $Cf_{v2}$ so that the second opening area AS2 becomes $V_{APP2}/V_{EST2}$ times as much as the second target area $Cf_{v2}$ at the time of feedforward control after the second deceleration time $T_{RED2}$ from the timing $T_{SR2}$. As a result, the position $P_A$ of the second hydraulic cylinder 48 reaches the second reference position REF_$P_A$ at a timing TFIN2 slightly delayed from the timing $T_{REF}$ at which the arm height $H_A$ set in the maps M1 to M3 becomes the target height TAR_H.

<Method of Controlling Work Vehicle>

Figure 16:
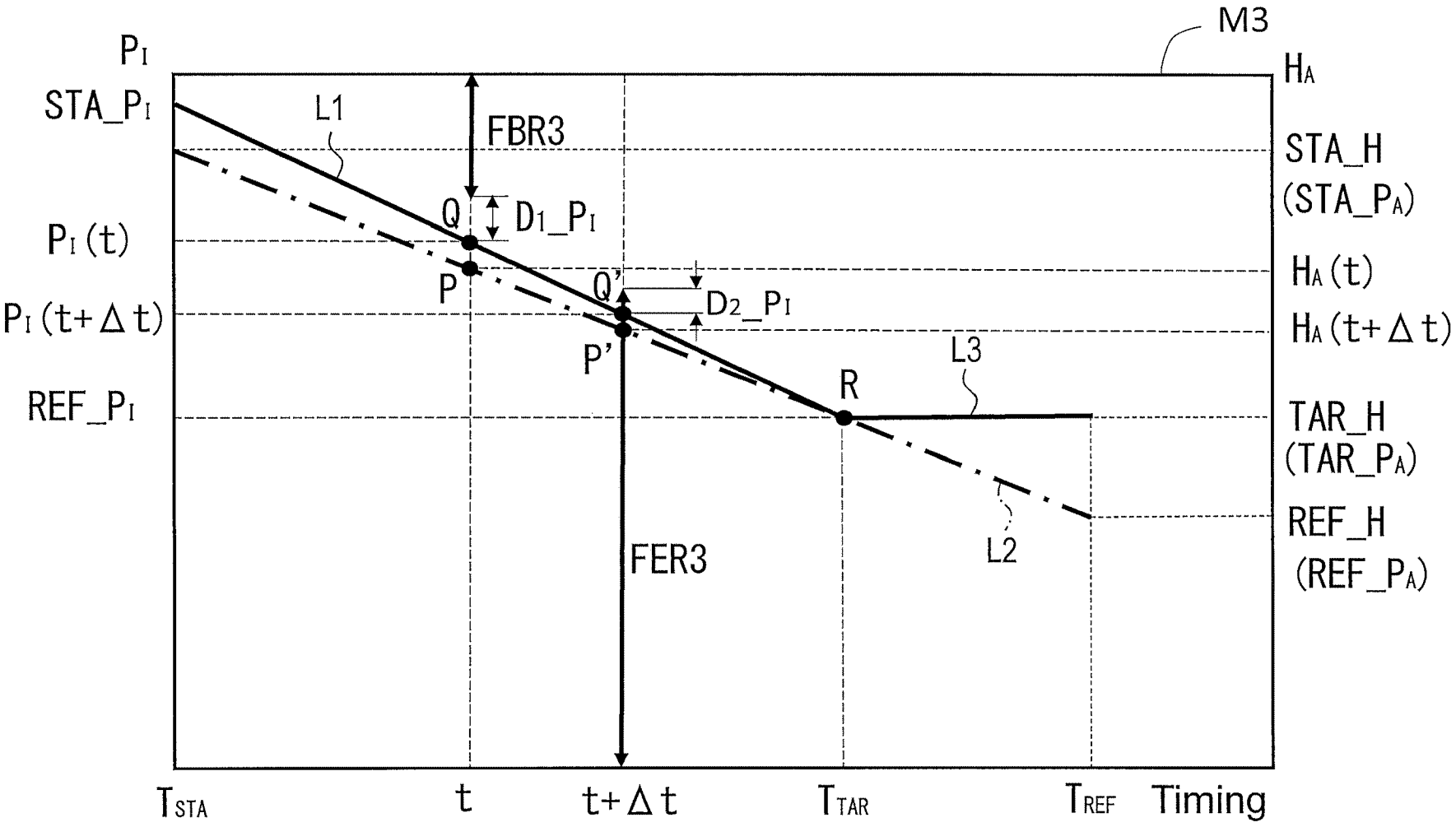
FIG. 16 is a diagram showing the relationship between the change in the arm height and the change in the position of the first hydraulic cylinder in the automatic implement return control.

Next, a method of controlling the work vehicle 1 according to the present embodiment will be described. FIG. 16 is a flowchart showing a method of controlling the work vehicle 1. In step S1, the controller 15 acquires a reference direction REF_D serving as a reference of an implement direction 41D from the joint 43 which rotatably connects the implement 41 with respect to the arm distal end 45D of the work vehicle 1, toward the implement direction 41D. To be specific, the hardware processor 15P of the controller 15 acquires the first reference value (REF_$\theta_R$ or REF_$P_I$) of the first parameter corresponding to the reference direction REF_D stored in the memory 15M of the controller 15.

In step S2, the controller 15 acquires a reference height REF_H that serves as a reference for an arm height $H_A$, which is the height of the arm distal end 45D with respect to the ground contact surface GL of the traveling device 3 in the height direction $D_H$ perpendicular to the travel direction of the traveling device 3. In particular, the hardware processor 15P of the controller 15 obtains the second reference value (REF_$\theta_J$, REF_$P_A$) of the first parameter corresponding to the reference direction REF_D stored in the memory 15M of the controller 15.

In step S3, the controller 15 determines a target height TAR_H which is the arm height $H_A$ of the arm distal end 45D when the implement tip 41T is oriented in the reference direction REF_D and which is larger than the reference height REF_H. In response to this, the first reference value (REF_$\theta_I$+$\theta_A$ (TAR_H)) of the first parameter corresponding to the reference direction REF_D stored in the memory 15M of the controller 15 is acquired.

In step S4, the controller 15 determines whether or not an instruction to perform automatic control for changing the implement direction 41D and the arm height $H_A$ to the reference direction REF_D and the reference height REF_H, respectively, is received. Specifically, the controller 15 determines whether or not an instruction has been received by the input device 17. If the instruction has not been received (NO in step S4), step S4 is repeated. When the instruction is received (YES in step S4), the controller 15 controls the second hydraulic cylinder 48 so that the arm height $H_A$ becomes the reference height REF_H in step S5. Specifically, the controller 15 performs the above-described feedforward control and cushion control on the second hydraulic cylinder 48.

As parallel processing of step S5, in step S6, the controller 15 controls the first hydraulic cylinder 49 so that the implement direction 41D becomes the reference direction REF_D when the arm height $H_A$ changes to the target height TAR_H. Specifically, the controller 15 performs the above-described feed-forward control, feedback control, and cushion control on the second hydraulic cylinder 48. After the completion of step S6, the process proceeds to step S5. In step S7, the controller 15 determines whether or not the arm height $H_A$ has reached the reference height REF_H. In step S7, since the controller 15 has been controlled in step S6 to set the implement tip 41T to face upward as a target, the controller 15 controls the first hydraulic cylinder 49 to finely adjust the implement direction 41D to the reference direction REF_D. To be more specific, for example, when the implement posture detection sensor 57 is composed of the first inertial measurement unit 57*a* and the second inertial measurement unit 57*b*, the first hydraulic cylinder 49 is controlled to perform fine adjustment so that the implement inclination angle $\theta_I$ becomes REF_$\theta_I$+$\theta_A$ (REF_H) [REF_$\theta_I$ when $\theta_A$ (REF_H)=0].

<Effects of Embodiment>

The controller 15 of the work vehicle 1 according to the present embodiment controls the first hydraulic cylinder 49 so that the implement direction 41D becomes the reference direction REF_D when the arm height $H_A$ changes to the target height TAR_H that is greater than the reference height REF_H. This makes it possible to reliably prevent the implement tip 41T from hitting the ground when the arm height $H_A$ becomes the reference height REF_H.

<Modification>

Figure 17:
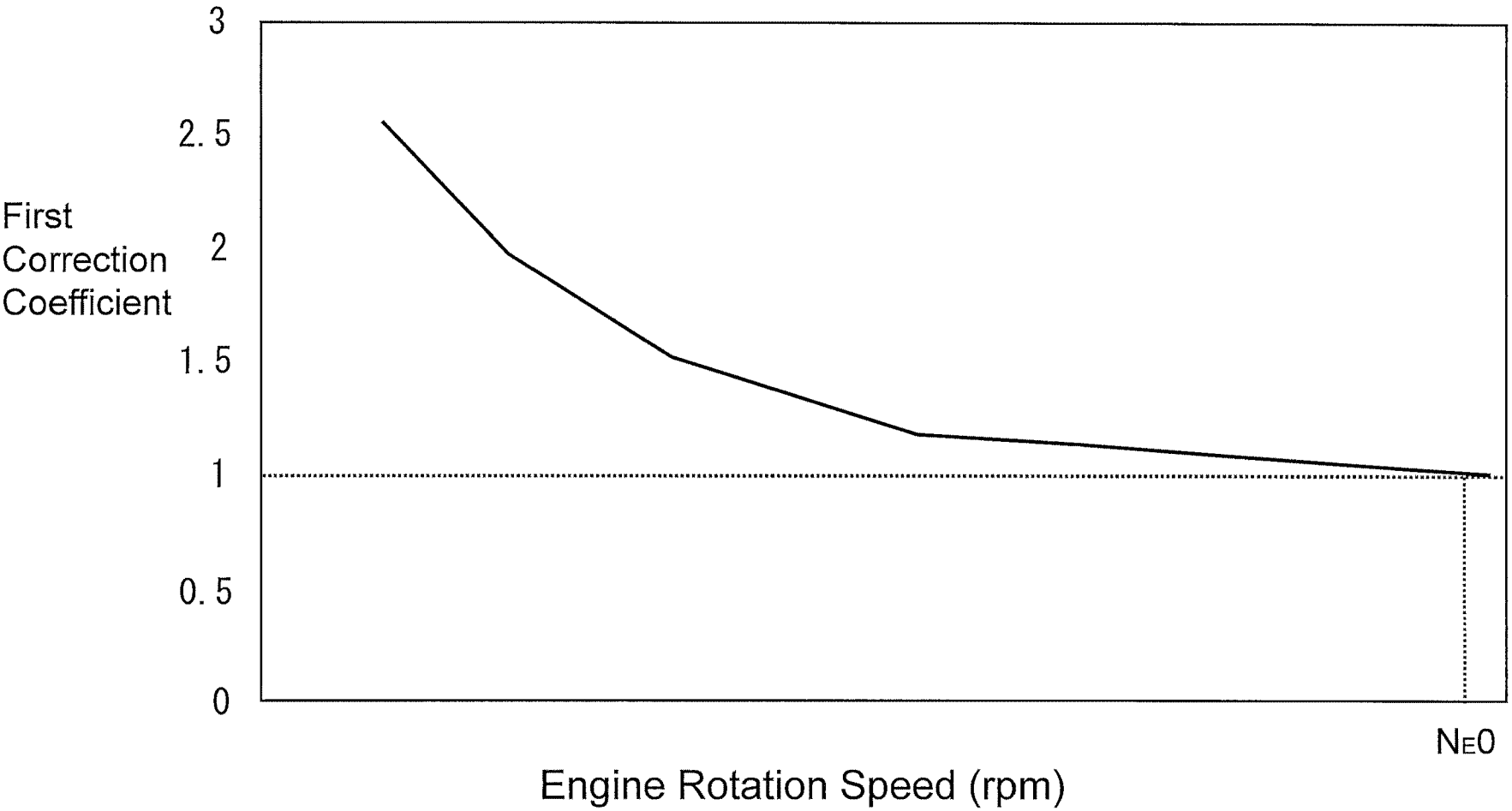
FIG. 17 is a diagram showing the relationship between the rotational speed of the engine and the first correction coefficient.
Figure 18:
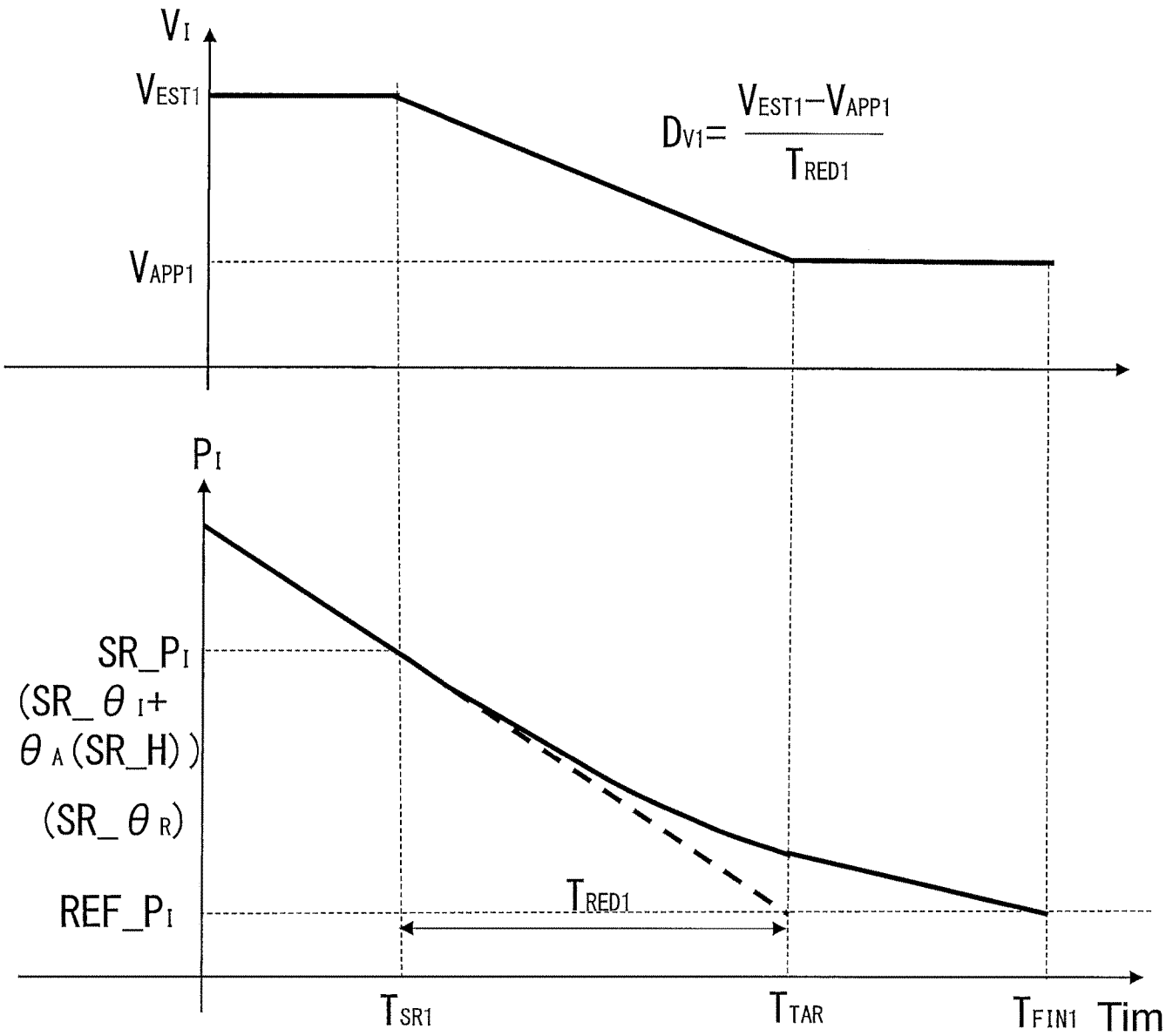
FIG. 18 is a view showing the concept of cushion control of the first hydraulic cylinder.
Figure 19:
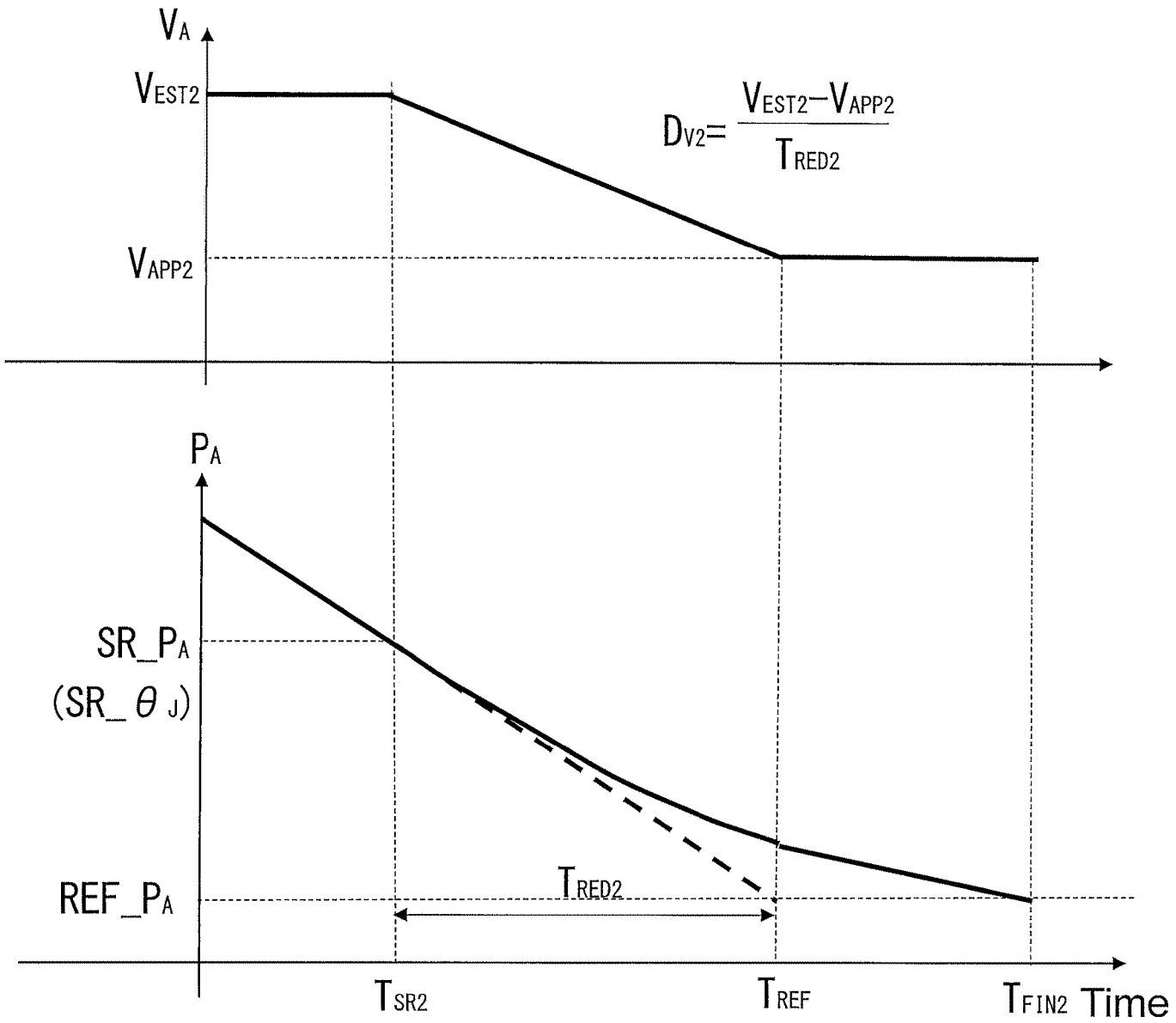
FIG. 19 is a view showing the concept of cushion control of the second hydraulic cylinder.
Figure 20:
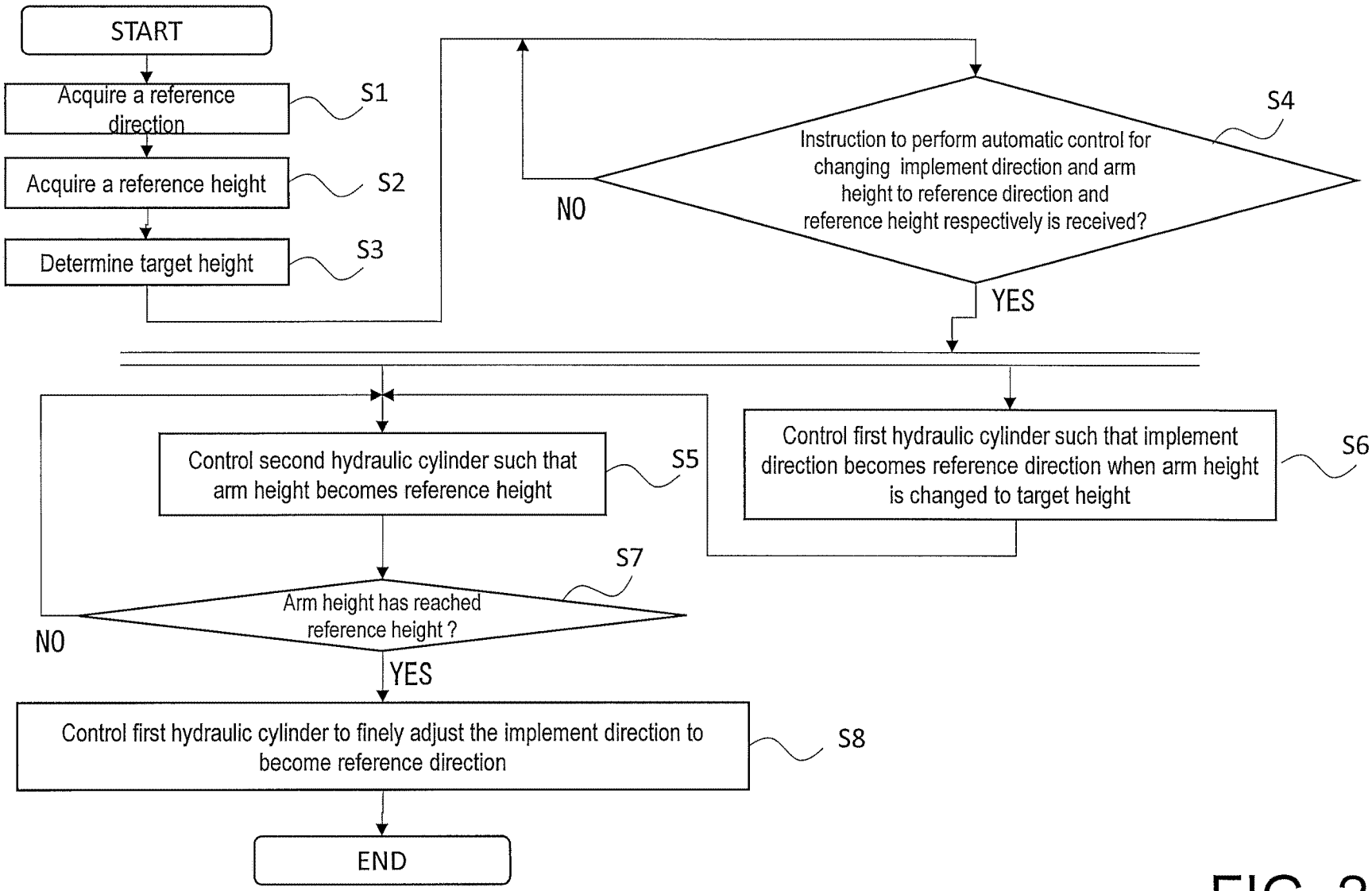
FIG. 20 is a flowchart showing a method of controlling the work vehicle.
Figure 21:
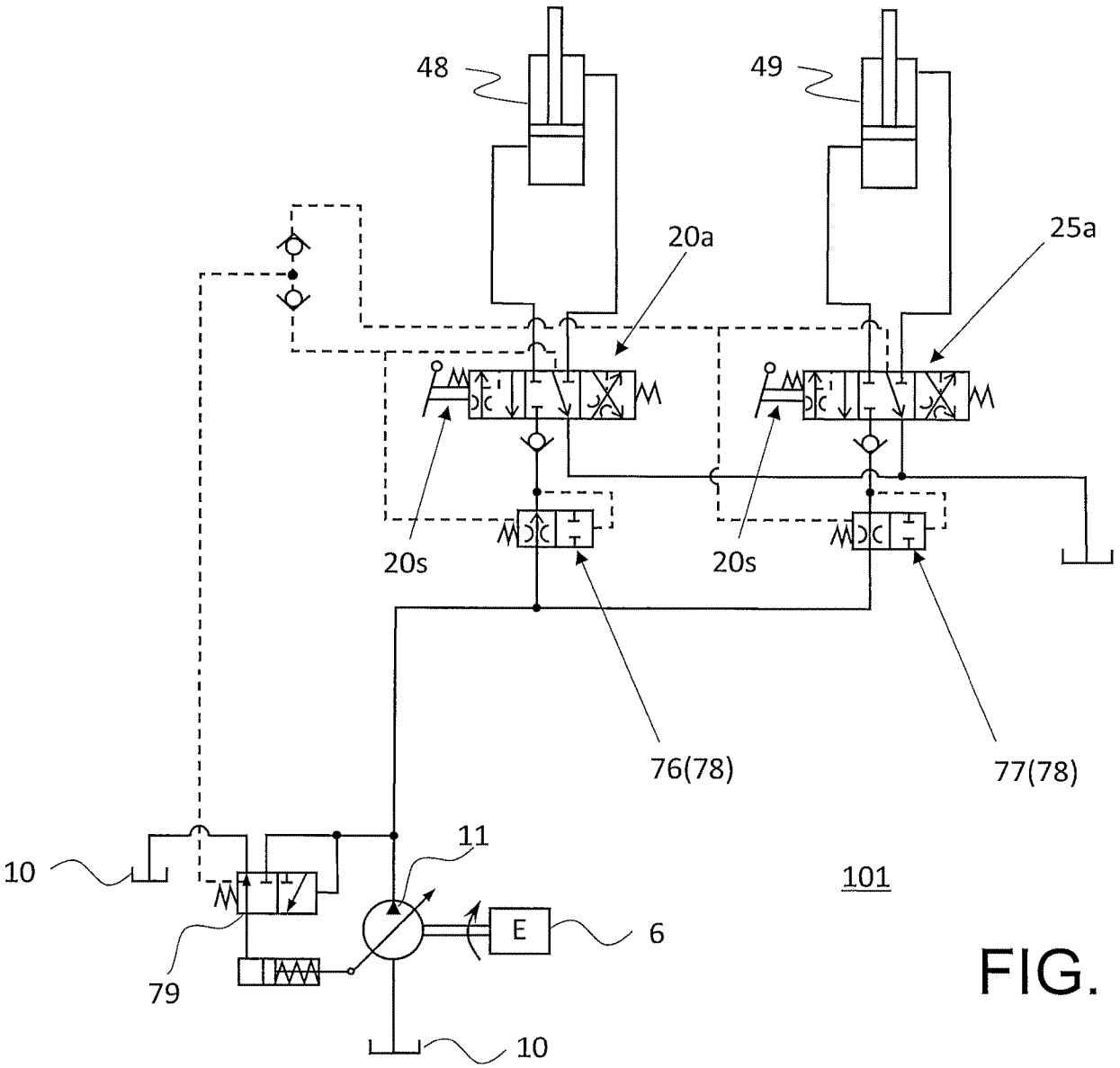
FIG. 21 shows a modification of the hydraulic circuit.

In the above-described embodiment, the hydraulic circuit 100 is a circuit capable of mechanically realizing the horizontal control, but may be a simpler hydraulic circuit. FIG. 17 shows a modified example 101 of the hydraulic circuit. In FIG. 17, the same components as those in FIG. 3 are denoted by the same reference numerals, and detailed description thereof will be omitted. The hydraulic circuit 101 includes a first control valve 25*a* instead of the first control valve 25 of the hydraulic circuit 100, and a second control valve 20*a* instead of the second control valve 20. The first control valve 25*a* includes a solenoid 25*s*, and the position of a spool is changed by sending a control signal to the solenoid 25*s*. The second control valve 20*a* includes a solenoid 20*s*, and the position of a spool is changed by sending a control signal to the solenoid 20*s*. In this modification, instead of the signals sent to the solenoids 60*s* and 61*s* in the above embodiment, a control signal may be sent to the solenoid 25*s* so that the first opening area AS1 becomes the first target area TS1, and a control signal may be sent to the solenoid 20*s* so that the second opening area AS2 becomes the second target area TS2.

In this application, the word "comprise" and its derivatives are used as open-ended terms to describe the presence of elements but not to exclude the presence of other elements not listed. This applies to "having", "including" and derivatives thereof.

The terms "member," "part," "element," "body," and "structure" may have a plurality of meanings, such as a single portion or a plurality of portions.

The ordinal numbers such as "first" and "second" are merely terms for identifying the configuration, and do not have other meanings (for example, a specific order).

For example, the presence of a "first element" does not imply the presence of a "second element," and the presence of a "second element" does not imply the presence of a "first element."

Terms of degree such as "substantially", "about", and "approximately" can mean a reasonable amount of deviation such that the end result is not significantly changed, unless the embodiment is specifically described otherwise. All numerical values recited herein may be construed to include terms such as "substantially," "about," and "approximately."

The phrase "at least one of A and B" as used herein should be interpreted to include A alone, B alone, and both A and B.

Obviously, numerous modifications and variations of the present embodiment are possible in light of the above teachings.

Thus, it is to be understood that the embodiment may be practiced otherwise than as specifically described herein without departing from the scope of the disclosure.

What is claimed is:

1. A work vehicle comprising:

a joint;

an implement connected to the joint and including an implement tip opposite to the joint;

an arm assembly including an arm distal end and arm proximal end opposite to the arm distal end, the arm distal end being connected to the joint to swingably support the implement;

a vehicle body configured to swingably support the arm proximal end;

a traveling device configured to move the vehicle body;

a first hydraulic cylinder configured to control an implement direction from the joint to the implement tip;

a second hydraulic cylinder configured to control an arm height which is a height of the arm distal end with respect to a ground contact surface of the traveling device in a height direction perpendicular to the traveling direction of the traveling device;

a hydraulic circuit configured to control the first hydraulic cylinder and the second hydraulic cylinder;

an implement posture detection sensor configured to detect the implement direction;

an arm posture detection sensor configured to detect the arm height;

a memory configured to store first information corresponding to a reference direction which is a standard of the implement direction, and second information corresponding to a reference height which is a standard of the arm height;

control circuitry configured to control the hydraulic circuit;

an input device configured to receive an instruction to perform automatic control for changing the implement direction to the reference direction and decreasing the arm height to the reference height; and the control circuitry configured to control the hydraulic circuit so that the arm height and the implement direction respectively approach the reference height and the reference direction in response to the instruction received by the input device, control the hydraulic circuit so that during the automatic control, the implement direction is changed to the reference direction when the arm height reaches a target height which is greater than the reference height, and control the hydraulic circuit so that the position of the first hydraulic cylinder is unchanged until the arm height reaches the reference height while the arm height is below the target height.

2. The work vehicle according to claim 1, wherein the first information includes a first reference value of a first parameter, the first parameter representing the implement direction, the first reference value corresponding to the reference direction, wherein the second information includes a second reference value of a second parameter, the second parameter representing which indicates the arm height, the second reference value corresponding to the reference height, and wherein the control circuitry is configured to control the hydraulic circuit such that the first parameter and the second parameter respectively approach the first reference value and the second reference value in response to the instruction received by the input device, and control the hydraulic circuit such that the first parameter is changed to the first reference value when the arm height reaches the target height.

3. A work vehicle comprising:

a joint;

an implement connected to the joint and including an implement tip opposite to the joint;

an arm assembly including an arm distal end and arm proximal end opposite to the arm distal end, the arm distal end being connected to the joint to swingably support the implement;

a vehicle body configured to swingably support the arm proximal end;

a traveling device configured to move the vehicle body;

a first hydraulic cylinder configured to control an implement direction from the joint to the implement tip;

a second hydraulic cylinder configured to control an arm height which is a height of the arm distal end with respect to a ground contact surface of the traveling device in a height direction perpendicular to the traveling direction of the traveling device;

a hydraulic circuit configured to control the first hydraulic cylinder and the second hydraulic cylinder;

an implement posture detection sensor configured to detect the implement direction;

an arm posture detection sensor configured to detect the arm height;

a memory configured to store first information corresponding to a reference direction which is a standard of the implement direction, and second information corresponding to a reference height which is a standard of the arm height;

control circuitry configured to control the hydraulic circuit;

an input device configured to receive an instruction to perform automatic control for changing the implement direction and the arm height respectively to the reference direction and the reference height; and the control circuitry configured to control the hydraulic circuit so that the arm height and the implement direction respectively approach the reference height and the reference direction in response to the instruction received by the input device, and control the hydraulic circuit so that during the automatic control, the implement direction is changed to the reference direction when the arm height reaches a target height which is greater than the reference height, wherein the first information includes a first reference value of a first parameter, the first parameter representing the implement direction, the first reference value corresponding to the reference direction, wherein the second information includes a second reference value of a second parameter, the second parameter representing which indicates the arm height, the second reference value corresponding to the reference height, and wherein the control circuitry is configured to control the hydraulic circuit such that the first parameter and the second parameter respectively approach the first reference value and the second reference value in response to the instruction received by the input device, and control the hydraulic circuit such that the first parameter is changed to the first reference value when the arm height reaches the target height, wherein the first parameter includes a position of the first hydraulic cylinder, wherein the second parameter includes a position of the second hydraulic cylinder, wherein the control circuitry is configured to perform processes in response to the instruction received by the input device, the processes comprising:

obtaining a first reference position, a second reference position, a second target position, a first initial position, and a second initial position, the first reference position being a position of the first hydraulic cylinder which corresponds to the reference direction, the second reference position being a position of the second hydraulic cylinder which corresponds to the reference height, the second target position being a position of the second hydraulic cylinder which corresponds to the target height, the first initial position being a position of the first hydraulic cylinder upon reception of the instruction, the second initial position being a position of the second hydraulic cylinder upon reception of the instruction; and controlling the hydraulic circuit, while a position of the first hydraulic cylinder is changed from the first initial position to the first reference position, such that the hydraulic circuit performs a target operation in which an absolute value of an amount of change in positions of the first hydraulic cylinder per unit time is set to an absolute value of an amount of change in the second hydraulic cylinder per unit time multiplied by a quotient, the quotient being an absolute value of a difference between the first reference position and the first initial position divided by an absolute value of a difference between the second target position and the second initial position.

4. The work vehicle according to claim 3, wherein, when the first parameter becomes the first reference value, the control circuitry is configured to control the hydraulic circuit so that the position of the first hydraulic cylinder is unchanged until the position of the second hydraulic cylinder is changed to the second reference position.

5. The work vehicle according to claim 3, wherein the hydraulic circuit comprises a hydraulic pump configured to supply hydraulic fluid to the first hydraulic cylinder and the second hydraulic cylinder;

a first cylinder hydraulic circuit connecting the first hydraulic cylinder with the hydraulic pump;

a second cylinder hydraulic circuit connecting the second hydraulic cylinder with the hydraulic pump;

an engine configured to drive the hydraulic pump;

a rotation speed detection sensor configured to detect a rotational speed of the engine;

a first control valve provided in the first cylinder hydraulic circuit between the hydraulic pump and the first hydraulic cylinder and configured to switch a first supplied oil chamber between two oil chambers of the first hydraulic cylinder, the hydraulic fluid being supplied to the first supplied oil chamber, the first control valve being configured to adjust an amount of the hydraulic fluid supplied to the first supplied oil chamber per unit time by a first opening area;

a second control valve provided in the second cylinder hydraulic circuit between the hydraulic pump and the second hydraulic cylinder and configured to switch a second supplied oil chamber between the two oil chambers of the second hydraulic cylinder, the hydraulic fluid being supplied to the first supplied oil chamber, the second control valve being configured to adjust an amount of the hydraulic fluid supplied to the second supplied oil chamber per unit time by a second opening area; and a pressure control mechanism comprising:

a first pressure compensation valve provided at the first cylinder hydraulic circuit between the first control valve and the hydraulic pump and configured to control a first output hydraulic pressure applied to the first supplied oil chamber via the first control valve and a first input hydraulic pressure applied to the first control valve via the first pressure compensation valve such that the first output hydraulic pressure is lower than the first input hydraulic pressure by a first pressure; and a second pressure compensation valve provided in the second cylinder hydraulic circuit between the second control valve and the hydraulic pump and configured to control a second output hydraulic pressure applied to the second supplied oil chamber via the second control valve and a second input hydraulic pressure applied to the second control valve via the second pressure compensation valve such that the second output hydraulic pressure is lower than the second input hydraulic pressure by the first pressure, wherein the control circuitry is configured to perform additional processes in response to the instruction received by the input device, the additional processes comprising:

obtaining a maximum allowable value of a sum of the first opening area and the second opening area based on the rotation speed of the engine upon receiving the instruction;

obtaining a limit value that is a sum of a maximum value of the first opening area and a maximum value of the second opening area;

determining a reference value which is smaller among the maximum allowable value and the limit value;

calculating, from the first initial position and the first reference position, a first volume of the hydraulic fluid supplied from the hydraulic pump to the first the first hydraulic cylinder to change the position of the first hydraulic cylinder to the first reference position;

calculating, from the second initial position and the second target position, a second volume of the hydraulic fluid supplied from the hydraulic pump to the second hydraulic cylinder to set the position of the second hydraulic cylinder to the second target position; and controlling, while the position of the first hydraulic cylinder is changed from the first initial position to the first reference position, the first opening area of the first control valve based on a reference area which is the reference value multiplied by an additional quotient, the additional quotient being the first volume divided by a sum of the first volume of the second volume.

6. The work vehicle according to claim 5, wherein the control circuitry is configured to set corrected area obtained by multiplying the reference area by a first correction coefficient associated with the rotation speed of the engine as a first target area when the corrected area is equal to or less than the maximum value of the first opening area, wherein the control circuitry is configured to set the maximum value of the first opening area as the first target area when the corrected area is larger than the maximum value of the first opening area, and wherein the control circuitry is configured to perform feedforward control so that the first opening area of the first control valve is set to the first target area while the position of the first hydraulic cylinder is changed from the first initial position to the first reference position.

7. The work vehicle according to claim 6, wherein the control circuitry performs feedforward control so that the second opening area of the second control valve is set to a second target area obtained by subtracting the first target area from the reference value while the position of the first hydraulic cylinder is changed from the first initial position to the first reference position.

8. The work vehicle according to claim 7, wherein the control circuitry is configured to obtain the arm height detected by the arm posture detection sensor, calculate a target value of the first parameter which corresponds to the arm height based on the target operation, acquire a detected value of the first parameter detected by the implement posture detection sensor, and perform feedback control of the first opening area of the first control valve such that the detected value approaches the target value when an absolute value of a difference between the detected value and the first reference value is larger than an absolute value of a difference between the target value and the first reference value by a first threshold value or more.

9. The work vehicle according to claim 8, wherein the control circuitry is configured to perform feedforward control such that the first opening area of the first control valve is set to a value obtained by multiplying the first target area by a second correction coefficient from a start timing until the position of the first hydraulic cylinder reaches the first reference position, an absolute value of a difference between the detected value and the first reference value becomes smaller than a value obtained by adding a second threshold value which is smaller than the first threshold value to an absolute value of a difference between the target value and the first reference value at the start timing after the feedback control is started, the second correction coefficient being a value obtained by dividing a control amount of the first control valve in the feedback control immediately before the start timing by a control amount of the first control valve when the feedforward control is performed such that the first opening area becomes the first target area.

10. The work vehicle according to claim 5, wherein the memory is configured to store a first approach speed and a first deceleration, the first approach speed being an amount of change in positions of the first hydraulic cylinder per unit time immediately before the position of the first hydraulic cylinder reaches the first reference position, a displacement speed of the first hydraulic cylinder decreasing to the first approach speed at the first deceleration, and wherein the control circuitry is configured to obtain detected positions of the first hydraulic cylinder detected by the implement posture detection sensor, obtain, from a temporal change in the detected positions, the displacement speed of the first hydraulic cylinder which is an amount of change in the detected positions of the first hydraulic cylinder per unit time, calculate a first deceleration time obtained by dividing the first deceleration into a difference between the displacement speed of the first hydraulic cylinder and the first approach speed, calculate a deceleration start position of the first hydraulic cylinder at which the first hydraulic cylinder starts decelerating based on the displacement speed of the first hydraulic cylinder, the first deceleration time, and the first reference position, and control the first opening area of the first control valve such that the displacement speed of the first hydraulic cylinder decreases at the first deceleration until the displacement speed of the first hydraulic cylinder reaches the first approach speed after the detected position of the first hydraulic cylinder reaches the deceleration start position of the first hydraulic cylinder.

11. The work vehicle according to claim 10, wherein the memory is configured to store a second approach speed and a second deceleration, the second approach speed being an amount of change in positions of the second hydraulic cylinder per unit time immediately before the position of the second hydraulic cylinder reaches the second reference position, a displacement speed of the second hydraulic cylinder decreasing to the second approach speed at the second deceleration, and wherein the control circuitry is configured to obtain detected positions of the second hydraulic cylinder detected by the arm posture detection sensor, obtain from a temporal change in the detected positions, the displacement speed of the second hydraulic cylinder, which is an amount of change in the detected positions of the second hydraulic cylinder per unit time, calculate a second deceleration time by dividing the second deceleration into a difference between the displacement speed of the second hydraulic cylinder and the second approach speed, calculate a deceleration start position of the second hydraulic cylinder at which the second hydraulic cylinder starts decelerating based on the displacement speed of the second hydraulic cylinder, the second deceleration time, and the second reference position, and control the second opening area of the second control valve such that the displacement speed of the second hydraulic cylinder decreases at the second deceleration until the displacement speed of the second hydraulic cylinder reaches the second approach speed after the detected positions of the second hydraulic cylinder reaches the deceleration start position of the second hydraulic cylinder.

12. The work vehicle according to claim 3, wherein the arm assembly includes a link mechanism configured to couple the arm distal end onto the vehicle body, wherein the arm posture detection sensor is a rotation angle detection sensor configured to detect a rotation angle of a joint of the link mechanism, wherein the implement posture detection sensor comprises a first inertial measurement unit attached to the implement, and a second inertial measurement unit attached to the vehicle body, wherein the memory stores first relational data in which a position of the first hydraulic cylinder is associated with a sum of an implement inclination angle and an adjustment angle, the implement inclination angle being formed by the implement direction and a vehicle reference direction by which a posture of the vehicle body is defined, the adjustment angle being a variation of the implement inclination angle in accordance with the arm height when the position of the first hydraulic cylinder is unchanged, wherein the memory stores third relational data in which the rotation angle is associated with the arm height and fifth relational data in which the adjustment angle is associated with the arm height, wherein the control circuitry is configured to acquire a first angle formed by a gravity direction and the vehicle reference direction by an output signal from the second inertial measurement unit, acquire a second angle formed by the gravity direction and the implement direction by an output signal from the first inertial measurement unit, obtain the implement inclination angle based on the first angle and the second angle;

acquire the rotation angle from the rotation angle detection sensor, obtain the adjustment angle from the rotation angle by referring to the third relational data and the fifth relational data, and obtain the position of the first hydraulic cylinder from the sum of the implement inclination angle and the adjustment angle by referring to the first relational data, and wherein the first parameter includes the obtained position of the first hydraulic cylinder.

13. The work vehicle according to claim 3, wherein the arm assembly includes a link mechanism configured to couple the arm proximal end onto the vehicle body, wherein the arm posture detection sensor is a rotation angle detection sensor configured to detect a rotation angle of a joint of the link mechanism, wherein the memory stores second relational data in which the rotation angle is associated with the position of the second hydraulic cylinder, wherein the control circuitry is configured to obtain the position of the second hydraulic cylinder from the rotation angle by referring to the second relational data, and wherein the second parameter includes the obtained position of the second hydraulic cylinder.

14. The work vehicle according to claim 12, further comprising:

an additional input device configured to receive a registration instruction to register the reference direction and the reference height, wherein the control circuitry is configured to perform processes in response to the registration instruction received by the additional input device, the processes comprising:

obtaining a position of the second hydraulic cylinder from the rotation angle of the joint upon reception of the registration instruction, and storing the obtained position of the second hydraulic cylinder in the memory as the second reference position.

15. The work vehicle according to claim 14, wherein the memory stores fourth relational data in which the position of the second hydraulic cylinder is associated with the arm height, wherein the control circuitry is configured to perform processes in response to the registration instruction received by the additional input device, the processes comprising:

obtaining the reference height from the second reference position obtained by referring to the fourth relational data;

obtaining the adjustment angle from the reference height by referring to the fifth relational data; calculating a reference inclination angle that is the implement inclination angle upon reception of the registration instruction, from outputs of the first inertial measurement unit and the second inertial measurement unit upon reception of the registration instruction;

obtaining the position of the first hydraulic cylinder upon reception of the registration instruction from the calculated reference inclination angle and the obtained adjustment angle by referring to the first relational data; and storing the obtained position of the first hydraulic cylinder in the memory as the first reference position.

16. A control method of a work vehicle, comprising:

acquiring a reference direction which is a standard of an implement direction from a joint to an implement tip of an implement, the joint rotatably connecting the implement to an arm distal end of the work vehicle;

acquiring a reference height which is a standard of an arm height which is a height of the implement tip with respect to a ground contact surface of a traveling device of the work vehicle in a height direction perpendicular to a traveling direction of the traveling device;

controlling a second hydraulic cylinder of the work vehicle such that the arm height approaches the reference height in response to an instruction to perform automatic control to change the implement direction to the reference direction and to decrease the arm height to the reference height;

controlling a first hydraulic cylinder of the work vehicle to change the implement direction in accordance with change in the arm height such that the implement direction is changed to the reference direction when the arm height reaches a target height which is greater than the reference height; and controlling the hydraulic circuit so that the position of the first hydraulic cylinder is unchanged until the arm height reaches the reference height while the arm height is below the target height.

17. A controller for a work vehicle, comprising:

a memory configured to store a first reference value and a second reference value, the first reference value corresponding to a reference direction which is a standard of an implement direction of a first parameter, the first parameter representing the implement direction representing an implement direction to an implement tip of an implement from a joint that rotatably connects the implement, the second reference value corresponding to a reference height which is a standard of an arm height of a second parameter, the second parameter representing the arm height which is a height of the implement tip with respect to a ground contact surface of a traveling device of the work vehicle in a height direction perpendicular to a traveling direction of the traveling device;

a processor configured to control a second hydraulic cylinder of the work vehicle such that the arm height approaches the reference height in response to an instruction to perform automatic control to change the implement direction to the reference direction and to decrease the arm height to the reference height;

the processor being configured to control a first hydraulic cylinder of the work vehicle to change the implement direction in accordance with change in the arm height such that the implement direction is changed to the reference direction when the arm height reaches a target height which is greater than the reference height; and the processor being configured to control the hydraulic circuit so that the position of the first hydraulic cylinder is unchanged until the arm height reaches the reference height while the arm height is below the target height.

18. The work vehicle according to claim 3, wherein the arm assembly includes a link mechanism configured to couple the arm distal end onto the vehicle body, wherein the arm posture detection sensor is a linear sensor configured to detect a position of the second hydraulic cylinder, wherein the implement posture detection sensor comprises a first inertial measurement unit attached to the implement, and a second inertial measurement unit attached to the vehicle body, wherein the memory stores first relational data in which the position of the first hydraulic cylinder is associated with a sum of an implement inclination angle and an adjustment angle, the implement inclination angle being formed by the implement direction and a vehicle reference direction by which a posture of the vehicle body is defined, the adjustment angle being a variation of the implement inclination angle in accordance with the arm height when the position of the first hydraulic cylinder is unchanged, wherein the memory stores fourth relational data in which the position of the second hydraulic cylinder is associated with the arm height and fifth relational data in which the adjustment angle is associated with the arm height, and wherein the control circuitry is configured to acquire a first angle formed by a gravity direction and the vehicle reference direction by an output signal from the second inertial measurement unit, acquire a second angle formed by the gravity direction and the implement direction by an output signal from the first inertial measurement unit, obtain the implement inclination angle based on the first angle and the second angle;

acquire the position of the second hydraulic cylinder from the linear sensor, obtain the adjustment angle from the position of the second hydraulic cylinder by referring to the fourth relational data and the fifth relational data, and obtain the position of the first hydraulic cylinder from the sum of the implement inclination angle and the adjustment angle by referring to the first relational data, and wherein the first parameter includes the obtained position of the first hydraulic cylinder.

19. The work vehicle according to claim 1, wherein the traveling device includes at least one of a crawler or a wheel, and wherein the input device includes at least one of a switch or a button.

20. The work vehicle according to claim 14, wherein the additional input device includes at least one of a switch or a button.

* * * * *